US005298370A

United States Patent [19]

Kojima et al.

[11] Patent Number: 5,298,370

[45] Date of Patent: Mar. 29, 1994

[54] METHOD OF PROCESSING SILVER HALIDE COLOR PHOTOGRAPHIC MATERIAL AND PHOTOGRAPHIC BLEACH-FIXING COMPOSITION

[75] Inventors: Tetsuro Kojima; Hisashi Okada; Nobuo Watanabe, all of Kanagawa, Japan

[73] Assignee: Fuji Photo Film Co., Ltd., Kanagawa, Japan

[21] Appl. No.: 882,492

[22] Filed: May 13, 1992

[30] Foreign Application Priority Data

May 14, 1991 [JP] Japan ..... 3-137064

[51] Int. Cl.[5] ..... G03C 7/00; G03C 5/44; G03C 5/38; G03C 5/18

[52] U.S. Cl. ..... 430/393; 430/428; 430/429; 430/430; 430/455; 430/460; 430/461

[58] Field of Search ..... 430/428, 429, 430, 455, 430/460, 461, 393

[56] References Cited

U.S. PATENT DOCUMENTS

| | | | |
|---|---|---|---|
| 4,378,424 | 3/1983 | Altland et al. | 430/455 |
| 4,546,070 | 10/1985 | Kishimoto et al. | 430/430 |
| 4,563,905 | 1/1986 | Ishikawa et al. | 430/461 |
| 4,590,150 | 5/1986 | Fujita | 430/428 |
| 4,695,529 | 9/1987 | Abe et al. | 430/430 |
| 4,804,617 | 2/1989 | Nishikara et al. | 430/428 |
| 4,804,618 | 2/1989 | Ueda et al. | 430/461 |
| 4,845,017 | 7/1989 | Kishimoto et al. | 430/461 |
| 5,002,860 | 3/1991 | Ishikawa et al. | 430/460 |
| 5,011,763 | 4/1991 | Morimoto et al. | 430/461 |
| 5,093,228 | 3/1992 | Nakamura | 430/455 |
| 5,188,927 | 2/1993 | Okada et al. | 430/393 |

FOREIGN PATENT DOCUMENTS

| | | | |
|---|---|---|---|
| 0353738 | 2/1990 | European Pat. Off. . | |
| 2554861 | 6/1976 | Fed. Rep. of Germany . | |
| 5089034 | 4/1961 | Japan . | |
| 3922095 | 10/1964 | Japan | 430/428 |
| 513231 | 3/1967 | Japan . | |
| 434135 | 2/1968 | Japan . | |
| 5037436 | 2/1970 | Japan . | |
| 1083534 | 4/1986 | Japan | 430/428 |
| 1250646 | 11/1986 | Japan | 430/418 |
| 2123459 | 6/1987 | Japan | 430/430 |
| 1210951 | 8/1989 | Japan | 430/460 |

OTHER PUBLICATIONS

Goto et al., U.S. Statutory Invention Registration, H953, Aug. 6, 1991.

*Primary Examiner*—Charles L. Bowers, Jr.
*Assistant Examiner*—James Pastevczyk
*Attorney, Agent, or Firm*—Sughrue, Mion, Zinn, Macpeak & Seas

[57] ABSTRACT

A method of processing a silver halide color photographic material using a carbamoyl or imidazole type organic metal complex bleaching agent of any of compounds of formulae (I), (II), (III), (IV), and (V) and a mercapto, mesoionic or thioether fixing agent of compounds of formulae (A), (B) and (C). A bleach-fixing composition containing the bleaching agent and fixing agent is also disclosed. The processing method provides good desilvering with little bleach fogging of the processed photographic material, and the processing composition has good stability. W in formula (III) below represents a divalent linking group.

(I)

(II)

(III)

(IV)

-continued
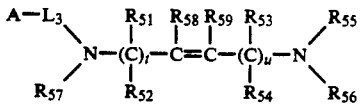
(V)
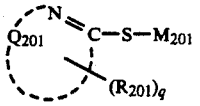
(A)
-continued
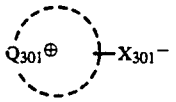
(B)
$L_{401}-(A_{401}-L_{402})_r-A_{402}-L_{403}$ (C)
6 Claims, No Drawings

METHOD OF PROCESSING SILVER HALIDE COLOR PHOTOGRAPHIC MATERIAL AND PHOTOGRAPHIC BLEACH-FIXING COMPOSITION

FIELD OF THE INVENTION

The present invention relates to a method of processing a silver halide color photographic material and to a photographic bleach-fixing composition. More particularly, the present invention relates to a method of processing a silver halide color photographic material resulting in little bleaching fog and having excellent desilverability and bath stability, as well as to a photographic bleach-fixing composition for carrying out the method.

BACKGROUND OF THE INVENTION

In general, the processing of a silver halide color photographic material comprises a color development step and a desilvering step. In the latter desilvering step, the developed silver formed in the color development step is oxidized to a silver salt with a bleaching agent having an oxidizing ability (bleaching), and the silver salt is then removed from the photographic layer by a fixing agent which forms soluble silver along with the non-used silver halide (fixation). Bleaching and fixation are effected either independently as separate bleaching and fixing steps, or simultaneously as a bleach-fixing step. The details of the processing steps are described in James, *The Theory of Photographic Process,* 4th Ed. (1977).

The above-described processing is generally carried out using an automatic developing machine. Recently, the use of a small-sized automatic developing machine called a mini-laboratory in photo processing shops has become popular for providing rapid processing service to customers.

Under these circumstances, rapid processing of photographic materials is presently in strong demand, such that further enhancements in rapid processing of the bleaching step, fixing step and bleach-fixing step are increasingly desired.

Since photographic processing has come to be carried out in various places, treatment of the waste liquid generated from the processing has become a serious problem.

Ferric ethylenediaminetetraacetate complex which has heretofore been used in a bleaching step has a fatal drawback characterized by a weak oxidizing capacity. Even when concurrently using a bleaching accelerator, the ferric complex still does not provide rapid bleaching.

Known bleaching agents useful for rapid bleaching include red prussiate of potash, iron chloride and bromates. However, these bleaching agents can not be widely used due to various problems. Particularly, red prussiate of potash causes environmental pollution; iron chloride causes corrosion of metals; and bromates are unstable in the form of a solution thereof. Accordingly, bleaching agents are desired which provide rapid bleaching, which can be handled with ease and which are free from the problem of generating harmful wastes.

Recently, as a bleaching agent satisfying the above-described conditions, ferric 1,3-diaminopropanetetraacetate complex has been proposed. However, this bleaching agent causes bleaching fog, and therefore is not entirely satisfactory.

On the other hand, thiosulfates are generally used as a fixing agent in a fixing step. However, the salts are oxidized and decompose to form sulfide precipitates. In most cases, therefore, sulfites are added to the step as a preservative for preventing oxidation and deterioration of the fixing agent. Further improvement of the stability of the fixing processing liquid is desired, while also reducing the replenishment amount. When an elevated amount of sulfites is added to the fixing step to reduce the amount of replenisher thereto, the additional sulfite does not fully dissolve in the bath or tends to be oxidized to form salt cake precipitates. In order to overcome these problems and to attain rapid processing, compounds having a better fixing capacity than thiosulfates are desired.

In processing color photographic papers, the bleaching agent and the fixing agent are contained in a common bath as a bleach-fixing bath, for attaining rapid processing. The bleaching agent generally used in this case is a ferric ethylenediaminetetraacetate complex. Recently, in order to further advance rapid processing, an oxidizing agent having a higher oxidizing power (or having a higher redox potential), such as ferric 1,3-diaminopropanetetraacetate complex, has been used in a bleach-fixing bath. However, the above noted oxidizing agent causes extreme bleaching fog and further contributes to oxidation and deterioration of thiosulfates in the bath, and is therefore not practically useful. In particular, the problems of the complex, as an oxidizing agent, are inconsistent with the development of processing systems using a reduced amount of replenisher.

In view of the above, the development of a bleaching agent and fixing agent which are free from the above-described problems and a processing composition containing the same, as well as a processing method using these processing compositions is highly desired.

SUMMARY OF THE INVENTION

Accordingly, a first object of the present invention is to provide a processing composition having excellent desilverability and a processing method using the processing composition.

A second object of the present invention is to provide a processing composition which does not cause bleaching fog, and a processing method using the same.

A third object of the present invention is to provide a processing composition, the use of which provides increased stability of the fixing bath and a successive bath, and a processing method using the same.

In formulae (III), (VII), (IX), (XI) and (XIII) below, the symbol "W" represents a divalent linking group, and is not to be confused with the element tungsten. Similarly, the symbol "Y" in formula (E) below represents O (oxygen), S (sulfur), N (nitrogen) or N—$R_{304}$ (Where $R_{304}$ is defined below), and is not to be confused with the element yttrium. Likewise, the symbols "B" and "La" used to define preferred groups represented by the divalent linking group W below should not be confused with the elements boron and lanthanum, respectively.

The above-described objects have been attained by the following processing method and processing composition.

In accordance with the present invention, a method of processing an imagewise exposed silver halide color photographic material is provided, said photographic material comprising a support having thereon at least one light-sensitive silver halide emulsion layer, comprising the steps of developing in a developing bath, bleaching in a bath having a bleaching ability and fixing in a bath having a fixing ability, wherein the bath having a bleaching ability contains at least one metal chelate compound of any of compounds represented by formulae (I), (II), (III), (IV) and (V) and the bath having a fixing ability contains at least one compound selected from the group consisting of compounds represented by formulae (A), (B) and (C):

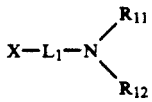

(I)

where X represents —CO—N(OH)—$R_a$, —N(OH)—CO—$R_b$, —$SO_2NR_c(R_d)$, or —$N(R_e)SO_2R_f$;

in which $R_a$ is a hydrogen atom, an aliphatic group having from 1 to 20 carbon atoms, an aromatic group having from 6 to 20 carbon atoms, or a heterocyclic group having from 1 to 20 carbon atoms;

$R_b$ is an aliphatic group having from 1 to 20 carbon atoms, an aromatic group having from 2 to 20 carbon atoms, or a heterocyclic group having from 1 to 20 carbon atoms;

$R_c$, $R_d$ and $R_e$ may be the same or different and each represents a hydrogen atom, an aliphatic group having from 1 to 20 carbon atoms, an aromatic group having from 6 to 20 carbon atoms, or a heterocyclic group having from 1 to 20 carbon atoms; and $R_f$ is an aliphatic group having from 1 to 20 carbon atoms, an aromatic group having from 6 to 20 carbon atoms, or a heterocyclic group having from 1 to 20 carbon atoms;

$L_1$ represents a divalent linking group containing an aliphatic group having from 1 to 20 carbon atoms, an aromatic group having from 6 to 20 carbon atoms, a heterocyclic group having from 1 to 20 carbon atoms or a group comprising a combination of these groups; and $R_{11}$ and $R_{12}$ may be same or different and each represents a hydrogen atom, an aliphatic group having from 1 to 20 carbon atoms, an aromatic group having from 6 to 20 carbon atoms, or a heterocyclic group having from 1 to 20 carbon atoms;

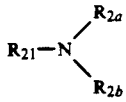

(II)

where $R_{21}$ has the same meaning as $R_{11}$ in formula (I); and $R_{2a}$ and $R_{2b}$ may be same or different and each represents —$Y_1$—C—(=$X_1$)—N($R_h$)—$R_g$, or —$Y_2$—N($R_i$)—C(=$X_2$)—$R_j$;

in which $Y_1$ and $Y_2$ each have the same meaning as $L_1$ in formula (I);

$R_g$, $R_h$ and $R_i$ each have the same meaning as $R_a$ in formula (I);

$R_j$ is an aliphatic group having from 1 to 20 carbon atoms, an aromatic group having from 6 to carbon atoms, a heterocyclic group having from 1 to 20 carbon atoms, —$NR_k(R_l)$, or —$OR_m$;

$R_k$ and $R_l$ each have the same meaning as $R_a$ in formula (I);

$R_m$ is an aliphatic group having from 1 to 20 carbon atoms, an aromatic group having from 6 to 20 carbon atoms, or a heterocyclic group having from 1 to 20 carbon atoms; and $X_1$ and $X_2$ may be the same or different, and each represents an oxygen atom or a sulfur atom;

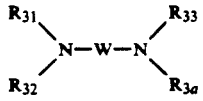

(III)

where $R_{31}$, $R_{32}$ and $R_{33}$ each have the same meaning as $R_{11}$ in formula I);

$R_{3a}$ has the same meaning as $R_{2a}$ in formula (II); and

W represents a divalent linking group;

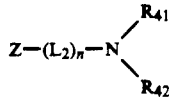

(IV)

where $R_{41}$ and $R_{42}$ each have the same meaning as $R_{11}$ in formula I);

$L_2$ represents a divalent linking group;

Z represents a heterocyclic group having from 1 to 20 carbon atoms; and n represents 0 or 1.

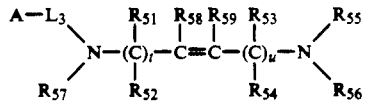

(V)

where $L_3$ represents a divalent linking group containing an aliphatic group having from 1 to 20 carbon atoms, an aromatic group having from 6 to 20 carbon atoms, a heterocyclic group having from 1 to 20 carbon atoms or a group comprising a combination of these groups;

A represents a carboxyl group, a phosphono group, a sulfo group, or a hydroxyl group;

$R_{51}$, $R_{52}$, $R_{53}$, $R_{54}$, $R_{55}$, $R_{56}$ and $R_{57}$ may be same or different and each represents a hydrogen atom, an aliphatic group having from 1 to 20 carbon atoms, an aromatic group having from 6 to 20 carbon atoms, or a heterocyclic group having from 1 to 20 carbon atoms;

$R_{58}$ and $R_{59}$ may be same or different and each represents a hydrogen atom, an aliphatic group having from 1 to 20 carbon atoms, an aromatic group having from 6 to 20 carbon atoms, a heterocyclic group having from 1 to 20 carbon atoms, a halogen atom, a cyano group, a nitro group, an acyl group, a sulfamoyl group, a carbamoyl group, an alkoxycarbonyl group, an aryloxycarbonyl group, a sulfonyl group, or a sulfinyl group; or $R_{58}$ and $R_{59}$ may be bonded to each other to form a ring; and t and u each represents 0 or 1;

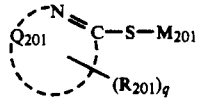

(A)

where $Q_{201}$ represents an atomic group necessary for forming a 5-membered or 6-membered hetero ring, which ring may be condensed with one or more carbon-aromatic rings or hetero-aromatic rings;

$R_{201}$ represents an alkyl, alkenyl, aralkyl, aryl or heterocyclic group substituted by at least one substituent selected from the group consisting of a carboxylic acid group or salt thereof, a sulfonic acid group or salt thereof, a phosphonic acid group or salt thereof, an amino group and an ammonium salt, or $R_{201}$ represents a mere bond;

q represents an integer of from 1 to 3; and $M_{201}$ represents a cationic group;

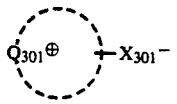

(B)

where $Q_{301}$ represents a 5-membered or 6-membered mesoionic ring composed of carbon, nitro9en, oxygen, sulfur and/or selenium atoms;

$X_{301}^-$ represents $—O^-$, $—S^-$, or $—N^-R_{301}$; and $R_{301}$ represents an alkyl group having from 1 to 20 Carbon atoms, a cycloalkyl group having from 1 to 20 carbon atoms, an alkenyl group having from 1 to 20 carbon atoms, an alkynyl group having from 1 to 20 carbon atoms, an aralkyl group having from 1 to 20 carbon atoms, an aryl group having from 6 to 20 carbon atoms, or a heterocyclic group having from 1 to 20 carbon atoms;

$$L_{401}—(A_{401}—L_{402})_r—A_{402}—L_{403} \quad (C)$$

where $L_{401}$ and $L_{403}$ may be same or different and each represents an alkyl group, an aryl group, an aralkyl group, an alkenyl group, or a heterocyclic group;

$L_{402}$ represents an alkylene group having from 1 to 12 carbon atoms, an arylene group having from 6 to 20 carbon atoms, an aralkylene group having from 7 to 20 carbon atoms, a heterocyclic linking group, or a linking group comprising combination of these groups;

$A_{401}$ and $A_{402}$ may be same or different and each represents —S—, —O—, $—NR_{420}—$, —CO—, —CS—, $—SO_2—$, or a group comprising combination of these groups;

r represents an integer of from 1 to 10;

provided that at least one of $L_{401}$ and $L_{403}$ must be substituted by $—SO_3M_{401}$, $—PO_3M_{402}M_{403}$, $—NR_{401}(R_{402})$, $—N^+R_{403}(R_{404})(R_{405}).X_{401}^-$, $—SO_2NR_{406}(R_{407})$, $—NR_{408}SO_2R_{409}$, $—CONR_{410}(R_{411})$, $—NR_{412}COR_{413}$, $—SO_2R_{414}$, $—PO(—NR_{415}(R_{416}))_2$, $—NR_{417}CONR_{418}(R_{419}$, $—COOM_{404}$ or a heterocyclic group;

$M_{401}$, $M_{402}$, $M_{403}$ and $M_{404}$ may be same or different and each represents a hydrogen atom or a pair cation;

$R_{401}$ to $R_{420}$ may be same or different and each represents a hydrogen atom, an alkyl group having from 1 to 20 carbon atoms, an aryl group having from 6 to 20 carbon atoms, an aralkyl group having from 7 to 20 carbon atoms, or an alkenyl group having from 1 to 20 carbon atoms; and $X_{401}^-$ represents a pair anion;

provided that at least one of $A_{401}$ and $A_{402}$ must be —S—.

In accordance with the present invention, a photographic bleach-fixing composition is also provided containing at least one metal chelate compound of any of compounds of the above-described formulae (I), (II), (III), (IV) and (V) and at least one compound selected from those of the above-described formulae (A), (B) and (C).

DETAILED DESCRIPTION OF THE INVENTION

The bath having a bleaching ability as referred to herein includes a bleaching bath and a bleach-fixing bath. The bath having a fixing ability as referred to herein includes a fixing bath and a bleach-fixing bath. The processing sequences using these bathes include various combinations of bleaching→fixing; bleach-fixing; bleaching →bleach-fixing→fixing→bleach-fixing; and bleaching →bleach-fixing→fixing. As needed, a rinsing step or the like intermediate step may be introduced between individual steps of the above described processing sequences.

The bleach-fixing composition of the present invention is generally in the form of a bleach-fixing solution. The processing composition of the present invention may also be a replenisher or a supply kit (as a solution or viscous liquid).

Compounds of formula (I) for use in the present invention are explained in detail below.

In formula (I), X represents $—CO—N(OH)—R_a$, $—N(OH)CO—R_b$, $—SO_2NR_c(R_d)$, or $—N(R_e)SO_2R_f$; $R_a$ is a hydrogen atom, an aliphatic group having from 1 to 20 Carbon atoms, an aromatic group having from 6 to 20 carbon atoms, or a heterocyclic group having from 1 to 20 carbon atoms; $R_b$ is an aliphatic group having from 1 to 20 carbon atoms, an aromatic group having from 6 to 20 carbon atoms, or a heterocyclic group having from 1 to 20 carbon atoms; $R_c$, $R_d$ and $R_e$ may be the same or different and each represents a hydrogen atom, an aliphatic group having from 1 to 20 carbon atoms, an aromatic group having from 6 to 20 carbon atoms, or a heterocyclic group having from 1 to 20 carbon atoms; $R_f$ is an aliphatic group having from 1 to 20 carbon atoms, an aromatic group having from 6 to 20 carbon atoms, or a heterocyclic group; $L_1$ represents a divalent linking group containing an aliphatic group having from 1 to 20 carbon atoms, an aromatic group having from 6 to 20 carbon atoms, a heterocyclic group having from 1 to 20 carbon atoms or a group comprising combination of these groups; and $R_{11}$ and $R_{12}$ may be same or different and each represents a hydrogen atom, an aliphatic group having from 1 to 20 carbon atoms, an aromatic group having from 6 to 20 carbon atoms, or a heterocyclic group having from 1 to 20 carbon atoms.

The aliphatic group represented by $R_a$ is a linear, branched or cyclic alkyl, alkenyl or alkynyl group, having from 1 to 20, preferably from 1 to 10 carbon atoms. As the aliphatic group, more preferred is an alkyl group; and most preferred is an alkyl group having from 1 to 4 carbon atoms. The aromatic group represented by $R_a$ is a monocyclic or bicyclic aryl group having from 6 to 20, preferably from 6 to 12 carbon atoms, which includes, for example, a phenyl group and a naphthyl group. A phenyl group is preferred. The heterocyclic group having from 1 to 20 carbon atoms represented by $R_a$ is a 3-membered to 10-membered saturated or unsaturated heterocyclic group, containing at least one of N, O and S atoms. The heterocyclic group may be either monocyclic or in the form of a condensed ring with one or more other aromatic rings or hetero rings. A preferred heterocyclic group is a 5-membered or 6-membered aromatic heterocyclic group, which includes, for example, thiophene, furan, pyrrole, imidazole, pyrazole, pyridine, pyrazine, pyrimidine, pyridazine, triazole, triazine, indole, indazole, purine, thiadiazole, oxadiazole, quinoline, phthalazine, naphthyridine, quinoxaline, quinazoline, cinnoline, puteridine, acridine, phenanthroline, phenazine, tetrazole, thiazole and oxazole rings. More preferred, as the aromatic heterocyclic group, are pyrrole, imidazole, pyrazole, pyridine, pyrazine, pyrimidine, triazole, thiadiazole, oxadiazole, quinoxaline, tetrazole, thiazole and oxazole rings; and most preferred are pyrrole, imidazole, pyridine, triazole, thiadiazole, oxadiazole, quinoxaline, tetrazole, thiazole and oxazole rings.

$R_1$ may have substituent(s) having from 1 to 20, preferably from 1 to 12 carbon atoms. Examples of the substituents include an alkyl group, an aralkyl group, an alkenyl group, an alkynyl group, an alkoxy group, an aryl group, an amino group, an acylamino group, a sulfonylamino group, an ureido group, an urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfone group, a carboxyl group, a phosphono group, an aryloxycarbonyl group, an acyl group, an alkoxycarbonyl group, an acyloxy group, a carbonamido group, a sulfonamido group, a nitro group, a hydroxamic acid group and a heterocyclic group.

The aliphatic group, aromatic group and heterocyclic group represented by $R_b$, $R_c$, $R_d$, $R_e$ and $R_f$ have the same meanings as the aliphatic group, aromatic group and heterocyclic group represented by $R_a$.

$R_c$ and $R_d$, and $R_e$ and $R_f$ may be bonded to each other to from a ring. Examples of the ring formed by the bonding include morpholine ring, piperidine ring, pyrrolidine ring, and pyrazine ring.

$L_1$ represents a divalent linking group containing an aliphatic group having from 1 to 20 carbon atoms, an aromatic group having from 6 to 20 carbon atoms, a heterocyclic group having from 1 to 20 carbon atoms or a group comprising combination of these groups. Preferred as the divalent linking group are an alkylene group having from 1 to 10 carbon atoms, an arylene group having from 6 to 10 carbon atoms, an aralkylene group having from 7 to 10 carbon atoms, and a group comprising combination of any of —O—, —S—, —CO—, —$NR_0$— (where $R_0$ is a hydrogen atom, an aliphatic group, an aromatic group, a heterocyclic group or a hydroxyl group) and —$SO_2$—, and an alkylene group or an arylene group. The divalent linking group may also comprise a combination of any two or more of the groups (e.g., —$CH_2CH_2O)_2CH_2CH_2$—, —$NHSO_2CH_2CH_2SO_2$—NH—). The divalent linking group may be substituted. Examples of the substituents include those described for the group $R_a$. Preferred examples of $L_1$ are set forth below. Of these, especially preferred ar methylene group and ethylene group.

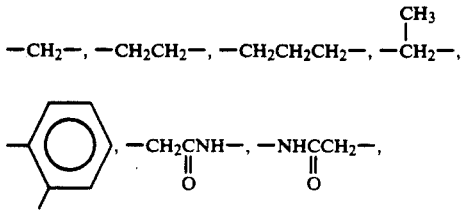

-continued

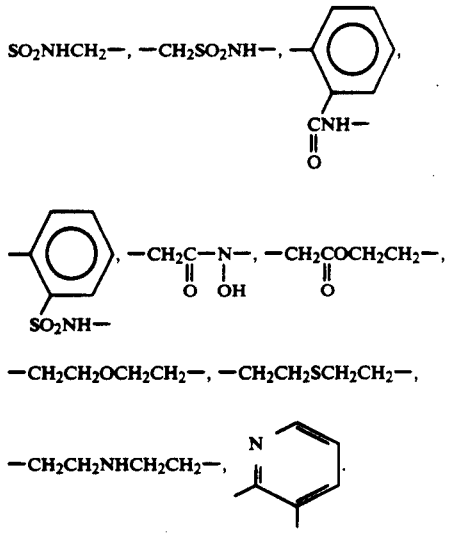

$R_{11}$ and $R_{12}$ may be same or different and each represents a hydrogen atom, an aliphatic group, an aromatic group, or a heterocyclic group. The aliphatic group represented by $R_{11}$ and $R_{12}$ is a linear, branched or cyclic alkyl, alkenyl or alkynyl group, which preferably has from 1 to 10 carbon atoms. As the aliphatic group, more preferred is an alkyl group; and most preferred is an alkyl group having from 1 to 4 carbon atoms. The aromatic group represented by $R_{11}$ and $R_{12}$ is a monocyclic or bicyclic aryl group having from 6 to 20 preferably from 6 to 12 carbon atoms, which includes, for example, a phenyl group and a naphthyl group. More preferred is a phenyl group. The heterocyclic group represented by $R_{11}$ and $R_{12}$ has the same meaning as the heterocyclic group represented by $R_a$ in formula (I). $R_{11}$ and $R_{12}$ each may be substituted. Examples of the substituents include those described above for the group $R_a$. At least one of $R_{11}$ and $R_{12}$ is preferably an alkyl, aryl or heterocyclic group substituted by at least one substituent group selected from —OH, —$COOM^1$, —$PO_3M^2M^3$ and —$SO_3M^4$. $M^1$, $M^2$, $M^3$ and $M^4$ may be same or different and each is a hydrogen atom or a cation. Examples of the cation include alkali metals (e.g., lithium, sodium, potassium), and ammonium and pyridinium groups. More preferably, at least one of $R_{11}$ and $R_{12}$ is an alkyl, aryl or heterocyclic group having a —$COOM^1$ substituent.

$R_{11}$, $R_{12}$, X and $L_1$ may be bonded to each other to form a ring.

Of the compounds of formula (I), those represented by formulae (VI), (VII), (VIII) and (IX) below are preferred.

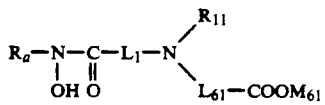

(VI)

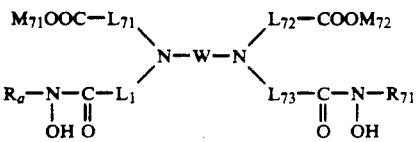

(VII)

-continued

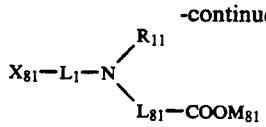

(VIII)

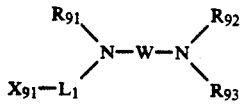

(IX)

In the above formulae, $R_{11}$, $R_a$ and $L_1$ have the same meanings as $R_{11}$, $R_a$ and $L_1$, respectively, in formula (I). $L_{61}$, $L_{71}$, $L_{72}$, $L_{73}$ and $L_{81}$ each have the same meaning as $L_1$ in formula (I). $R_{71}$ has the same meaning as $R_a$ in formula (I). $M_{61}$, $M_{71}$, $M_{72}$ and $M_{81}$ each are a hydrogen atom, or a cation (e.g., alkali metal, ammonium, pyridinium). $X_{81}$ and $X_{91}$ each are $-SO_2NR_c(R_d)$ or $-NR_e-SO_2R_f$, in which $R_c$, $R_d$, $R_e$ and $R_f$ have the same meanings as $R_c$, $R_d$, $R_e$, and $R_f$, respectively in formula (I). $R_{91}$, $R_{92}$ and $R_{93}$ each have the same meaning as $R_{11}$ in formula (I); and $R_{91}$, $R_{92}$, $R_{93}$ and $X_{91}-L_1$ may be same as or different from one another. At least one of $R_{91}$, $R_{92}$ and $R_{93}$ is $L_{x1}-COOM^{x1}$ or $L_{x2}-X_{92}$, in which $L_{x1}$ and $L_{x2}$ each have the same meaning as $L_1$ in formula (I), and $M^{x1}$ is a hydrogen atom or a cation (e.g., alkali metal, ammonium, pyridinium). Preferably, $X_{92}$ has the same meaning as $X_{91}$ in formula (IX).

W represents a divalent linking group. Preferred examples of the divalent linking group include an alkylene group having from 1 to 12, preferably from 2 to 8 carbon atoms, an arylene group having from 6 to 20, preferably from 6 to 10 carbon atoms, an aralkylene group having from 7 to 20, preferably from 7 to 10 carbon atoms, a cyclohexyl group, a heterocyclic group, $-(W^1-O-)_p-W^2-$, $-(W^1-S-)_p-W^2-$, and $-W^1-NB-W_2-$. $W^1$ and $W^2$ each are an alkylene group having from 1 to 20 carbon atoms, an arylene group having from 6 to 20 carbon atoms, an aralkylene group having from 7 to 20 carbon atoms or a heterocyclic group; p is 1, 2 or 3; B is a hydrogen atom, a hydrocarbon group having from 1 to 20 carbon atoms, $-La-COOM_{a1}$, $-La-PO_3M_{a2}M_{a3}$, $-La-OH$, or $-La-SO_3M_{a4}$; La is an alkylene group having from 1 to 8 carbon atoms, an arylene group having from 6 to 10 carbon atoms, an aralkylene group having from 7 to 10 carbon atoms, or a heterocyclic group; and $M_{a1}$, $M_{a2}$, $M_{a3}$ and $M_{a4}$ each are a hydrogen atom, or a cation (e.g., alkali metal, ammonium, pyridinium). The divalent linking group of W may comprise a combination of these groups. The divalent linking group may be substituted. Examples of the substituents include those described above for $R_a$.

Specific examples of W are as follows.

$-CH_2-$, $-(CH_2)_2-$, $-(CH_2)_3-$, $-CH_2-\underset{\underset{CH_3}{|}}{CH}-CH_2-$, $-CH_2\underset{\underset{OH}{|}}{CH}CH_2-$, $-CH_2CH_2OCH_2CH_2-$, $-CH_2CH_2OCH_2CH_2OCH_2CH_2-$, $-CH_2CH_2SCH_2CH_2-$, $-CH_2CH_2SCH_2CH_2SCH_2CH_2-$, -continued $-CH_2CH_2\underset{\underset{CH_2COOH}{|}}{N}CH_2CH_2-$,

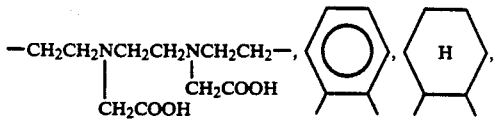

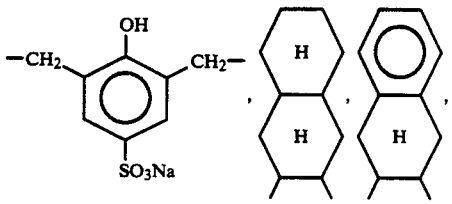

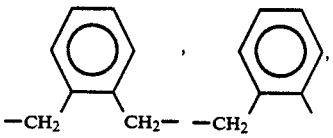

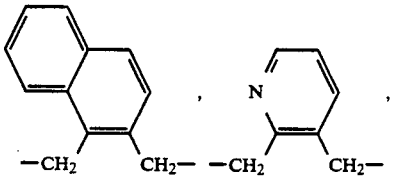

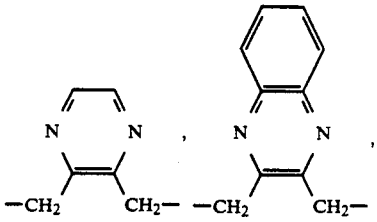

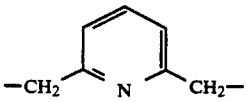

The compounds of formula (II) are explained in detail below.

In formula (II), $R_{21}$ has the same meaning as $R_{11}$ in formula (I). $R_{2a}$ and $R_{2b}$ may be the same or different and each represents $-Y_1-C-(=X_1)-N(R_h)-R_g$, or $-Y_2-N(R_i)-C(=X_2)-R_j$, in which $Y_1$ and $Y_2$ each have the same meaning as $L_1$ in formula (I). $R_g$, $R_h$ and $R_i$ each have the same meaning as $R_a$ in formula (I). $R_j$ is an aliphatic group, an aromatic group, a heterocyclic group, $-NR_k(R_l)$, or $-OR_m$. $R_k$ and $R_l$ each have the same meaning as $R_a$ in formula (I). $R_m$ is an aliphatic group, an aromatic group, or a heterocyclic group. $X_1$ and $X_2$ may be the same or different, and each represents an oxygen atom or a sulfur atom.

The aliphatic group, aromatic group and heterocyclic group represented by $R_m$ each have the same meaning as the aliphatic group, aromatic group and heterocyclic group, respectively, represented by $R_a$ in formula (I).

$R_g$ and $R_h$, $R_i$ and $R_j$, $R_k$ and $R_l$ may be bonded to each other to form a ring. Examples of the ring formed by the bonding include morpholine ring, piperidine ring, pyrrolidine ring and pyrazine ring.

Of the compounds of formula (II), those represented by formula (X) are preferred.

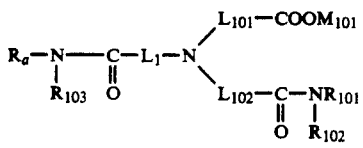

(X)

where $R_a$ and $L_1$ have the same meanings as $R_a$ and $L_1$, respectively in formula (I); $L_{101}$ and $L_{102}$ each have the same meaning as $L_1$ in formula (I); $R_{101}$, $R_{102}$ and $R_{103}$ each have the same meaning as $R_a$ in formula (I); and $M_{101}$ has the same meaning as $M_{61}$ in formula (VI).

The compounds of formula (III) are explained in detail below.

In formula (III), $R_{31}$, $R_{32}$ and $R_{33}$ each have the same meaning as $R_{11}$ in formula (I). $R_{3a}$ has the same meaning as $R_{2a}$ in formula (II). W has the same meaning as W in formula (VII).

Of the compounds of formula (III), those represented by formula (XI) are preferred.

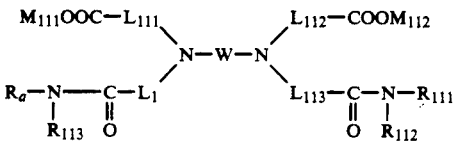

(XI)

where $R_a$ and $L_1$ have the same meanings as the corresponding groups in formula (I); $L_{111}$, $L_{112}$ and $L_{113}$ each have the Same meaning as $L_1$ in formula (I); $R_{111}$, $R_{112}$ and $R_{113}$ each have the same meaning as $R_a$ in formula (I); $M_{111}$ and $M_{112}$ each have the same meaning as $M_{61}$ in formula (VI); and W has the same meaning as W in formula (VII).

The compounds of formula (IV) are explained in detail below.

In formula (IV), $R_{41}$ and $R_{42}$ each have the same meaning as $R_{11}$ in formula (I); Z represents a heterocyclic group, which has the same meaning as the heterocyclic group of $R_a$ in formula (I); and n represents 0 or 1.

$L_2$ represents a divalent linking group, which may be a linear, branched or cyclic alkylene, alkenylene or alkynylene group having from 1 to 20 carbon atoms (preferably having from 1 to 10 carbon atoms; more preferably an alkylene group, most preferably an alkylene group having from 1 to 4 carbon atoms), or an arylene group having from 6 to 20 carbon atoms (preferably having from 6 to 10 carbon atoms, such as a phenylene or naphthylene group), or an aralkylene group having from 7 to 20 carbon atoms (preferably having from 7 to 10 carbon atoms), or —CO— or —$SO_2$—, or may also be a group comprising a combination of any of —O—, —S—, —CO—, —$NR^{00}$— (where $R^{00}$ is a hydrogen atom, an aliphatic group, an aromatic group, a heterocyclic group, or a hydroxyl group) and —$SO_2$—, and an alkylene, arylene or heterocyclic group. The divalent linking group may also comprise a combination of any two or more of these groups. The divalent linking group may be substituted. Examples of the substituents include those described above for the group $R_a$.

Preferred examples of $L_2$ are given below.

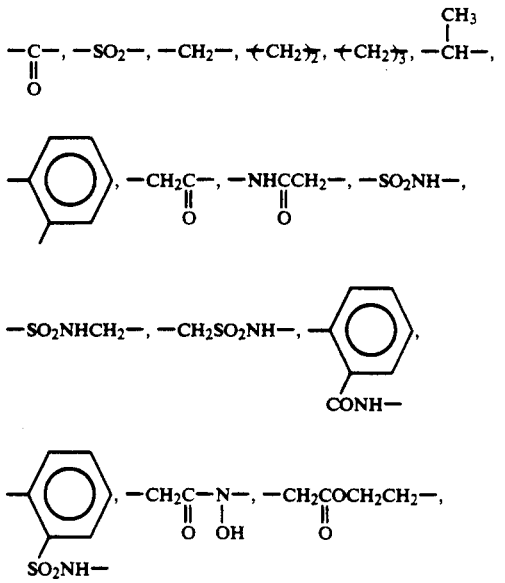

Also, $R_{41}$, $R_{42}$, Z and $L_2$ may be bonded to each other to form a ring.

Of the compounds of formula (IV), those represented by formulae (XII) and (XIII) are preferred.

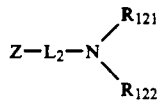

(XII)

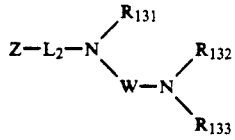

(XIII)

In these formulae, Z and $L_2$ have the same meanings as Z and $L_2$, respectively in formula (IV). W has the same meaning as W in formula (VII). $R_{121}$ and $R_{122}$ each have the Same meaning as $R_{11}$ in formula (I); and $R_{121}$, $R_{122}$ and Z—$L_2$ may be same as or different from each other. Preferably, $R_{121}$ and $R_{122}$ each are —$L_b$—OH, —$L_b$—$COOM_{b1}$, —$L_b$—$PO_3M_{b2}M_{b3}$, —$L_b$—$SO_3M_{b4}$, or —$L_B$—Za. $M_{b1}$, $M_{b2}$, $M_{b3}$ and $M_{b4}$ each are a hydrogen atom or a cation. Examples of the cation include alkali metals (e.g., lithium, sodium, potassium), and ammonium and pyridinium groups. $L_b$ has the same meaning as $L_1$ in formula (I). $L_B$ has the same meaning as $L_2$ in formula IV); and Za has the same meaning as Z in formula (IV). More preferably, $R_{121}$ and $R_{122}$ each are —$L_B$—$COOM_{b1}$ or —$L_B$—Za.

$R_{131}$, $R_{132}$ and $R_{133}$ each have the same meaning as $R_{11}$ in formula (I). $R_{131}$, $R_{132}$, $R_{133}$ and Z—$L_2$ may be same as or different from one another. Preferably, at least one of $R_{131}$ $R_{132}$ and $R_{133}$ is $Z_b$—$L_c$. $L_c$ has the meaning as $L_2$ in formula (IV); and Zb has the same meaning as Z in formula (IV).

The compounds of formula (V) are explained in detail below.

$L_3$ has the same meaning as $L_1$ in formula (I).

A represents a carboxyl group, a phosphono group, a sulfo group, or a hydroxyl group. Preferably, A is a carboxyl group or a hydroxyl group; more preferably, A is a carboxyl group.

The aliphatic group, aromatic group and heterocyclic group to be represented by $R_{51}$, $R_{52}$, $R_{53}$, $R_{54}$, $R_{55}$, $R_{56}$ $R_{57}$, $R_{58}$ and $R_{59}$ have the same meaning as $R_a$ in formula (I).

Preferably, the acyl, sulfamoyl, carbamoyl, alkoxycarbonyl, aryloxycarbonyl, sulfonyl and sulfinyl groups represented by $R_{58}$ and $R_{59}$ each have 10 or less carbon atoms (inclusive of zero).

$R_{51}$, $R_{52}$, $R_{53}$ and $R_{54}$ are preferably hydrogen atoms; and $R_{58}$ and $R_{59}$ are preferably cis-positioned.

$R_{58}$ and $R_{59}$ may be bonded to each other to form a ring.

t and u each are 0 or 1. Preferably, at least one of t and u is 1; more preferably both of t and u are 1.

Of the compounds of formula (V), those represented by formula (XIV) are preferred.

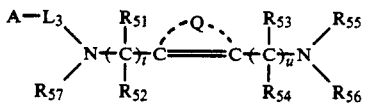

(XIV)

In formula (XIV), A, $L_3$, $R_{51}$, $R_{52}$, $R_{53}$, $R_{54}$, $R_{55}$, $R_{56}$, $R_{57}$, t and u have the same meanings as the corresponding groups in formula (V).

In formula (XIV), Q represents a non-metallic atomic group capable of forming a 5-membered or 6-membered ring. Examples of the 5-membered or 6-membered ring formed by Q include aromatic rings (e.g., benzene, naphthalene, phenanthrene, anthracene), hetero rings (e.g., pyridine, pyrazine, pyrimidine, pyridazine, thiophene, furan, pyrane, pyrrole, imidazole, pyrazole, isothiazole, isoxazole, thianthrene, isobenzofuran, chromene, xanthene, phenoxthine, indolidine, isoindole, indole, indazole, quinolidine, isoquinoline, quinoline, phthalazine, naphthyridine, quinoxaline, quinazoline, cinnoline, puteridine, carbazole, carboline, phenanthoridine, acridine, puteridine, phenanthoroline, phenazine, phenothiazine, phenoxazine, coumarone, pyrroline, pyrazoline, indoline, isoindoline), and cyclic alkenes (e.g., cyclopentene, cyclohexene). These rings may be condensed with one or more other rings. Preferred rings formed by Q are benzene, naphthalene, pyridine, pyrazine, pyrimidine, quinoline and quinoxaline rings; and more preferred is benzene ring.

The ring formed by Q may be substituted. Examples of the substituents include those described above for the group $R_a$ in formula (I).

Of the compounds of formula V), those represented by formula (XV) are preferred.

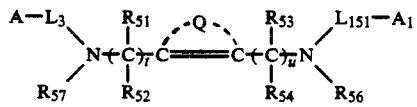

(XV)

where Q, A, $L_3$, $R_{51}$, $R_{52}$, $R_{53}$, $R_{54}$, $R_{56}$, $R_{57}$ t and u have the same meanings as the corresponding groups in formula (XIV); $L_{151}$ has the same meaning as $L_3$ in formula (V); and $A_1$ has the same meaning as A in formula (V).

Of the compounds of formula (V), those represented by formula (XVI) are especially preferred.

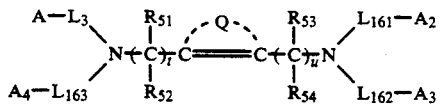

(XVI)

where Q, A, $L_3$, $R_{51}$, $R_{52}$, R\$3, $R_{54}$, t and u have the same meanings as the corresponding groups in formula (XIV); $L_{161}$, $L_{162}$ and $L_{163}$ each have the same meaning as $L_3$ in formula (V); and $A_2$, $A_3$ and $A_4$ each have the same meaning as A in formula (V).

Examples of compounds of formulae (I), (II), (III), (IV) and (V) as well as methods of preparing the same are described in Japanese Patent Application Nos. 2-27479 (EP-A-461413), 2-175026 (EP-A-458131), 2-196972, 2-01846 and 2-258539 (EP-A-461670).

Specific examples of compounds represented by formulae (I), (II), (III , (IV) and (V) are given below; however, the present invention should not be construed as being limited to these compounds.

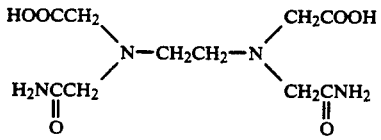

1.

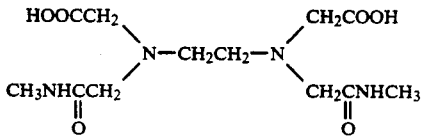

2.

-continued
3.
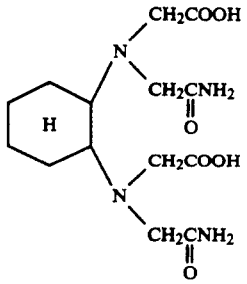
4.
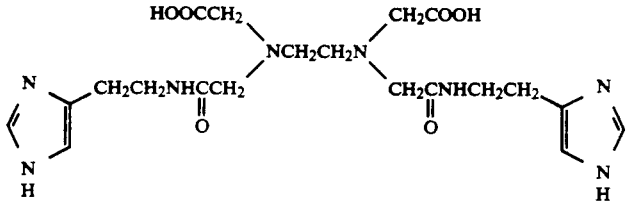
5.
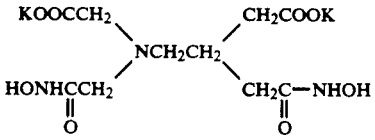
6.
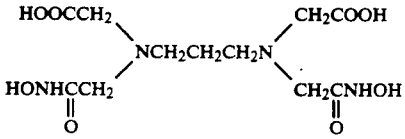
7.
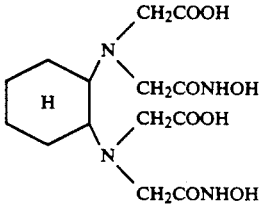
8.
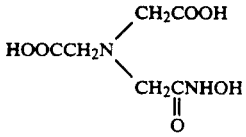
9.
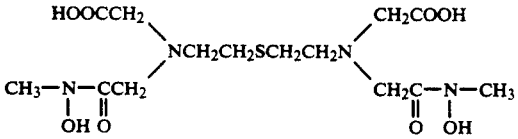
10.
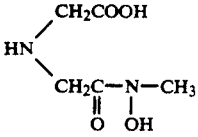
11.
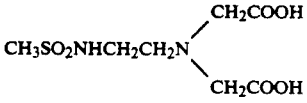
12.
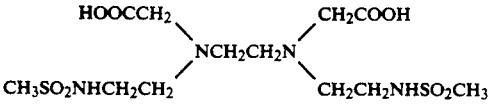

-continued
13.
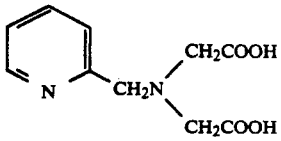
14.
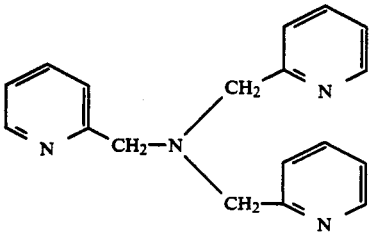
15.
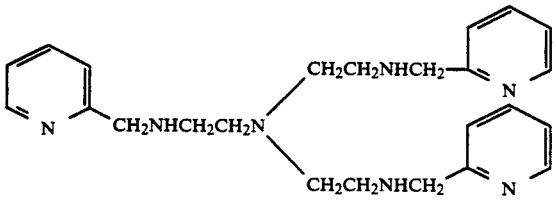
16.
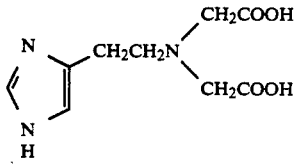
17.
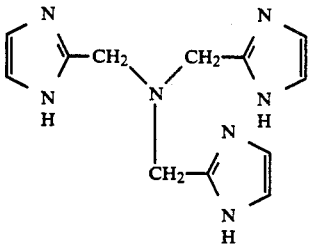
18.
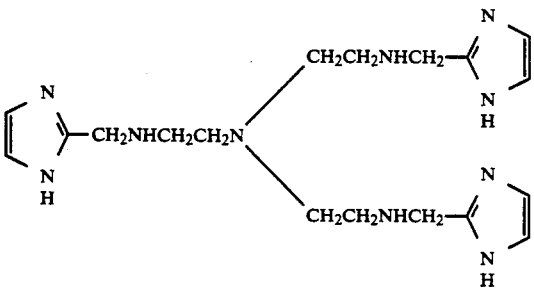
19.
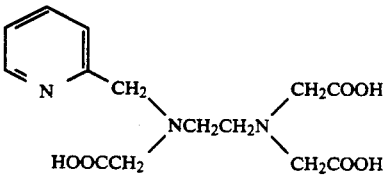

-continued
20.
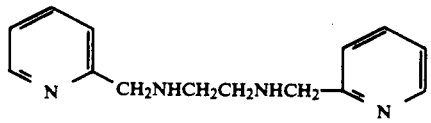
21.
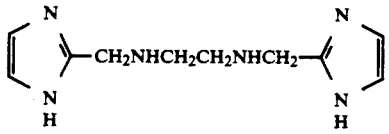
22.
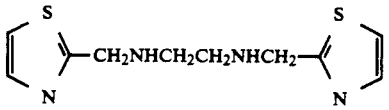
23.
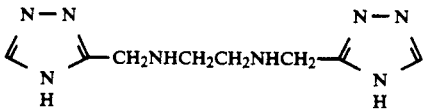
24.
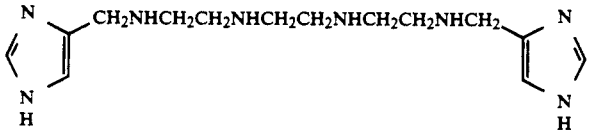
25.
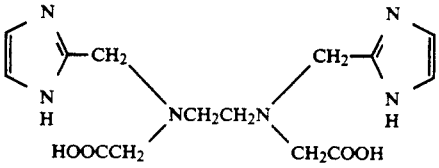
26.
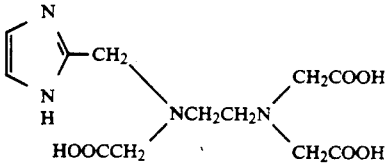
27.
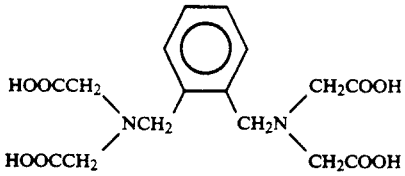
28.
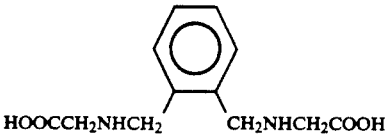
29.
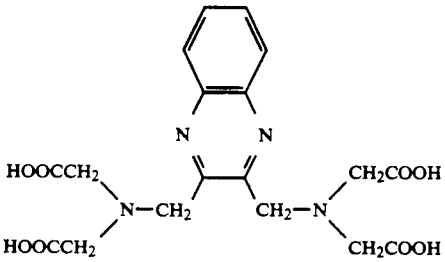

-continued
30.
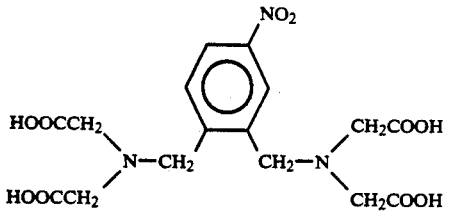
31.
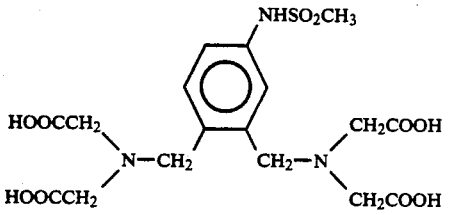
32.
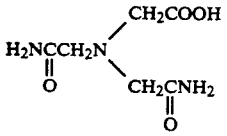
33.
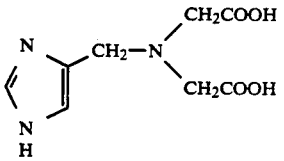
34.
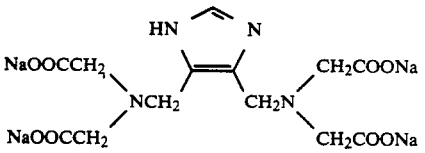
35.
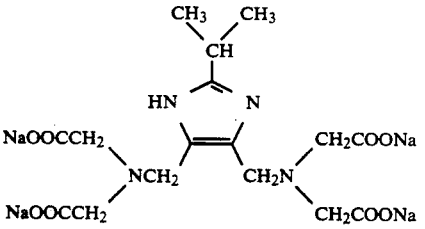
36.
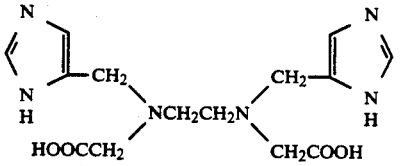
37.
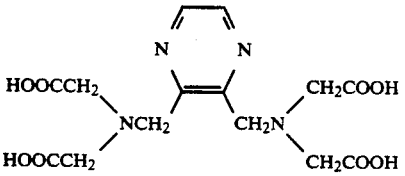

-continued

38.

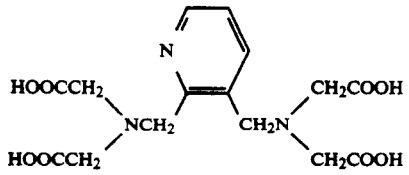

39.

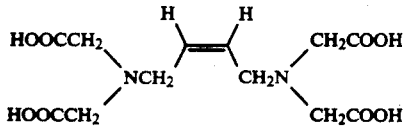

Examples of the center metal of the metal chelate compound of the present invention include Fe(III), Mn(III), Co(III), Rh(II), Rh(III), Au(III), Au(II) and Ce(IV).

The metal chelate compounds for use in the present invention may be isolated as chelating agent.

As a matter of course, one or more compounds of formulae (I), (II), (III), (IV) and/or (V) may be reacted in solution with one or more metal salts, such as ferric sulfate complexes, ferric chloride, ferric nitrate, ammonium ferric sulfate and ferric phosphate to form the metal chelate compound, before use or during use in the present invention. In this case, the one or more compounds of formulae (I), (II), (III), (IV) and/or (V) are added in an amount of 1.0 mole or more per mole of the metal ion. This ratio is preferably larger when the stability of the resulting metal chelate compound is low. In general, the molar ratio of the compound represented by formulae (I) to (V) to metal ion is from 1 to 30.

The content of the one or more metal chelate compounds of the present invention in the processing solution is from 0.05 to 1 mol per liter of the solution, to be effective as a bleaching agent in the processing solution (bleaching solution or bleach-fixing solution). If desired, a small amount, approximately from 0.05 to 0.3 mol, of the metal chelate compound may be present in the fixing solution or in the intermediate bath between the color development step and the desilvering step.

The metal chelate compound of the present invention is effectively incorporated into the processing solution having a bleaching capacity in an amount of from 0.05 to 1 mol per liter of the solution, as described above, more preferably in an amount of from 0.1 to 0.5 mol per liter of the solution.

Next, the compounds of formulae (A), (B) and (C) for use in the present invention are explained in detail below.

In formula (A), $Q_{201}$ is preferably an atomic group necessary for forming a 5-membered or 6-membered hetero ring composed of at least one of carbon, nitrogen, oxygen, sulfur and selenium atoms. The hetero ring may be condensed with one or more carbon-aromatic rings or hetero-aromatic rings.

Examples of the hetero ring formed from $Q_{201}$ include tetrazoles, triazoles, imidazoles, thiadiazoles, oxadiazoles, selenadiazoles, oxazoles, thiazoles, benzoxazoles, benzothiazoles, benzimidazoles, pyrimidines, triazaindenes, tetrazaindenes and pentazaindenes.

$R_{201}$ represents an alkyl group having from 1 to 10 carbon atoms (e.g., methyl, ethyl, propyl, butyl, isopropyl, 2-hydroxypropyl, hexyl, octyl), an alkenyl group having from 2 to 10 carbon atoms (e.g., vinyl, propenyl, butenyl), an aralkyl group having from 7 to 12 carbon atoms (e.g., benzyl, phenethyl), an aryl group having from 6 to 12 carbon atoms (e.g., phenyl, 2-chlorophenyl, 3-methoxyphenyl, naphthyl), or a heterocyclic group having from 1 to 10 carbon atoms (e.g., pyridyl, thienyl, furyl, triazolyl, imidazolyl), which group is substituted by at least one substituent selected from a carboxylic acid group or salt thereof (e.g., sodium salt, potassium salt, ammonium salt, calcium salt), a sulfonic acid group or salt thereof (e.g., sodium salt, potassium salt, ammonium salt, magnesium salt, calcium salt), a phosphonic acid or salt thereof (e.g., sodium salt, potassium salt, ammonium salt), a substituted or unsubstituted amino group (e.g., unsubstituted amino, dimethylamino, diethylamino, methylamino, bismethoxyethylamino), and a substituted or unsubstituted ammonium group (e.g., trimethylammonium, triethylammonium, dimethylbenzylammonium); or $R_{201}$ is a single bond, wherein the substituent group of $R_{201}$ is directly bonded to $Q_{201}$ In addition, $R_{201}$ may also be a group comprising a combination of any two or more Of the above-described alkyl, alkenyl, aralkyl, aryl and heterocyclic groups (e.g., hetero ring-substituted alkyl groups, a benzylidene group, hetero ring-substituted aryl group, etc.); or $R_{201}$ may also contain a linking group comprising a combination of any of —CO—, —CS—, —$SO_2$—, —$NR_{202}$—, —O— and —S—. $R_{202}$ is a hydrogen atom, an alkyl group having from 1 to 6 carbon atoms (e.g., methyl, ethyl, butyl, hexyl), an aralkyl group having from 7 to 10 carbon atoms (e.g., benzyl, phenethyl), or an aryl group having from 6 to 10 carbon atoms (e.g., phenyl, 4-methylphenyl).

$M_{201}$ represents a cation, for example, a hydrogen atom, an alkali metal atom (e.g., sodium, potassium), an alkaline earth metal atom (e.g., magnesium, calcium), or an ammonium group (e.g., ammonium, triethylammonium).

The hetero ring represented by formula (A) as well as $R_{201}$ may be substituted by one or more substituents selected from a nitro group, a halogen atom (e.g., chlorine, bromine), a mercapto group, a substituted or unsubstituted alkyl group (e.g., methyl, ethyl, propyl, t-butyl, cyanoethyl), a substituted or unsubstituted aryl group (e.g., phenyl, 4-methanesulfonamidophenyl, 4-methylphenyl, 3,4-dichlorophenyl, naphthyl), a substituted or unsubstituted alkenyl group (e.g., allyl), a substituted or unsubstituted aralkyl group (e.g., benzyl, 4-methylbenzyl, phenethyl), a substituted or unsubstituted sulfonyl group (e.g., methanesulfonyl, ethanesulfonyl, p-toluenesulfonyl), a substituted or unsubstituted carbamoyl group (e.g., unsubstituted carbamoyl, methylcarbamoyl, phenylcarbamoyl), a substituted or unsubstituted sulfamoyl group (e.g., unsubstituted sulfamoyl, methylsulfamoyl, phenylsulfamoyl), a substituted or unsubstituted carbonamido group (e.g., acetamido, benzamido), a substituted or unsubstituted sulfonamido group (e.g., methanesulfonamido, benzenesulfonamido, p-toluenesulfonamido), a substituted or unsubstituted acyloxy group (e.g., acetyloxy, benzoyloxy), a substituted or unsubstituted sulfonyloxy group (e.g., methanesulfonyloxy), a substituted or unsubstituted ureido group (e.g., unsubstituted ureido, methylureido, ethylureido, phenylureido), a substituted or unsubstituted thioureido group (e.g., unsubstituted thioureido, methylthioureido), a substituted or unsubstituted acyl group (e.g., acetyl, benzoyl), a substituted or unsubstituted oxycarbonyl group (e.g., methoxycarbonyl, phenoxycarbonyl), a substituted or unsubstituted oxycarbonylamino group (e.g., methoxycarbonylamino, phenoxycarbonylamino, 2-ethylhexyloxycarbonylamino), and a hydroxyl group.

q represents an integer of from 1 to 3. When q is 2 or 3, the two or three $R_{201}$ groups, respectively, may be same as or different from one another.

Of the compounds of formula (A), preferred are those in which $Q_{201}$ is an atomic group capable of forming any of a tetrazole, triazole, imidazole, oxadiazole, triazaindene, tetrazaindene and pentazaindene; $R_{201}$ is an alkyl group having from 1 to 6 carbon atoms and Substituted by one or two substituents selected from a carboxylic acid group or salt thereof and a sulfonic acid group or salt thereof; and q is 1 or 2.

Of the compounds of formula (A), those represented by formula (D) are more preferred:

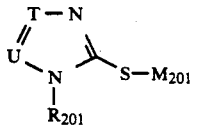

(D)

where $M_{201}$ and $R_{201}$ have the same meanings as $M_{201}$ and $R_{201}$, respectively, in formula (A); T and U each represent C— $R_{202}$ or N; $R_{202}$ represents a hydrogen atom, a halogen atom, a hydroxyl group, a nitro group, an alkyl group, an alkenyl group, an aralkyl group, an aryl group, a carbonamido group, a sulfonamido group, an ureido group, a thioureido group, or $R_{201}$; provided that when $R_{202}$ is $R_{201}$, $R_{202}$ may be same as or different from $R_{201}$ in formula (A).

Next, compounds of formula (D) will be explained in detail hereunder.

In formula (D), T and U each are C—$R_{202}$ or N, and $R_{202}$ is a hydrogen atom, a halogen atom (e.g., chlorine, bromine), a hydroxyl group, a nitro group, an alkyl group (e.g., methyl, ethyl, methoxyethyl, n-butyl, 2-ethylhexyl), an alkenyl group e.g., allyl), an aralkyl group e.g., benzyl, 4-methylbenzyl, phenethyl, 4-methoxybenzyl), an aryl group (e.g., phenyl, naphthyl, 4-methanesulfonamidophenyl, 4-methylphenyl), a carbonamido group (e.g., acetylamino, benzoylamino, methoxypropionylamino), a sulfonamido group (e.g., methanesulfonamido, benzenesulfonamido, p-toluenesulfonamido), an ureido group (e.g., unsubstituted ureido, methylureido, phenylureido), a thioureido group (e.g., unsubstituted thioureido, methylthioureido, methoxyethylthioureido, phenylthioureido), or $R_{201}$ When when $R_{202}$ is $R_{201}$ $R_{202}$ may be same as or different from $R_{201}$ in formula (A).

Of compounds of formula (D), preferred are those in which T and U are both N, or in which T and U are both (C—$R_{202}$); $R_{202}$ is a hydrogen atom, or an alkyl group having from 1 to 4 carbon atoms; and $R_{201}$ is an alkyl group having from 1 to 4 carbon atoms and substituted by one or more substituents selected from a carboxylic acid group or salt thereof and a sulfonic acid group or salt thereof.

Specific examples of the compounds of formula (A) for use in the present invention are given below, but the present invention should not be construed as being limited thereto.

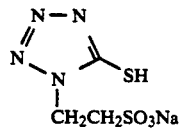

A-1.

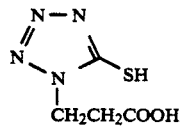

A-2.

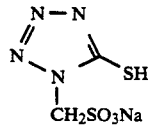

A-3.

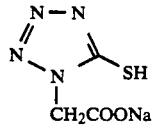

A-4.

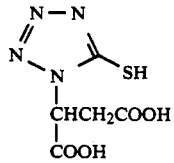

A-5.

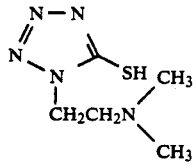

A-6.

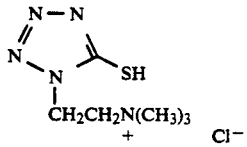

A-7.

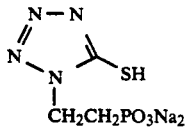

A-8.

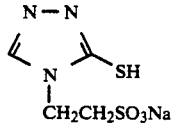

A-9.

-continued

A-10.

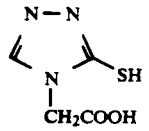

A-11.

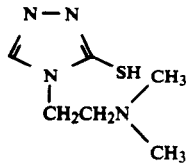

A-12.

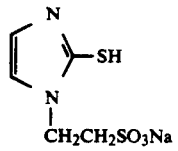

A-13.

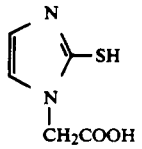

A-14.

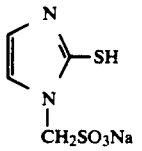

A-15.

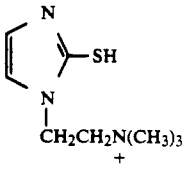

A-16.

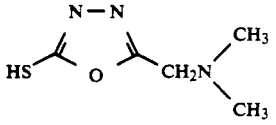

A-17.

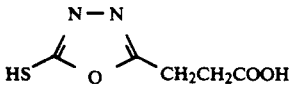

A-18.

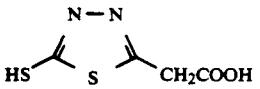

A-19.

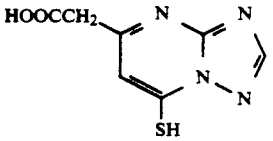

A-20.

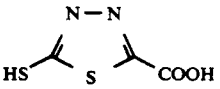

Compounds of formula (A) for use in the present invention can be prepared in accordance with the methods described in *Berichte der Deutschen Chemischen Gesellschaft*, 28, 77 (1985); JP-A-50-37436 and JP-A-51-3231 (the term "JP-A" used herein means an unexamined published Japanese patent application); U.S. Pat. Nos. 3,295,976 and 3,376,310; *Berichte der Deutschen Chemischen Gesellschaft*, 22, 568 (1989); ibid., 29, 2483 (1896); *J. Chem. Soc.*, 1932, 1806; *J. Am. Chem. Soc.*, 71, 4000 (1949); U.S. Pat. Nos. 2,585,388 and 2,541,924; *Advances in Heterocyclic Chemistry*, 9, 165 (1968); JP-B-40-38496 (term "JP-B" used herein means as examined Japanese publication); JP-A-50-89034; U.S. Pat. Nos. 3,106,467, 3,420,670, 2,271,229, 3,137,578, 3,148,066, 3,511,663, 3,060,028, 3,271,154, 3,251,691, 3,598,599 and 3,148,066; JP-B-43-4135; and U.S. Pat. Nos. 3,615,616, 3,420,664, 3,071,465, 2,444,605, 2,444,606, 2,444,607 and 2,935,404.

Next, compounds of formula (B) for use in the present invention are explained in detail below.

In formula (B), $Q_{301}$ represents a 5-membered or 6-membered mesoionic ring composed of carbon, nitrogen, oxygen, sulfur and/or selenium atoms; $X_{301}^-$ represents $-O^-$, $-S^-$, or $-N^-R_{301}$; and $R_{301}$ represents an alkyl group, a cycloalkyl group, an alkenyl group, an alkynyl group, an aralkyl group, an aryl group, or a heterocyclic group.

The mesoionic compound of formula (B) belongs to the group of compounds as defined by W. Baker and W. D. Ollis in their *Quart. Rev.*, 11, 15 (1957) and *Advances in Heterocyclic Chemistry*, 19, 1 (1976). The compounds are 5-membered or 6-membered heterocyclic compounds which can not be satisfactorily expressed by one covalent bond structural formula or polar structural formula, and have sextets of $\pi$ electrons delocalized about the ring. The ring has partial positive charges and is balanced with the equivalent negative charges on the atoms or atomic groups outside of the ring.

Examples of the mesoionic ring represented by $Q_{301}$ include an imidazolium, pyrazolium, oxazolium, thiazolium, triazolium, tetrazolium, thiadiazolium, oxadiazolium, thiatriazolium, and oxatriazolium.

$R_{301}$ represents a substituted or unsubstituted alkyl group (e.g., methyl, ethyl, n-propyl, n-butyl, isobutyl, n-octyl, carboxymethyl, dimethylaminoethyl), a substituted or unsubstituted cycloalkyl group (e.g., cyclohexyl, 4-methylcyclohexyl, cyclopentyl), a substituted or unsubstituted alkenyl group (e.g., propenyl, 2-methylpropenyl), a substituted or unsubstituted alkynyl group (e.g., propargyl, butynyl, 1-methylpropargyl), a substituted or unsubstituted aralkyl group (e.g., benzyl, 4-methoxybenzyl), a substituted or unsubstituted aryl group (e.g., phenyl, naphthyl, 4-methylphenyl, 3-methoxyphenyl, 4-ethoxycarbonylphenyl), or a substituted or unsubstituted heterocyclic group (e.g., pyridyl, imidazolyl, morpholino, triazolyl, tetrazolyl, thienyl).

The mesoionic ring represented by $Q_{301}$ may optionally be substituted by one or more SubStituents, such as those described above for compounds of formula (A).

Compounds of formula (B) may form a salt (e.g., an acetate, nitrate, salicylate, hydrochloride, iodate, bromate).

In formula (B), $X_{301}^-$ is preferably $-S^-$.

Of the mesoionic compounds of formula (B) for use in the present invention, more preferred are those represented by formula (E):

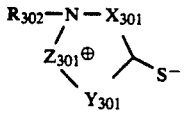

(E)

In the above formula, $X_{301}$ represents N or C-$R_{303}$; $Y_{301}$ represents O, S, N or N—$R_{304}$; and Z301 represents N, N—$R_{305}$ or C-$R_{306}$.

$R_{302}$, $R_{303}$, $R_{304}$, $R_{305}$ and $R_{306}$ each represent an alkyl group, a cycloalkyl group, an alkenyl group, an alkynyl group, an aryl group, a heterocyclic group, an amino group, an acylamino group, a sulfonamido group, an ureido group, a sulfamoylamino group, an acyl group, a thioacyl group, a carbamoyl group or a thiocarbamoyl group.

$R_{303}$ and $R_{306}$ each may also represent a hydrogen atom. $R_{302}$ and $R_{303}$, $R_{302}$ and $R_{305}$, $R_{302}$ and $R_{306}$, $R_{304}$ and $R_{305}$, and $R_{304}$ and $R_{306}$ may bond together to form a ring.

Compounds of formula (E) are explained in detail below.

$R_{302}$, $R_{303}$, $R_{304}$, $R_{305}$ and $R_{306}$ each represents a substituted or unsubstituted alkyl group (e.g., methyl, ethyl, n-propyl, t-butyl, methoxyethyl, carboxyethyl, carboxymethyl, dimethylaminoethyl, sulfoethyl, sulfomethyl, sulfopropyl, aminoethyl, methylthiomethyl, trimethylammonioethyl, phosphonomethyl, phosphonoethyl), a substituted or unsubstituted cycloalkyl group (e.g., cyclohexyl, cyclopentyl, 2-methylcyclohexyl), a substituted or unsubstituted alkenyl group (e.g., allyl, 2-methylallyl), a substituted or unsubstituted alkynyl group (e.g., propargyl), a substituted or unsubstituted aralkyl group (e.g., benzyl, phenethyl, 4-sulfobenzyl), an aryl group (e.g., phenyl, naphthyl, 4-methylphenyl, 4-methoxyphenyl, 4-carboxyphenyl, 4-sulfophenyl, 3,4-disulfophenyl), a substituted or unsubstituted heterocyclic group (e.g., 2-pyridyl, 3-pyridyl, 4-pyridyl, 2-thienyl, 1-pyrazolyl, 1-imidazolyl, 2-tetrahydrofuryl), a substituted or unsubstituted amino group (e.g., unsubstituted amino, dimethylamino, methylamino, carboxymethylamino), an acylamino (e.g., acetylamino, benzoylamino; methoxypropionylamino), a sulfonamido group (e.g., methanesulfonamido, benzenesulfonamido, 4-toluenesulfonamido), an ureido group (e.g., unsubstituted ureido, 3-methylureido), a sulfamoylamino group (e.g., unsubstituted sulfamoylamino, 3-methylsulfamoylamino), an acyl group (e.g., acetyl, benzoyl), a thioacyl group (e.g., thioacetyl), a carbamoyl group (e.g., unsubstituted carbamoyl, dimethylcarbamoyl), or a thiocarbamoyl group (e.g., dimethylthiocarbamoyl). $R_{303}$ and $R_{304}$ each may also be a hydrogen atom.

Of compounds of formula (E), preferred are those in which $X_{301}$ is N or C—$R_{303}$; $Y_{301}$ is N—$R_{304}$, S or O; $Z_{301}$ is N or C—$R_{306}$; $R_{302}$, $R_{303}$ and $R_{306}$ each are a substituted or unsubstituted alkyl group, a substituted or unsubstituted alkenyl group, a substituted or unsubstituted alkynyl group, or a substituted or unsubstituted heterocyclic group; provided that $R_{303}$ and $R_{306}$ each may be a hydrogen atom: $R_{304}$ is a substituted or unsubstituted alkyl group, a substituted or unsubstituted alkenyl group, a substituted or unsubstituted alkynyl group, a substituted or unsubstituted heterocyclic group, a substituted or unsubstituted amino group, a substituted or unsubstituted thioacyl group, or a substituted or unsubstituted thiocarbamoyl group.

Of compounds of formula (E), more preferred are those in which $X_{301}$ is N; $Y_{301}$ is N—$R_{304}$; $Z_{301}$ is C—$R_{306}$; $R_{302}$ and $R_{304}$ each are an alkyl group having from 1 to 6 carbon atoms; $R_{306}$ is a hydrogen atom, or an alkyl group having from 1 to 6 carbon atoms; provided that at least one alkyl group of $R_{302}$, $R_{304}$ and $R_{306}$ is substituted by at least one carboxylic acid group, sulfonic acid group, amino group or phosphono group.

Specific examples of compounds of formula (B) for use in the present invention are given below, but the present invention should not be construed as being limited thereto.

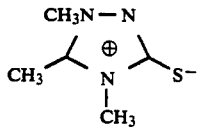

B-1.

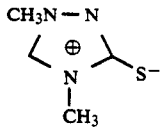

B-2.

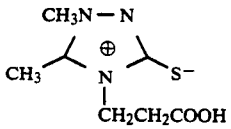

B-3.

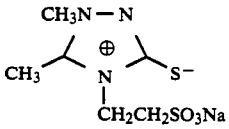

B-4.

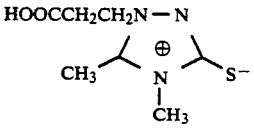

B-5.

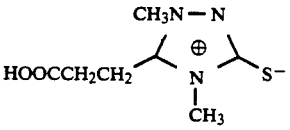

B-6.

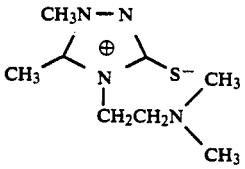

B-7.

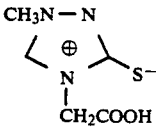

B-8.

-continued

B-9.

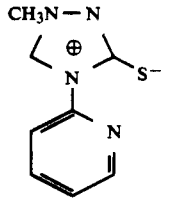

B-10.

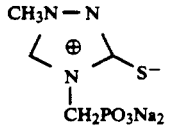

B-11.

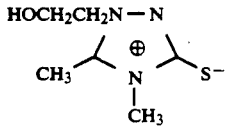

B-12.

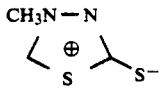

B-13.

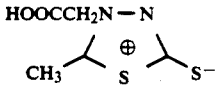

B-14.

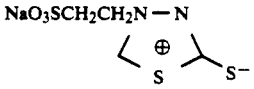

B-15.

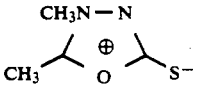

B-16.

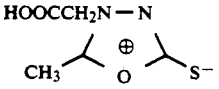

B-17.

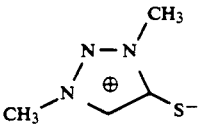

B-18.

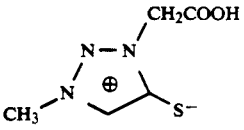

B-19.

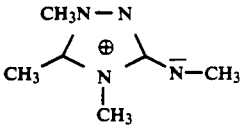

B-20.

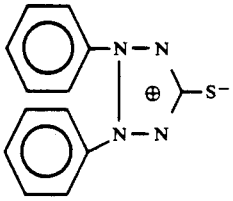

-continued

B-21.

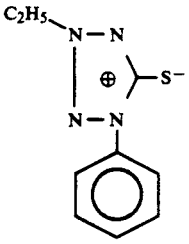

B-22.

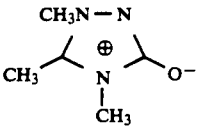

B-23.

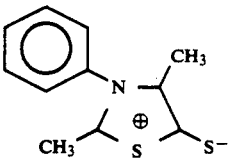

Compounds of formulae (B) and (E) can be produced in accordance with the methods described in *J. Heterocyclic Chem.*, 2, 105 (1965); *J. Org. Chem.*, 32, 2245 (1967); *J. Chem. Soc.*, 3799 (1969); *J. Am. Chem. Soc.*, 80, 1895 (1958); *Chem. Commun.*, 1222 (1971); *Tetrahedron Lett.*, 2939 (1972); JP-A-60-87322; *Berichte der Deutschen Chemischen Gesellschaft*, 38, 4049 (1905); *J. Chem. Soc. Chem. Commun.*, 1224 (197); JP-A-60-0122936 and JP-A-60-117240; *Advances in Heterocyclic Chemistry*, 19, 1 (1976); *Tetrahedron Letters*, 5881 (1968); *J. Heterocyclic Chem.*, 5, 277 (1968); *J. Chem. Soc., Perkin Trans. I*, 627 (1974); *Tetrahedron Letters*, 1809 (1967); ibid., 1578 (1971); *J. Chem. Soc.*, 899 (1935); ibid., 2865 (1958); and *J. Org. Chem.*, 30, 567 (1965).

Next, compounds of formula (C) for use in the present invention are explained in detail below.

In formula (C), $L_{401}$ and $L_{403}$ each represents a substituted or unsubstituted alkyl group having from 1 to 10 carbon atoms (e.g., methyl, ethyl, propyl, hexyl, isopropyl, carboxyethyl). a substituted or unsubstituted aryl group having from 6 to 12 carbon atoms (e.g., phenyl, 4-methylphenyl, 3-methoxyphenyl), a substituted or unsubstituted aralkyl group having from 7 to 12 carbon atoms (e.g., benzyl, phenethyl), a substituted or unsubstituted alkenyl group having from 2 to 10 carbon atoms (e.g., vinyl, propenyl, 1-methylvinyl), or a substituted or unsubstituted heterocyclic group having from 1 to 10 carbon atoms (e.g., pyridyl, furyl, thienyl, imidazolyl); $L_{402}$ represents a substituted or unsubstituted alkylene group having from 1 to 10 carbon atoms (e.g., methylene, ethylene, trimethylene, tetramethylene, pentamethylene, hexamethylene, 1-methylethylene, 1-hydroxytrimethylene), a substituted or unsubstituted arylene group having from 6 to 12 carbon atoms (e.g., phenylene, naphthylene), a substituted or unsubstituted aralkylene group having from 7 to 12 carbon atoms (e.g., 1,2-xylylene), or a substituted or unsubstituted heterocyclic linking group having from 1 to 10 carbon atoms (e.g., 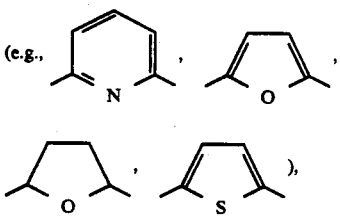 ).

or a linking group comprising a combination of these groups (e.g., 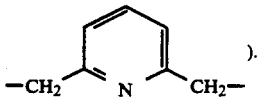 ).

$A_{401}$ and $A_{402}$ each represent —S—, —O—, —$NR_{420}$—, —CO—, —CS—, —$SO_2$— or a linking group comprising combination of any of these groups. Examples of the linking group comprising a combination of groups include —$COR_{421}$, —$NR_{422}CO$—, —$NR_{423}CONR_{424}$—, —COO—, —OCO—, —$SO_2NR_{425}$—, —$NR_{426}SO_2$—, —$CSNR_{427}$—, —$NR_{428}CS$—, and —$NR_{429}CONR_{430}$—.

r represents an integer of from 1 to 10.

At least one of $L_{401}$ and $L_{403}$ is substituted by one or more substituents selected from —$SO_3M_{401}$, —$PO_3M_{402}M_{403}$, —$NR_{401}(R_{402})$ (which may be in the form of a salt Such as a hydrochloride or acetate, e.g., unsubstituted amino, methylamino, dimethylamino, N-methyl-N-hydroxyethylamino, N-ethyl-N-carboxyethylamino), —$N^+R_{403}(R_{404})(R_{405}).X_{401}^-$ (e.g., trimethylammonio chloride), —$SO_2NR_{406}(R_{407})$ (e.g, substituted sulfamoyl, dimethylsulfamoyl), —$NR_{408}SO_2R_{409}$ (e.g., methanesulfonamido, benzenesulfonamido), —$CONR_{410}(R_{411})$— e.g., unsubstituted carbamoyl, N-methylcarbamoyl, N,N-bis(hydroxyethyl)carbamoyl), —$NR_{412}COR_{413}$ (e g., formamido, acetamido, 4-methylbenzoylamino), —$SO_2R_{414}$ (e g., methanesulfonyl, 4-chlorophenylsulfonyl), —$PO(—NR_{415}(R_{416}))_2$ (e.g., unsubstituted phosphonamido, tetramethylphosphonamido), —$NR_{417}CONR_{418}(R_{419})$— (e.g., unsubstituted ureido, N,N-dimethylureido), a heterocyclic group (e.g., pyridyl, imidazolyl, thienyl, tetrahydrofuranyl), and —$COOM_{404}$.

$M_{401}$, $M_{402}$, $M_{403}$ and $M_{404}$ each represent a hydrogen atom, or a pair cation (e.g., an alkali metal atom such as sodium or potassium atom; an alkaline earth metal atom such as magnesium or calcium atom; or an ammonium group such as ammonium or triethylammonium group).

$R_{401}$ to $R_{430}$ each represent a hydrogen atom, a substituted or unsubstituted alkyl group having from 1 to 10 carbon atoms (e.g., methyl, ethyl, propyl, hexyl, isopropyl), a substituted or unsubstituted aryl group having from 6 to 12 carbon atoms (e.g., phenyl, 4-methylphenyl, 3-methoxyphenyl), a substituted or unsubstituted aralkyl group having from 7 to 12 carbon atoms (e.g., benzyl, phenethyl), or a substituted or unsubstituted alkenyl group having from 2 to 10 carbon atoms (e.g., vinyl, propenyl, 1-methylvinyl); and $X_{401}^-$ represents a pair anion (e.g., halide ion such as chloride or bromide ion, or nitrate ion, sulfate ion, acetate ion, or p-toluenesulfonate ion).

The respective groups of $L_{401}$, $L_{402}$, $L_{403}$ and $R_{401}$ to $R_{430}$ may be substituted by one or more substituent groups selected from a lower alkyl group having from 1 to 4 carbon atoms (e.g., methyl, ethyl), an aryl group having from 6 to 10 carbon atoms (e.g., phenyl, 4-methylphenyl), an aralkyl group having from 7 to 10 carbon atoms (e.g., benzyl), an alkenyl group having from 2 to 4 carbon atoms (e.g., propenyl), an alkoxy group having from 1 to 4 carbon atoms (e.g., methoxy, ethoxy), a halogen atom (e.g., chlorine, bromine), a cyano group, a nitro group, a carboxylic acid group (which may be in the form of a salt thereof), and a hydroxyl group.

Where r is 2 or more, $A_{401}$ and $L_{402}$ each may comprise a combination of the above-noted groups.

At least one of $A_{401}$ and $A_{402}$ is —S—.

Of compounds of formula (C), preferred are those in which at least one of $L_{401}$ and $L_{403}$ is an alkyl group having from 1 to 6 carbon atoms and is substituted by one or more substituents selected from —$SO_3M_{401}$, —$PO_3M_{402}M_{403}$, —$NR_{401}(R_{402})$, —$N^+R_{403}(R_{404})(R_{405}).X_{401}^-$, a heterocyclic group and —$COOM_{404}$; $L_{402}$ is an alkylene group having from 1 to 6 carbon atoms; $A_{401}$ and $A_{402}$ each are —S—, —O— or —$NR_{420}$—; $R_{401}$, $R_{402}$, $R_{403}$, $R_{404}$, $R_{420}$ each and $R_{420}$ each are a hydrogen atom or an alkyl group having from 1 to 6 carbon atoms; and r is an integer of from 1 to 6.

Of the compounds of formula (C), more preferred are those in which $L_{401}$ and $L_{403}$ each are an alkyl group having from 1 to 4 carbon atoms and substituted by one or more substituents selected from —$SO_3M_{401}$, —$PO_3M_{402}M_{403}$ and —$COOM_{404}$; $A_{401}$ and $A_{402}$ each are —S—; and r is an integer of from 1 to 3. Examples of the resulting combination of two or more groups which form the divalent linking group are —$CH_2CH_2O$—$CH_2CH_2O$, $CH_2CH_2SCH_2CH_2O$—,

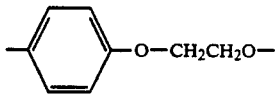

and etc.

Next, specific examples of compounds of formula (C) for use in the present invention are given below, but the present invention should not be construed as being limited thereto.

$NaO_3S(CH_2)_2S(CH_2)_2S(CH_2)_2SO_3Na$ C-1.

$NaO_3S(CH_2)_2\text{-}(SCH_2CH_2)_2\text{-}S(CH_2)_2SO_3Na$ C-2.

$NaO_3S(CH_2)_2\text{-}(SCH_2CH_2)_3\text{-}S(CH_2)_2SO_3Na$ C-3.

$NaO_3S(CH_2)_2\text{-}(SCH_2CH_2)_4\text{-}S(CH_2)_2SO_3Na$ C-4.

$NaO_3S(CH_2)_3S(CH_2)_2S(CH_2)_3SO_3Na$ C-5.

$NaO_3S(CH_2)_3\text{-}(SCH_2CH_2)_2\text{-}S(CH_2)_3SO_3Na$ C-6.

$NaO_3S(CH_2)_3\text{-}(SCH_2CH_2)_3\text{-}S(CH_2)_3SO_3Na$ C-7.

$NaO_3S(CH_2)_3S(CH_2)_2O(CH_2)_2S(CH_2)_3SO_3Na$ C-8.

$NaO_3S(CH_2)_2S(CH_2)_2\overset{CH_3}{\overset{|}{N}}(CH_2)_2S(CH_2)_2SO_3Na$ C-9.

-continued $KO_3S(CH_2)_2S(CH_2)_2N(CH_2)_2S(CH_2)_2SO_3K$ C-10.
$\quad\quad\quad bly arranged on the support such that the sensitivity of the layers progressively decrease in a direction forwards the support. In this embodiment, a non-light-sensitive layer may be provided between the plural silver halide emulsion layers. In another embodiment, a low-sensitivity emulsion layer is formed remote from the support and a high-sensitivity emulsion layer is formed closer to the support, as described in JP-A-57-112751, JP-A-62-200350, JP-A-62-206541, and JP-A-62-206543. Specific examples of the arrangement order of the layers on the support include an order of a low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL), wherein (BL) is farthest from the support; and an order of BH/BL/GL/GH/RH/RL; and an order of BH/BL/GH/GL/RL/RH.

Other examples include an order of blue-sensitive layer/GH/RH/GL/RL as described in JP-B-55-34932; and an order of blue-sensitive layer/GL/RL/GH/RH as described in JP-A-56-25738 and JP-A-62-63936, wherein the first-named layer is arranged farthest from the support.

An additional example is a three-layer unit structure as described in JP-B-49-15495, where the uppermost layer is a highest-sensitivity silver halide emulsion layer, the intermediate layer is a silver halide emulsion layer having a lower sensitivity than the uppermost layer, and the lowermost layer is a silver halide emulsion layer having a sensitivity lower than that of the intermediate layer. Namely, in a layer structure of this type, the sensitivity degree of each emulsion layer is progressively lowered in the direction of the support. Even in such a three-layer structure, each of the layers having the same color-sensitivity may be arranged in the order of a middle-sensitivity uppermost emulsion layer/high-sensitivity emulsion layer/low-sensitivity emulsion layer as described in JP-A-59-202464.

As discussed above, various layer structures and arrangements may be selected depending on the intended application of the photographic material.

When the silver halide color photographic material for processing in accordance with the method of the present invention is a color negative film or a color reversal film, the silver halide of the photographic emulsion layer of the photographic material is preferably silver iodobromide, silver iodochloride or silver iodochlorobromide having a silver iodide content of about 30 mol % or less. Especially preferred is a silver iodobromide or silver iodochlorobromide having a silver iodide content of from about 2 mol % to about 25 mol %.

Where the silver halide color photographic material for processing in accordance with the method of the present invention is a color print paper, the silver halide of the photographic emulsion layer of the photographic material is preferably silver chlorobromide or silver chloride which substantially does not contain silver iodide. The silver halide which substantially does not contain silver iodide as referred to herein has a silver iodide content of 1 mol % or less, preferably 0.2 mol % or less. The silver chlorobromide emulsion is not restricted with respect to ratio of silver bromide/silver chloride. The ratio may be selected within a broad range depending on the intended application. Preferably, the silver chloride content is 2 mol % or more. For photographic materials adapted for rapid processing, a high silver chloride emulsion is preferably employed having a high silver chloride content of preferably 90 mol % or more, especially preferably 95 mol % or more. In order to reduce the amount of the replenisher to the developer in accordance with the method of the present invention, an almost pure silver chloride emulsion having a silver chloride content of from 98 to 99.9 mol % is preferably used.

The silver halide grains contained in the photographic emulsion layer of the photographic material for processing in accordance with the method of the present invention may be regular crystalline grains such as cubic, octahedral or tetradecahedral grains, or irregular crystalline grains such as spherical or tabular grains, or irregular crystalline grains having a crystal defect such as a twin plane, or composite crystalline grains composed of the above-described regular and irregular crystalline forms.

The silver halide photographic emulsion for use in the present invention may be prepared by various methods, for example, those described in *Research Disclosure* (hereinafter referred to as RD) No. 17643 (December, 1978), pages 22 to 23 (I. Emulsion Preparation and Types); and RD No. 18716 (November, 1979).

Monodispersed emulsions as described in U.S. Pat. Nos. 3,574,628 and 3,655,394 and British Patent 1,413,748 are also preferably used in the present invention.

Additionally, tabular grains having an aspect ratio of about 5 or more may also be used in the present invention. Such tabular grains are readily prepared in accordance with the various methods, for example, as described in Gutoff, *Photographic Science and Engineering*, Vol. 14, pages 248 to 257 (1970); and U.S. Pat. Nos. 4,434,226, 4,414,310, 4,430,048, 4,439,520 and British Patent 2,112,157.

The crystal structure of the silver halide grains constituting the silver halide emulsions for use in the invention are described as follows. The grains may have a uniform halogen composition throughout the entire grain, or the grains may have a halogen composition that is different between the inside (core) part and the outside (shell) part of one grain, or the grains may have a layered structure. Further, the grains may comprise epitaxially joined silver halides of different halogen composition, or the grains may comprise components other than silver halides, such as silver rhodanide or lead oxide, conjugated with the silver halide matrix.

Additionally, a mixture of various grains of different crystalline forms may be employed in the present invention.

The silver halide emulsions for use in the present invention are generally physically ripened, chemically sensitized and/or color-sensitized. In the step of physical ripening, various polyvalent metal ion complexes (e.g., salts and/or complexes or cadmium, zinc, lead, copper, thallium, iron, ruthenium, rhodium, palladium, osmium, iridium and platinum) may be introduced into the emulsion. Useful compounds for chemical sensitization include those described in JP-A-62-215272, from page 18, right lower column, to page 22, right upper column. Additives for use in the ripening or sensitizing steps are described in RD No. 17643 and RD No. 18716 as indicated in the Table below. Various known photographic additives described in these two RD's may also be used in the present invention as indicated in the Table below.

| | Kinds of Additives | RD 17643 | RD 18716 |
|---|---|---|---|
| 1 | Chemical Sensitizer | page 23 | page 648, right column |
| 2 | Sensitivity Enhancer | | page 648, right column |
| 3 | Color Sensitizing Agent | pages 23 to 24 | page 648, right column, to page 649, right column |
| | Super Color Sensitizing Agent | pages 23 to 24 | page 648, right column, to page 649, right column |
| 4 | Brightening Agent | page 24 | |
| 5 | Anti-foggant | pages 24 to 25 | page 649, right column |
| | Stabilizer | pages 24 to 25 | page 649, right column |
| 6 | Light Absorbent | pages 25 to 26 | page 649, right column to page 650, left column |
| | Filter Dye | pages 25 to 26 | page 649, right column to page 650, left column |
| | Ultraviolet Absorbent | pages 25 to 26 | page 649, right column to page 650, left column |
| 7 | Stain Inhibitor | page 25, right column | page 650, left column to right column |
| 8 | Color Image Stabilizer | page 25 | |
| 9 | Hardening Agent | page 26 | page 651, left column |
| 10 | Binder | page 26 | page 651, left column |
| 11 | Plasticizer, Lubricant | page 27 | page 650, right column |
| 12 | Coating Aid | pages 26 to 27 | page 650, right column |
| | Surfactant | pages 26 to 27 | page 650, right column |
| 13 | Antistatic Agent | page 27 | page 650, right column |

In order to prevent deterioration of photographic properties upon contact of the photographic material for use in the present invention with formaldehyde gas, compounds capable of fixing formaldehyde, for example, those described in U.S. Pat. Nos. 4,411,987 and 4,435,503, are preferably incorporated into the photographic material.

Various color couplers can be incorporated into the photographic material for use in the present invention, and examples of useful color couplers are described in the patent publications referred to in the above-noted RD No. 17643, VI-C to G.

Preferred yellow couplers, for example, are described in U.S. Pat. Nos. 3,933,501, 4,022,620, 4,326,024, 4,401,752, 4,248,961, JP-B-58-10739, British Patents 1,425,020, 1,476,760, U.S. Pat. Nos. 3,973,968, 4,314,023, 4,511,649, and European Patent 249,473A.

Preferred magenta couplers include 5-pyrazolone compounds and pyrazoloazole compounds. For example, those described in U.S. Pat. Nos. 4,310,619, 4,351,897, European Patent 73,636, U.S. Pat. Nos. 3,061,432, 3,725,045, RD No. 24220 (June, 1984), JP-A-60-33552, RD No. 24230 (June, 1984), JP-A-60-43659, JP-A-61-72238, JP-A-60-35730, JP-A-55-118034, JP-A-60-185951, U.S. Pat. Nos. 4,500,630, 4,540,654, 4,556,630, and WO(PCT)88/04795 are preferred.

Preferred cyan couplers include phenol couplers and naphthol couplers. For example, those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, German Patent (OLS) No. 3,329,729, European Patents 121,365A, 249,453A, U.S. Pat. Nos. 3,446,622, 4,333,999, 4,753,871, 4,451,559, 4,427,767, 4,690,889, 4,254,212, 4,296,199, and JP-A-61-42658 are preferred.

Preferred colored couplers for correcting unnecessary absorption of colored dyes as described in RD No. 17643, VII-G, U.S. Pat. No. 4,163,670, JP-B-57-39413, U.S. Pat. Nos. 4,004,929, 4,138,258, and British Patent 1,146,368 are preferred. Additionally, couplers for correcting the unnecessary absorption of colored dyes by releasing a phosphor dye during coupling, as described in U.S. Pat. No. 4,774,181, as well as couplers having a dye precursor group capable of reacting with a developing agent to form a dye, as a split-off group, as described in U.S. Pat. No. 4,777,120 are also preferably used.

Couplers capable of forming a colored dye having appropriate diffusibility may also be used, and those described in U.S. Pat. No. 4,366,237, British Patent 2,125,570, European Patent 96,570, and German Patent (OLS) No. 3,234,533 are preferred.

Polymerized dye-forming couplers may also be used, and typical examples thereof are described in U.S. Pat. Nos. 3,451,820, 4,080,211, 4,367,282, 4,409,320, 4,576,910, British Patent 2,102,137 and European Patent 341,188A.

Couplers capable of releasing a photographically useful residue upon coupling may also be used in the photographic material for processing in accordance with the present invention. For instance, preferred DIR couplers capable of releasing a development inhibitor are described in the patent publications referred to in the above-noted RD No. 17643, Item VII-F, as well as in JP-A-57-151944, JP-A-57-154234, JP-A-60-184248 and JP-A-63-37346 and U.S. Pat. Nos. 4,248,962 and 4,782,012.

Preferred couplers which imagewise release a nucleating agent or development accelerator during development are described in British Patents 2,097,140 and 2,131,188, and JP-A-59-157638 and JP-A-59-170840.

Additionally, examples of compounds which may be incorporated into the photographic material for processing in accordance with the present invention include the competing couplers described in U.S. Pat. No. 4,130,427; poly-valent couplers described in U.S. Pat. Nos. 4,238,472, 4,338,393 and 4,310,618; DIR redox compound-releasing couplers, DIR coupler-releasing couplers, DIR coupler-releasing redox compounds and DIR redox-releasing redox compounds described in JP-A-60-185950 and JP-A-62-24252; couplers which release a dye which recolors after being released from the coupler as described in European Patents 173,302A; bleaching accelerator-releasing couplers as described in RD Nos. 11449 and 24241 and JP-A-61-201247; the ligand-releasing couplers described in U.S. Pat. No. 4,553,477; and leuco dye-releasing couplers described in JP-A-63-75747; and couplers which release a phosphor dye as described in U.S. Pat. No. 4,774,181.

The above-described couplers can be incorporated into the photographic material for processing in accordance with the present invention by various known dispersion methods.

For instance, an oil-in-water dispersion method may be employed for this purpose. Examples of high boiling point solvents for use in this method are described in U.S. Pat. No. 2,322,027. Examples of high boiling point organic solvents having a boiling point of 175° C. or higher at normal atmospheric pressure for use in the oil-in-water dispersion method include phthalates (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, bis(1,1-diethylpropyl) phthalate, phosphates or phosphonates (e.g., triphenyl phosphate, tricresyl phosphate, 2-ethylhexyl diphenylphosphate, tricyclohexyl phosphate, tri-2-ethylhexyl phosphate, tridocyl phosphate, tributoxyethyl phosphate, trichloropropyl phosphate, di-2-ethylhexylphenyl phosphonate), benzoates (e.g., 2-ethylhexyl benzoate, dodecyl benzoate, 2-ethylhexyl p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylates (e.g., bis(2-ethylhexyl) sebacate, dioctyl azelate, glycerol tributylate, isostearyl lactate, trioctyl citrate), aniline derivatives (e.g., N,N-dibutyl-2-butoxy-5-tert-octylaniline), hydrocarbons (e.g., paraffin, dodecylbenzene, diisopropylnaphthalene). As an auxiliary solvent, organic solvents having a boiling point of approximately 30° C. or higher, preferably from 50° to 160° C. can be used. Examples of such auxiliary organic solvents include ethyl acetate, butyl acetate, ethyl propionate, methyl ethyl ketone, cyclohexanone, 2-ethoxyethyl acetate and dimethylformamide.

A latex dispersion method may also be employed for incorporating couplers into the photographic material for processing in accordance with the method of the present invention. The steps of carrying out the dispersion method, the effect of the method and examples of latexes for use in this method for impregnation are described in U.S. Pat. No. 4,199,363, German Patent (OLS) Nos. 2,541,274 and 2,541,230.

As needed, the couplers may be absorbed into loadable latex polymers (e.g., those described in U.S. Pat. No. 4,203,716) in the presence or absence of one of the above-described high boiling point organic solvent. Alternatively, the couplers may be dissolved in water-insoluble and organic solvent-soluble polymers, for emulsification and dispersion in an aqueous hydrophilic colloid solution.

Preferably, the homopolymers and copolymers as described in International Patent Application Laid-Open No. WO88/00723, pages 12 to 30 are used for this purpose. In particular, use of acrylamide polymers are preferred for stabilizing the resulting color images.

The present invention may be applied to the processing of various color photographic materials. Typical examples include color negative films for general use or for move use, color reversal films for slide use or for television use, as well as color papers, direct positive color photographic materials, color positive films and color reversal papers.

Suitable supports for use in the photographic material for processing in accordance with the present invention are described in, for example, the above-cited RD No. 17643, page 28, and RD No. 18716, from page 647, right column to page 648, left column.

The total film thickness of all of the hydrophilic colloid layers as provided on the surface of the support having the silver halide emulsion layers is preferably 25 microns or less, more preferably 20 microns or less, in the photographic material for processing in accordance with the present invention. The photographic material of the invention preferably also has a film swelling rate (T ½) of 30 seconds or less, more preferably 15 seconds or less. The film thickness as referred to herein is measured under storage in controlled conditions of a temperature of 25° C. and a relative humidity of 55% (for 2 days); and the film swelling rate as referred to herein may be measured y means known in the art. For instance, the film swelling rate may be measured by the use of a swellometer of the type as described in A. Green et al., Photographic Science Engineering, Vol. 19, No. 2, pages 124 to 129. The film swelling rate (T ½) is defined as follows: 90% of the maximum swollen thickness of the photographic material as processed in a color developer under conditions of 30° C. and 3 minutes and 15 seconds is designated a saturated swollen thickness. The time necessary for attaining one half (½) of the saturated swollen thickness is defined as the film swelling rate (T ½).

The film swelling rate (T ½) can be adjusted byu adding a hardening agent to gelatin used as a binder, or by varying the storage condition of the coated photographic material. Additionally, the photographic material of the present invention preferably has a swelling degree of from 150 to 400%. The swelling degree as referred to herein is calculated from the maximum swollen film thickness obtained under the above-described conditions, using the following formula:

*(maximum swollen film thickness—original film thickness)/(original film thickness).*

The color photographic material for processing in accordance with the present invention can be developed by any ordinary method, for example, in accordance with the process described in the above-cited RD No. 17643, pages 28 and 29, and RD No. 18716, page 615, from left column to right column.

The color developer for use in developing the photographic material in accordance with the present invention is preferably an aqueous alkaline solution containing an aromatic primary amine color-developing agent. As the color-developing agent, p-phenylenediamine compounds are preferably used, although aminophenol compounds are also useful. Specific examples of p-phenylenediamine compounds for use as the color-developing agent include 3-methyl-4-amino-N,N-diethylaniline, 3-methyl-4-amino-N ethyl-N-⊖-hydroxyethylaniline, 3-methyl-4-amino-N-ethyl-N-β-methanesulfoneamidoethylaniline, 3-methyl-4-amino N-ethyl-N-β-methoxyethylaniline, as well as sulfates, hydrochlorides and p-toluenesulfonates of the compounds. These compounds can be used in combination depending on the intended application.

A content of the developing agent in the color developer is from $1\times10^{-3}$ to 1 mol/l, preferably from 0.01 to 0.3 mol/l.

The color developer generally contains a pH buffer such as an alkali metal carbonate, borate or phosphate, and a development inhibitor or anti-foggant such as a bromide, iodide, benzimidazole, benzothiazole or mercapto compound. If desired, the color developer may also contain various preservatives such as hydroxylamine, diethylhydroxylamine, sulfites, hydrazines, phenylsemicarbazides, triethanolamine, catechol-sulfonic acids, and triethylenediamine(1,4-diazabicyclo[2,2,2]octanes); an organic solvent such as ethylene glycol, and diethylene glycol; a development accelerator such as benzyl alcohol, polyethylene glycol, a quaternary ammonium salt, and an amine; a dye-forming coupler; a competing coupler; a foggant such as sodium borohydride; an auxiliary developing agent such as 1-phenyl-3-pyrazolidone; a tackifier; as well as various chelating agents such as aminopolycarboxylic acids, aminopolyphosphonic acids, alkylphosphonic acids, and phosphonocarboxylic acids. Specific examples of chelating agents which may be added to the color developer include ethylenediamine-tetraacetic acid, nitrilo-triacetic acid, diethylenetriamine-pentaacetic acid, cyclohexanediamine-tetraacetic acid, hydroxylethylimino-diacetic acid, 1-hydroxyethylidene-1,1-diphosphonic acid, nitrilo-N,N,N-trimethylenephosphonic acid, ethylenediamine-N,N,N,N-tetramethylene-phosphonic acid, ethylenediamine-di(o-hydroxyphenylacetic acid) and salts thereof. In addition, the color developer for use in the present invention may also contain, as needed, a brightening agent such as 4,4'-diamino-2,2'-disulfostilbene compounds; as well as various surfactants such as alkylsulfonic acids, arylsulfonic acids, aliphatic carboxylic acids and aromatic carboxylic acids.

However, the color developer preferably does not substantially contain benzyl alcohol, because benzyl alcohol often causes problems of environmental pollution. Furthermore, it is difficult to prepare a color developer containing benzyl alcohol, and benzyl alcohol causes color staining of the formed images. The color developer substantially not containing benzyl alcohol contains 2 ml or less benzyl alcohol per liter of developer, and more preferably contains no benzyl alcohol.

When the photographic material is processed for reversal finish, in general, the photographic material is first subjected to black-and-white development and then to color development. The first black-and-white development is carried out using a black-and-white developer containing a conventional black-and-white developing agent, for example, a dihydroxybenzene such as hydroquinone, a 3-pyraozlidone such as 1-phenyl-3-pyraozlidone, or an aminophenol such as N-methyl-p-aminophenol, alone or in combination thereof.

The color developer and the black-and-white developer generally has a pH value of from 9 to 12. The amount of the replenisher to the developer (depending on the nature of the color photographic material to be processed), is generally 3 liters or less per $m^2$ of the material to be processed. The replenisher amount may be reduced to 500 ml or less per $m^2$ of the material to be processed, by lowering the bromide ion concentration in the replenisher. In particular, when a high silver chloride photographic material is processed, the bromide ion content in the color developer is preferably lowered while the chloride ion content is made relatively large. As a result, the photographic properties of the processed material are improved, and the processability of the developer is also improved. Additionally, fluctuation of the photographic properties of the processed material may be prevented. The amount of the replenisher in this case may be reduced to about 20 ml per $m^2$ of the photographic material being processed, such that there is substantially no overflow from the color developer. When the amount of the replenisher is reduced, the contact area of the surface of the processing solution in the processing tank with air is preferably reduced to thereby prevent evaporation and aerial oxidation of the processing solution. In addition, by employing a means of preventing accumulation of bromide ions in the developer, the amount of the replenisher to the developer bath may also be reduced.

The processing temperature for color development in the method of the present invention is from 20° to 50° C, preferably from 30° to 45° C. The processing time for the developing step is from 20 seconds to 5 minutes, preferably from 30 seconds to 3 minutes. As needed, a higher processing temperature, a higher pH value of the processing solution and a higher developing agent concentration in the developing solution may be employed, to thereby shorten the processing time.

After color development, the photographic emulsion layer is generally bleached. Bleaching can be effected simultaneously with fixing (bleach-fixing). In order to accelerate the processing speed, a processing sequence of bleaching followed by bleach-fixing may be employed. A -processing sequence using two bleach-fixing baths in tandem, a sequence of fixing followed by bleach-fixation, or a sequence of bleach-fixing followed by bleaching may also be employed, in accordance with the intended application. The compounds of the present invention are used as the bleaching agent, which may be combined with other known bleaching agents, if desired, provided that the latter do not interfere with the effect of the present invention Examples of known bleaching agents which can be used in combination with the compounds of the present invention include ferricyanides; bichromates; organic complexes of iron(III) or cobalt(III), such as complexes thereof with aminopolycarboxylic acids, for example, ethylenediaminetetraacetic acid, diethylenetriaminepentaacetic acid, cyclohexanediaminetetraacetic acid, methyliminodiacetic acid, 1,3-diaminopropanetetraacetic acid or glycolether-diaminetetraacetic acid, or with citric acid, tartaric acid or malic acid; persulfates; bromates; permanganates; and nitrobenzenes.

The bleaching solution or bleach-fixing solution for use in the present invention generally has a pH value of from 5.5 to 8. If desired, the bleaching and bleach-fixing solutions may have a lower pH value for attaining rapid processing.

An amount of bleaching agent other than metal chelate to be added in the bleaching solution is from $1\times10^{-3}$ mol/l to 0.3 mol/l. A bleaching time is from 20 seconds to 10 minutes, preferably from 30 seconds to 10 minutes.

The bleaching solution, the bleach-fixing solution and the previous bath may contain a bleaching accelerating agent. Various bleaching accelerating agents are known, and examples of such agents which are advantageously used in the present invention include mercapto group- or disulfide group-containing compounds described in U.S. Pat. No. 3,893,858, German Patent 1,290,812, RD No. 17129 (July, 1978); thiazolidine derivatives as described in JP-A 50-140129; thiourea derivatives as described in U.S. Pat. No. 3,706,561; iodide salts as described in JP-A-58-16235; polyoxyethylene compounds as described in German Patent 2,748,430; polyamine compounds as described in JP-B-45 8836; and bromide ions. Above all, mercapto group- or disulfide group-containing compounds, in particular, those as described in U.S. Pat. No. 3,893,858, German Patent 1,290,812 and JP-A-53-95630 are preferred, as having a large accelerating effect. In addition, the compounds described in U.S. Pat. No. 4,552,834 are also preferred. These bleaching accelerators may also be incorporated into the photographic material for processing in accordance with the invention. When the photographic material is a picture-taking color photographic material and is bleach-fixed, the above noted bleaching accelerators are especially effective. The amount of bleaching accelerating agent added to the bleaching solution or bleach-fixing solution is from $1\times10^{-3}$ to 1 mol/liter, preferably from $1\times10^{-2}$ to 0.2 mol/liter.

The bleach-fixing solution for use in the present invention may contain known additives for use in bleach-fixing solutions, for example, a re-halogenating agent such as ammonium bromide or ammonium chloride, a pH buffer such as ammonium sulfate, and a metal corrosion inhibitor such as ammonium sulfate.

The bleach-fixing solution may also contain, as a preservative, sulfites, bisulfites, carbonyl-bisulfite adducts or sulfinic acid compounds. For improving stability of the solution, chelating agents of aminopolycarboxylic acids or organic phosphonic acids (preferably, 1-hydroxyethylidene-1,1-diphosphonic acid, N,N,N',N'-ethylenediaminetetraphosphonic acid) are preferably added thereto.

The bleach-fixing solution may further contain various brightening agents, defoaming agents, surfactants, polyvinylpyrrolidone and methanol.

An amount of the bleaching agent and the fixing agent to be added in the bleach-fixing solution other than bleaching agent and fixing agent of the present invention is from 0.05 mol/l, and from $1\times10^{-3}$ mol to 3 mol/l, respectively.

The bleach-fixing time is from 20 seconds to 10 minutes, preferably, from 30 seconds to 3 minutes.

The bath having a fixing ability for use in the present invention can contain known fixing agents in addition to the compounds of the present invention in an amount of from $1\times10^{-3}$ to 3 mol/l. Usable fixing agents include thiosulfates, thiocyanates, thioureas and iodide in large quantity. The fixing solution for use in the present invention has a pH value of from 2 to 10, preferably from 4 to 9.

In the desilvering step, the respective processing solutions are preferably stirred as strongly as possible, to thereby shorten the desilvering time. Stirring means such as the methods described in JP-A-62-183460 and JP-A-62-183461 are referred to. When a jet stream is employed as the stirring means, application of the jet stream to the photographic material is preferably carried out within 15 seconds of introduction of the photographic material into the processing tank.

In carrying out the method of the present invention, the cross-over time from the color developer to the bleach-fixing solution (i.e., the time after removing the photographic material from color developer tank until introducing the same into the bleaching tank) is preferably within 10 seconds to prevent bleaching fog and adhesion of stains to the surface of the processed material.

The amount of the replenisher to the bleach-fixing solution in accordance with the method of the present invention is preferably 800 ml $m^2$ or less for picture-taking color photographic materials (for example, having a coated silver amount of from 4 to 12 9 $m^2$) and 60 ml/$m^2$ or less for color printing papers.

The silver halide color photographic material processed in accordance with the present invention is generally rinsed in water and/or stabilized after desilvering. The amount of water used in the rinsing step depends on the nature of the photographic material being processed (for example, the constituent components thereof, such as the couplers, etc.), or the intended application of the photographic material, as well as the temperature of the rinsing water, the number of the rinsing tanks (the number of the rinsing stages , the replenishment system (e.g., normal current or countercurrent) and other factors. The relation between the number of the rinsing tanks and the amount of the rinsing water in a multi-stage countercurrent rinsing system can be obtained by the method described in *Journal of the Society of Motion Picture and Television Engineers*, Vol. 64, pages 248 to 253 (May, 1955).

According to the multi-stage countercurrent system described in the above-cited literature reference, the amount of rinsing water can be remarkably reduced. However, due to an increase in residence time of the water in the rinsing tank, bacteria tend to propagate. Floating material generated by the propagation of bacteria disadvantageously adheres to the surface of the material during processing. In the method of the present invention, the technique of reducing calcium and magnesium ions, as described in JP-A-62-288838, is effective for overcoming this problem. In addition, isothiazolone compounds and thiabendazoles described in JP-A-57-8542; chlorine-containing bactericides such as chlorinated sodium isocyanurates; and benzotriazoles and other bactericides described in H. Horiguchi, *Chemistry of Bactericidal and Fungicidal Agents* (1986, by Sankyo Publishing Co., Japan), *Bactericidal and Fungicidal Techniques to Microorganisms*, edited by Association of Sanitary Technique, Japan (1982, by Kogyo Gijutsukai, Japan), and *Encyclopedia of Bactericidal and Fungicidal Agents*, edited by Nippon Bactericide and Fungicide Association, Japan (1986), can also be used.

The pH value of the rinsing water for use in processing the photographic material in accordance with the method of the present invention is from 4 to 9, preferably from 5 to 8. The temperature of the rinsing water and the rinsing time is set depending on the nature of the photographic material to be processed as well as the use thereof. In general, the temperature is from 15° to 45° C. and the time is from 20 seconds to 10 minutes, and preferably the temperature is from 25° to 40° C. and the time is from 30 seconds to 5 minutes. Alternatively, the photographic material may also be processed directly with a stabilizing solution in place of rinsing with water. For the stabilization, known methods, for example, as described in JP-A-57-8543, JP-A-58-14834 and JP-A-60-220345, can be employed.

In addition, the photographic material can also be stabilized, following the rinsing step using, for example, a stabilizing bath containing a dye stabilizer, which is used as a final bath for picture-taking color photographic materials. Examples of dye stabilizers useful for this purpose include formalin, hexamethylenetetramine, hexahydrotriazine and N-methylol compounds. The stabilizing bath may also contain, as needed, ammonium compounds, metal compounds such as Bi or Al compounds, brightening agents, various chelating agents, film pH adjusting agents, hardening agents, microbiocides, fungicides, alkanolamines and surfactants (silicone surfactants are preferred). The water for use in the rinsing step or stabilization step may be municipal water as well as ion-exchanged or de-ionized water having a reduced Ca or Mg ion concentration of 5 mg/liter or less, or water sterilized with a halogen or ultraviolet sterilizing lamp.

The amount of the replenisher to the rinsing and/or stabilizing bath is from 1 to 50 times, preferably from 2 to 30 times, more preferably from 2 to 15 times, the amount of carryover from the previous bath per unit area of the photographic material being processed. The overflow resulting from addition of the replenisher to the bath may be re-used in a previous desilvering step and other steps.

The silver halide color photographic material for processing in accordance with the present invention can contain a color developing agent to simplify and accelerate processing. For incorporating a color developing agent into the photographic material, various precursors are preferably used, including, for example, the indoaniline compounds described in U.S. Pat. No. 3,342,597, Schiff base compounds described in U.S. Pat. No. 3,342,599 and RD Nos. 14850 and 15159, aldole compounds described in RD No. 13924, metal complexes described in U.S. Pat. No. 3,719,492 and urethane compounds described in JP-A 53-135628.

The silver halide color photographic material for processing in accordance with the present invention can contain various kinds of 1-phenyl-3-pyrazolidones, if desired, for accelerating the color developability thereof. Specific examples of these compounds are described in JP-A-56-64339, JP-A-144547 and JP-A-58-115438.

The processing solutions in accordance with the present invention are used in 10° C. to 50° C. In general, a processing temperature of from 33° C. to 38° C. is standard, but the temperature may be increased to accelerate processing of to shorten the processing time, or alternatively, the temperature may be reduced to improve the quality of the resulting images and to improve the stability of the processing solution. If desired, cobalt intensification or hydrogen peroxide intensification as described in German Patent 2,226,770 and U.S. Pat. No. 3,674,499 may also be employed to save silver in preparation of the photographic material.

An example of a silver halide color photographic material for processing in accordance with the present invention is a direct positive silver halide photographic material. Processing of the material is described below.

The direct positive silver halide photographic material is first imagewise exposed and then black-and-white processed. After or while fogging with light or a nucleating agent, the photographic material is color-developed with a surface developer containing an aromatic primary amine color-developing agent and having pH of 11.5 or less. Thereafter, the photographic material is bleach-fixed to form a direct positive color image. More preferably, the developer has a pH value of falling within the range of from 10.0 to 11.0

The fogging may be effected by either a "light-fogging method" in which the entire surface of the light-sensitive layer is subjected to secondary exposure, or by a "chemical fogging method" where the exposed material is developed in the presence of a nucleating agent. If desired, development may be effected in the presence of both a nucleating agent and light. Also, a nucleating agent may have previously been incorporated into the photographic material, and the photographic material may be subjected to fogging exposure.

Details of the light-fogging method are described in JP-A-63-108336, from page 47, line 4 to page 49, line 5. Examples of nucleating agents for use in the present invention are described in the same specification, from page 49, line 6 to page 67, line 2. In particular, use of compounds of general formulae (N-1) and (N-2) as described therein is preferred. Specific examples of particularly preferred compounds for use in the present invention include (N-I-1) to (N-I-10) (pages 56 to 58 of the specification of the above cited patent application) and (N-II-1) to (N-II-12) (pages 63 to 66 of the same).

Nucleation accelerators for use in the present invention are also described in the specification of the above cited patent application, from page 68, line 11 to page 71, line 3. In particular, the use of compounds (A-1) to (A-13) is preferred.

Next, the present invention is explained in greater detail by way of the following examples, which, however, should not be construed as limiting the scope of the present invention.

EXAMPLE 1

Plural layers each having the composition described below were coated over a paper support, both surfaces of which had been laminated with a polyethylene coat, to prepare a multi-layer color photographic printing paper sample. The coating compositions used were prepared as described below.

Preparation of Coating Composition for First Layer 27.2 cc of ethyl acetate and 8.2 of solvent (Solv-1) were added to 19.1 g of yellow coupler (ExY), 4.4 g of color image stabilizer (Cpd-1) and 0.7 g of color image stabilizer (Cpd-7), and the latter were dissolved in the former. The resulting solution was dispersed by emulsification in 185 cc of aqueous 10 wt % gelatin solution containing 8 cc of 10 wt % sodium dodecylbenzenesulfonate. On the other hand, a silver chlorobromide emulsion was prepared, which was a mixture (3/7 as a silver molar ratio) comprising an emulsion of cubic grains having a mean grain size of 0.88 μm and an emulsion of cubic grains having a mean grain size of 0.70 μm. The two emulsions had a variation coefficient of grain size distribution of 0.08 and 0.10, respectively. The two emulsions had 0.2 mol % of silver bromide formed locally on the surfaces of the grains. The blue-sensitizing dye described below was added to the mixed emulsion in an amount of $2.0\times10^{-4}$ mol per mol of silver of the large-size emulsion and $2.5\times10^{-4}$ mol per mol of silver of the small-size emulsion. Then, the mixed emulsion was sulfur-sensitized. The previously prepared emulsified dispersion and the sensitized mixed emulsion were blended to obtain a coating composition for the first layer, which comprised the components listed below.

Other coating compositions for the second layer to the seventh layer were prepared in the same manner as above. 1-Hydroxy-3,5-dichloro-s-triazine sodium salt was used as a gelatin hardening agent for each of these layer.

The following color sensitizing dyes were added to the respective layers.

Blue-sensitive Emulsion Layer

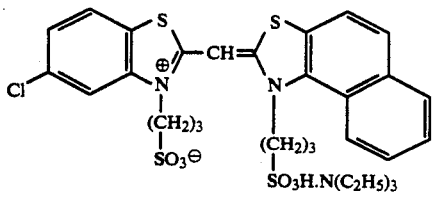

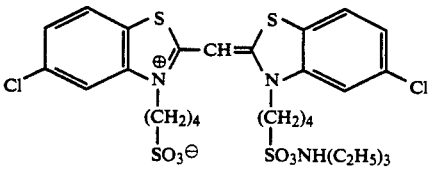

(Each of the above dyes were added in an amount of $2.0\times10^{-4}$ mol per mol of silver halide to the large-size emulsion and $2.5\times10^{-4}$ mol per mol of silver halide to the small-size emulsion.)

Green-sensitive Emulsion Layer

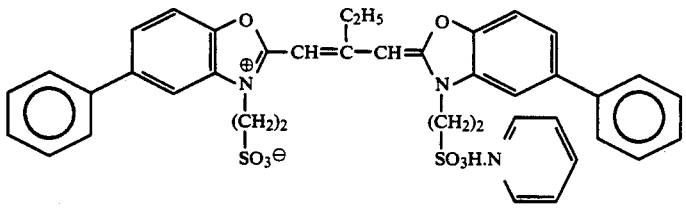

(The above dye was added in an amount of $4.0\times10^{-4}$ mol per mol of silver halide to the large-size emulsion and $5.6\times10^{-4}$ mol per mol of silver halide to the small-size emulsion.) and

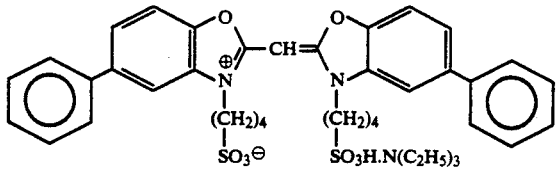

(The above dye was added in an amount of $7.0\times10^{-5}$ mol per mol of silver halide to the large-size emulsion and $1.0\times10^{-5}$ mol per mol of silver halide to the small-size emulsion.)

Red-sensitive Emulsion Layer

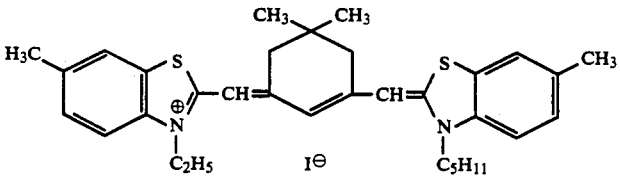

(The above dye was added in an amount of $0.9\times10^{-4}$ mol per mol of silver halide to the large-size emulsion and $1.1\times10^{-4}$ mol per mol of silver halide to the small-size emulsion.)

To the red-sensitive emulsion layer was added the following compound in an amount of $2.6\times10^{-4}$ mol per mol of silver halide.

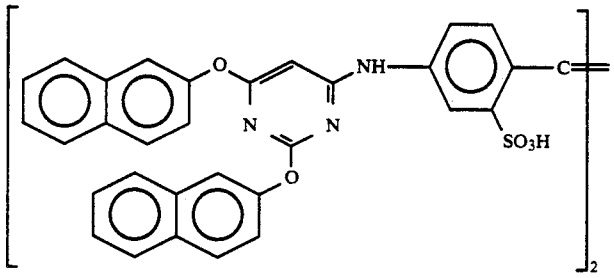

To each of the blue-sensitive emulsion layer, green-sensitive emulsion layer and red-sensitive emulsion layer was added 1-(5-methylureidophenyl)-5-mercaptotetrazole in an amount of $8.5\times10^{-5}$ mol, $7.7\times10^{-4}$ mol and $2.5\times10^{-4}$ mol, respectively, per mol of silver halide.

To each of the blue-sensitive emulsion layer and green-sensitive emulsion layer was added 4-hydroxy-6-methyl-1,3,3a,7-tetrazaindene in an amount of $1\times10^{-4}$ mol and $2\times10^{-4}$ mol per mol of silver halide, respectively.

The following dyes were added to each emulsion layer for anti-irradiation.

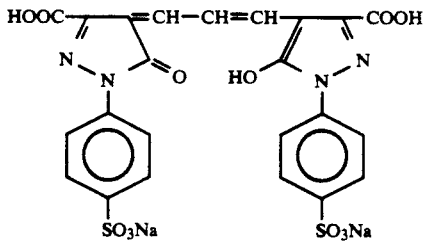

and

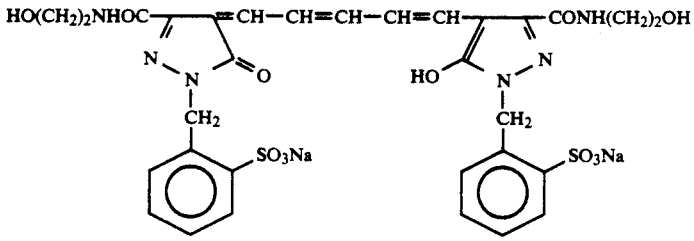

Layer Constitution of Photographic Material Sample

The composition of each layer of the sample is described below. The number indicates the amount of the component coated (g/m$^2$). The silver halide emulsion coverage is given in terms of the amount of silver.

Support

Polyethylene-laminated Paper (containing white pigment ($TiO_2$) and bluish dye (ultramarine) in the polyethylene below the first layer)

| | |
|---|---|
| First Layer (Blue-sensitive Layer): | |
| Above-described Silver Chlorobromide Emulsion | 0.30 as Ag |
| Gelatin | 1.86 |
| Yellow Coupler (ExY) | 0.82 |
| Color Image Stabilizer (Cpd-1) | 0.19 |
| Solvent (Solv-1) | 0.35 |
| Color Image Stabilizer (Cpd-7) | 0.06 |
| Second Layer (Color Mixing Preventing Layer): | |
| Gelatin | 0.99 |
| Color Mixing Preventing Agent (Cpd-5) | 0.08 |
| Solvent (Solv-1) | 0.16 |
| Solvent (Solv-4) | 0.08 |
| Third Layer (Green-sensitive Layer): | |
| Silver Chlorobromide Emulsion (1/3 (as silver molar ratio) mixture comprising a large-size emulsion of cubic grains with a mean grain size of 0.55 μm and a small-size emulsion of cubic grains with a mean grain size of 0.39 μm; the two emulsions each having a variation coefficient of grain size distribution of 0.10 and 0.08, respectively, and each having 0.8 mol % of AgBr formed locally on the surfaces of the grains) | 0.12 as Ag |
| Gelatin | 1.24 |
| Magenta Coupler (ExM) | 0.20 |

-continued

| | |
|---|---|
| Color Image Stabilizer (Cpd-2) | 0.03 |
| Color Image Stabilizer (Cpd-3) | 0.15 |
| Color Image Stabilizer (Cpd-4) | 0.02 |
| Color Image Stabilizer (Cpd-9) | 0.02 |
| Solvent (Solv-2) | 0.40 |
| Fourth Layer (Ultraviolet Absorbing Layer): | |
| Gelatin | 1.58 |
| Ultraviolet Absorbent (UV-1) | 0.47 |
| Color Mixing Preventing Agent (Cpd-5) | 0.05 |
| Solvent (Solv-5) | 0.24 |
| Fifth Layer (Red-sensitive Layer): | |
| Silver Chlorobromide Emulsion (1/4 (as silver molar ratio) mixture comprising a large-size emulsion of cubic grains with a mean grain size of 0.58 μm and a small-size emulsion of cubic grains with a mean grain size of 0.45 μm; the two emulsions each having a variation coefficient of grain size distribution of 0.09 and 0.11, respectively, and each having 0.6 mol % of AgBr formed locally on the surfaces of the grains) | 0.23 as Ag |
| Gelatin | 1.34 |
| Cyan Coupler (ExC) | 0.32 |
| Color Image Stabilizer (Cpd-6) | 0.17 |
| Color Image Stabilizer (Cpd-7) | 0.40 |
| Color Image Stabilizer (Cpd-8) | 0.04 |
| Solvent (Solv-6) | 0.15 |
| Sixth Layer (Ultraviolet Absorbing Layer): | |
| Gelatin | 0.53 |
| Ultraviolet Absorbent (UV-1) | 0.16 |
| Color Mixing Preventing Agent (Cpd-5) | 0.02 |
| Solvent (Solv-5) | 0.08 |
| Seventh Layer (Protective Layer): | |
| Gelatin | 1.33 |
| Acryl-modified Copolymer of Polyvinyl Alcohol (modification degree 17%) | 0.17 |
| Liquid Paraffin | 0.03 |

The above noted compounds are described below.

(ExY) Yellow Coupler:

-continued
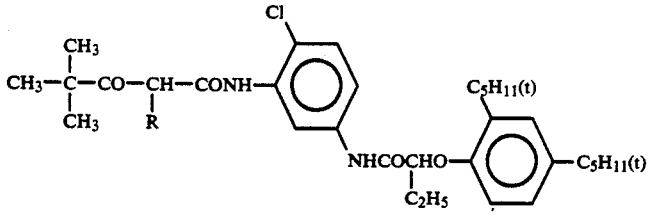
1/1 (by mol) mixture of the following:
R =
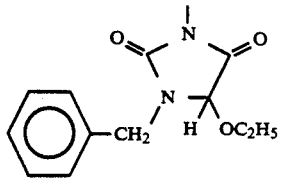
and
R =
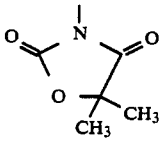
(ExM) Magenta Coupler:
1/1 (by mol) mixture of the following:
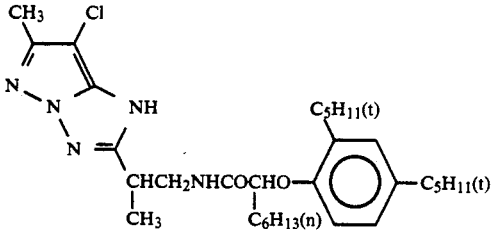
and
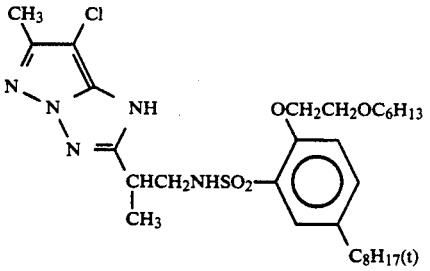
(ExC) Cyan Coupler:
2/4/4 (by weight) mixture of the following:
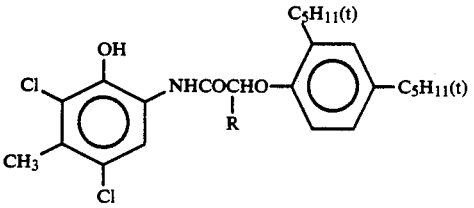
R = $C_2H_5$ and $C_4H_9$
and -continued
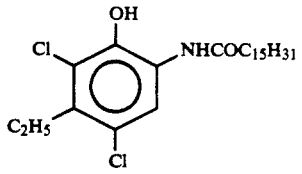
(Cpd-1) Color Image Stabilizer:
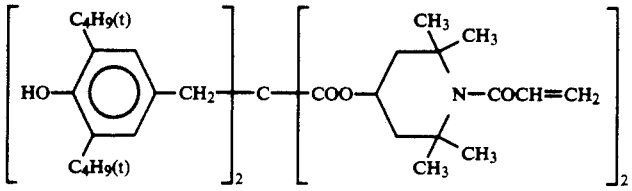
(Cpd-2) Color Image Stabilizer:
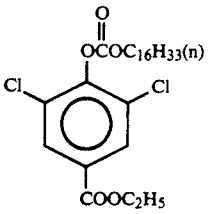
(Cpd-3) Color Image Stabilizer:
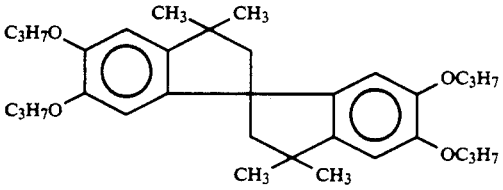
(Cpd-4) Color Image Stabilizer:
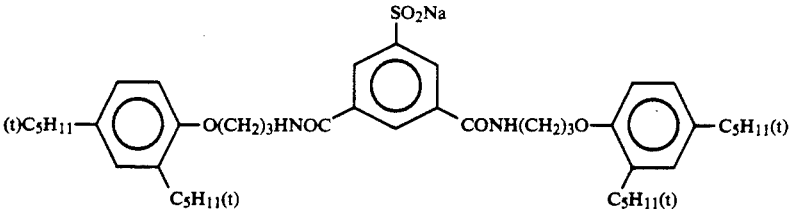
(Cpd-5) Color Mixing Preventing Agent:
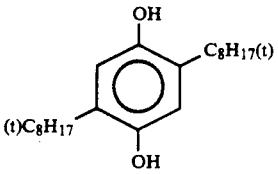
(Cpd-6) Color Image Stabilizer:
2/4/4 (by weight) mixture of the following:

-continued
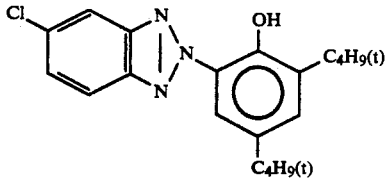
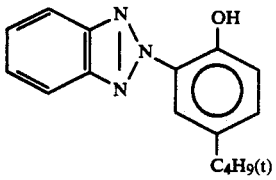
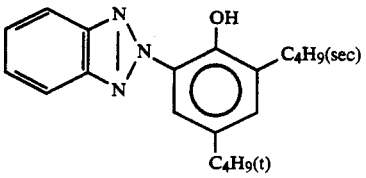
(Cpd-7) Color Image Stabilizer:
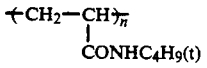
(mean molecular weight: 60,000)
(Cpd-8) Color Image Stabilizer:
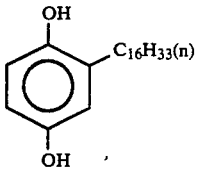
(Cpd-9) Color Image Stabilizer:
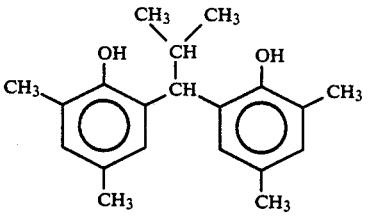
(UV-1) Ultraviolet Absorbent:
4/2/4 (by weight) mixture of the following:
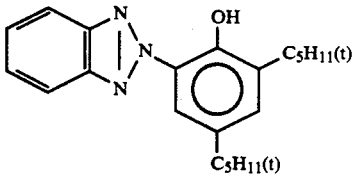
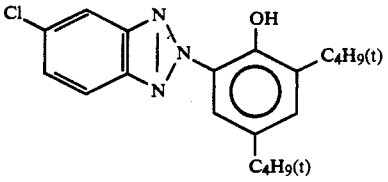

-continued

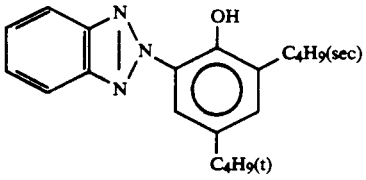

(Solv-1) Solvent:

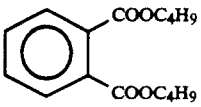

(Solv-2) Solvent:

2/1 (by volume) mixture of the following:

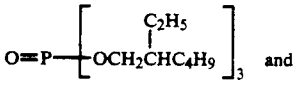

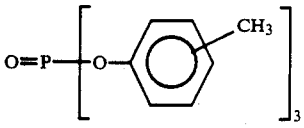

(Solv-4) Solvent:

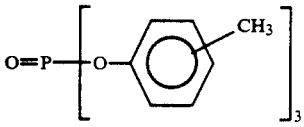

(Solv-5) Solvent:

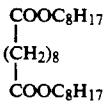

(Solv-6) Solvent:

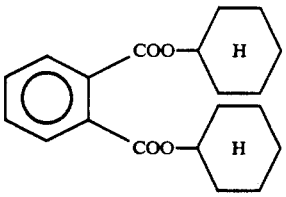

The photographic material sample thus prepared was cut into a desired size, imagewise exposed and subjected to a running test with a paper processing machine in accordance with the process described below. The running test was continued until the amount of the replenisher to the bleach-fixing tank reached two times that of the tank capacity. Apart from this, the sample was exposed to a white light and then processed in the same manner and with the same processing system after completion of the running test.

Processing Steps

| Step | Temp. | Time | Replenisher (*) | Tank Capacity (liter) |
|---|---|---|---|---|
| Color Development | 39° C. | 45 sec | 70 ml | 20 |
| Bleach-Fixing | 35° C. | 30 sec | 60 ml (**) | 20 |
| Rinsing (1) | 35° C. | 20 sec | — | 10 |
| Rinsing (2) | 35° C. | 20 sec | — | 10 |
| Rinsing (3) | 35° C. | 20 sec | 360 ml | 10 |
| Drying | 80° C. | 60 sec | | |

Rinsing was effected by a three-tank countercurrent cascade system from rinsing tank (3) to rinsing tank (1).

The processing solutions used in the above process are described below.

| | Tank Solution | Replenisher |
|---|---|---|
| Color Development: | | |
| Water | 700 ml | 700 ml |
| Diethylenetriaminetetra-acetic Acid | 0.4 g | 0.4 g |
| N,N,N-trimethylene-phosphonic Acid | 4.0 g | 4.0 g |
| 1-Hydroxyethylidene-1,1-diphosphonic Acid | 0.4 g | 0.4 g |
| Triethanolamine | 12.0 g | 12.0 g |
| Potassium Chloride | 6.5 g | — |
| Potassium Bromide | 0.03 g | — |
| Potassium Carbonate | 27.0 g | 27.0 g |
| Brightening Agent (WHITEX 4B, product by Sumitomo Chemical Co.) | 1.0 g | 3.0 g |
| Sodium Sulfite | 0.1 g | 0.1 g |
| N,N-bis(sulfoethyl)hydroxyl-amine | 10.0 g | 13.0 g |
| N-ethyl-N-(β-methanesulfon-amidoethyl)-3-methyl-4-amino-aniline Sulfate | 5.0 g | 11.5 g |
| Water to make | 1000 ml | 1000 ml |
| pH (25° C.) | 10.10 | 11.10 |
| Bleach-fixing Solution: | | |
| Water | 500 ml | 100 ml |
| Fixing Agent (See Table 1) | 0.5 mol | 1.25 mol |
| Ammonium Sulfite (Ammonium sulfite was used only when the fixing agent was ammonium thiosulfate.) | 40 g | 100 g |
| Bleaching Agent (See Table 1) | 0.15 mol | 0.37 mol |
| Chelating Agent (The same as that of the bleaching agent.) | 0.02 mol | 0.04 mol |
| Ammonium Bromide | 40 g | 75 g |
| Nitric Acid (67 wt %) | 30 g | 65 g |
| Water to make | 1000 ml | 1000 ml |
| pH (25° C., as adjusted with acetic acid or ammonia) | 5.8 | 5.6 |

Rinsing Solution

Both the tank solution and the replenisher were the same.

An ion-exchanged water (having a calcium content and magnesium content each of 3 ppm or less) was used.

Evaluation of Desilvering Capacity

The white-exposed film as processed in the processing system after the running test was evaluated with respect to the amount of silver remaining therein by X-ray fluorescence.

Evaluation of Bleaching Fog

The image-exposed film sample of just before finish of the running test was evaluated with respect to the magenta minimum density (Dmin) by the use of a photographic densitometer (FSD 103 Model, manufactured by Fuji Photo Film Co.).

Evaluation of Processing Solution Stability

After the running test, the bleach-fixing solution used was visually evaluated with respect to the presence or absence of solid precipitates therein. Evaluation was made on the basis of the following criteria.

○: No precipitate formed.

Δ: Some precipitates formed.

x: Substantial precipitates formed.

Results of the tests are shown in Table 1 below.

TABLE 1

| No. | Bleaching Agent [Fe(III) Salt] | Fixing Agent | Amount of Remaining Silver (μg/cm²) | Magenta (Dmin) | Precipitates in Bleach-fixing Solution | Remarks |
|---|---|---|---|---|---|---|
| 1 | EDTA | ATS | 8.5 | 0.15 | Δ | comparative sample |
| 2 | 1,3-PDTA | ATS | 1.1 | 0.25 | X | comparative sample |
| 3 | Compound 1 | ATS | 1.0 | 0.12 | X | comparative sample |
| 4 | Compound 21 | ATS | 1.0 | 0.12 | X | comparative sample |
| 5 | EDTA | A-4 | 8.0 | 0.16 | ○ | comparative sample |
| 6 | 1,3-PDTA | A-4 | 1.0 | 0.27 | ○ | comparative sample |
| 7 | Compound 1 | A-4 | 0.1 | 0.08 | ○ | sample of the invention |
| 8 | Compound 21 | A-4 | 0.2 | 0.09 | ○ | sample of the invention |
| 9 | EDTA | B-3 | 8.1 | 0.15 | ○ | comparative sample |
| 10 | 1,3-PDTA | B-3 | 1.1 | 0.26 | ○ | comparative sample |
| 11 | Compound 1 | B-3 | 0.1 | 0.09 | ○ | sample of the invention |
| 12 | Compound 21 | B-3 | 0.1 | 0.09 | ○ | sample of the invention |

ATS: Ammonium Thiosulfate

As clearly seen from the results in Table 1 above, the present invention provided good results with respect to each of desilverability, prevention of bleaching fog, and stability of bleach-fixing solution.

EXAMPLE 2

The same tests as in Example 1 were carried out, except that the bleaching agent in No. 11 was separately replaced by the Fe(III) salts of Compounds 2, 3, 5, 12, 25, 26, 33, 35 and 39, each in an equimolar amount. Like Example 1, the same good results were also obtained.

EXAMPLE 3

The same tests as in Example 1 were carried out, except that the fixing agent in No. 11 was separately replaced by of A-1, A-6, A-12, B-1, B-4, C-1, C-2 and C-6, each in an equimolar amount. Like Example 1, the same good results were also obtained.

EXAMPLE 4

Plural layers each having the composition described below were formed on a subbing layer-coated cellulose triacetate film support to prepare a multi-layer color photographic material sample No. 101.

Constitution of Photographic Layers

The coverage is given in units of g/m² as silver, for silver halides and colloidal silvers. The coverage for couplers, additives and gelatin is given in units of g/m². The coverage of sensitizing dyes is given as mols per mol of silver halide contained in the same layer.

| First Layer (Anti-halation Layer): | |
|---|---|
| Black Colloidal Silver | 0.20 as Ag |
| Gelatin | 2.20 |

-continued

| | |
|---|---|
| UV-1 | 0.11 |
| UV-2 | 0.20 |
| Cpd-1 | $4.0 \times 10^{-2}$ |
| Cpd-2 | $1.9 \times 10^{-2}$ |
| Solv-1 | 0.30 |
| Solv-2 | $1.2 \times 10^{-2}$ |
| Second Layer (Interlayer): | |
| Fine Silver Iodobromide Grains (AgI 1.0 mol %; sphere-corresponding diameter 0.07 μm) | 0.15 as Ag |
| Gelatin | 1.00 |
| ExC-4 | $6.0 \times 10^{-2}$ |
| Cpd-3 | $2.0 \times 10^{-2}$ |
| Third Layer (First Red-sensitive Emulsion Layer): | |
| Silver Iodobromide Emulsion (AgI 5.0 mol %; AgI-rich surface type; sphere-corresponding diameter 0.9 μm; variation coefficient of sphere-corresponding diameter 21%; tabular grains with aspect ratio of diameter/thickness of 7.5) | 0.42 as Ag |
| Silver Iodobromide Emulsion (AgI 4.0 mol %; AgI-rich internal type; sphere-corresponding diameter 0.4 μm; variation coefficient of sphere-corresponding diameter 18%; tetradecahedral grains) | 0.40 as Ag |
| Gelatin | 1.90 |
| ExS-1 | $4.5 \times 10^{-4}$ mol |
| ExS-2 | $1.5 \times 10^{-4}$ mol |
| ExS-3 | $4.0 \times 10^{-5}$ mol |
| ExC-1 | 0.65 |
| ExC-3 | $1.0 \times 10^{-2}$ |
| ExC-4 | $2.3 \times 10^{-2}$ |
| Solv-1 | 0.32 |
| Fourth Layer (Second Red-sensitive Emulsion Layer): | |
| Silver Iodobromide Emulsion (AgI 8.5 mol %; AgI-rich internal type; sphere-corresponding diameter 1.0 μm; variation coefficient of sphere-corresponding diameter 25%; tabular grains with aspect ratio of diameter/thickness of 3.0) | 0.85 as Ag |
| Gelatin | 0.91 |
| ExS-1 | $3.0 \times 10^{-4}$ mol |
| ExS-2 | $1.0 \times 10^{-4}$ mol |
| ExS-3 | $3.0 \times 10^{-5}$ mol |
| ExC-1 | 0.13 |
| ExC-2 | $6.2 \times 10^{-2}$ |
| ExC-4 | $4.0 \times 10^{-2}$ |
| Solv-1 | 0.10 |
| Fifth Layer (Third Red-sensitive Emulsion Layer): | |
| Silver Iodobromide Emulsion (AgI 11.3 mol %; AgI-rich internal type; sphere-corresponding diameter 1.4 μm; variation coefficient of sphere-corresponding diameter 28%; tabular grains with aspect ratio of diameter/thickness of 6.0) | 1.50 as Ag |
| Gelatin | 1.20 |
| ExS-1 | $2.0 \times 10^{-4}$ mol |
| ExS-2 | $6.0 \times 10^{-5}$ mol |
| ExS-3 | $2.0 \times 10^{-5}$ mol |
| ExC 2 | $8.5 \times 10^{-2}$ |
| ExC-5 | $7.3 \times 10^{-2}$ |
| Solv-1 | 0.12 |
| Solv-2 | 0.12 |
| Sixth Layer (Interlayer): | |
| Gelatin | 1.00 |
| Cpd-4 | $8.0 \times 10^{-2}$ |
| Solv-1 | $8.0 \times 10^{-2}$ |
| Seventh Layer (First Green-sensitive Emulsion Layer): | |
| Silver Iodobromide Emulsion (AgI 5.0 mol %; AgI-rich surface type; sphere-corresponding diameter 0.9 μm; variation coefficient of sphere-corresponding diameter 21%; tabular grains with aspect ratio of diameter/thickness of 7.0) | 0.28 as Ag |
| Silver Iodobromide Emulsion (AgI 4.0 mol %; AgI-rich internal type; sphere-corresponding diameter 0.4 μm; variation coefficient of sphere-corresponding diameter 18%; tetradecahedral grains) | 0.16 as Ag |
| Gelatin | 1.20 |
| ExS-4 | $5.0 \times 10^{-4}$ mol |
| ExS-5 | $2.0 \times 10^{-4}$ mol |
| ExS-6 | $1.0 \times 10^{-4}$ mol |
| ExM-1 | 0.50 |
| ExM-2 | 0.10 |
| ExM-5 | $3.5 \times 10^{-2}$ |
| Solv-1 | 0.20 |
| Solv-3 | $3.0 \times 10^{-2}$ |
| Eighth Layer (Second Green-sensitive Emulsion Layer): | |
| Silver Iodobromide Emulsion (AgI 8.5 mol %; AgI-rich internal type; sphere-corresponding diameter 1.0 μm; fluctuation coefficient of sphere-corresponding diameter 25%; tabular grains with aspect ratio of diameter/thickness of 3.0) | 0.57 as Ag |
| Gelatin | 0.45 |
| ExS-4 | $3.5 \times 10^{-4}$ mol |
| ExS-5 | $1.4 \times 10^{-4}$ mol |
| ExS-6 | $7.0 \times 10^{-5}$ mol |
| ExM-1 | 0.12 |
| ExM-2 | $7.1 \times 10^{-3}$ |
| ExM-3 | $3.5 \times 10^{-2}$ |
| Solv-1 | 0.15 |
| Solv-3 | $1.0 \times 10^{-2}$ |
| Ninth Layer (Interlayer): | |
| Gelatin | 0.50 |
| Solv-1 | $2.0 \times 10^{-2}$ |
| Tenth Layer (Third Green-sensitive Emulsion Layer): | |
| Silver Iodobromide Emulsion (AgI 11.3 mol %; AgI-rich internal type; sphere-corresponding diameter 1.4 μm; variation coefficient of sphere-corresponding diameter 28%; tabular grains with aspect ratio of diameter/thickness of 6.0) | 1.30 as Ag |
| Gelatin | 1.20 |
| ExS-4 | $2.0 \times 10^{-4}$ mol |
| ExS-5 | $8.0 \times 10^{-5}$ mol |
| ExS-6 | $8.0 \times 10^{-5}$ mol |
| ExM-4 | $4.5 \times 10^{-2}$ |
| ExM-6 | $1.0 \times 10^{-2}$ |
| ExC-2 | $4.5 \times 10^{-3}$ |
| Cpd-5 | $1.0 \times 10^{-2}$ |
| Solv-1 | 0.25 |
| Eleventh Layer (Yellow Filter Layer): | |
| Gelatin | 0.50 |
| Cpd-8 | $5.2 \times 10^{-2}$ |
| Solv-1 | 0.12 |
| Twelfth Layer (Interlayer): | |
| Gelatin | 0.45 |
| Cpd-3 | 0.10 |
| Thirteenth Layer (First Blue-sensitive Emulsion Layer): | |
| Silver Iodobromide Emulsion (AgI 2 mol %; uniform AgI type; sphere-corresponding diameter 0.55 μm; fluctuation coefficient of sphere-corresponding diameter 25%; tabular grains with aspect ratio of diameter/thickness of 7.0) | 0.20 as Ag |
| Gelatin | 1.00 |
| ExS-7 | $3.0 \times 10^{-4}$ mol |
| ExY-1 | 0.60 |
| ExY-2 | $2.3 \times 10^{-2}$ |
| Solv-1 | 0.15 |
| Fourteenth Layer (Second Blue-sensitive Emulsion Layer): | |
| Silver Iodobromide Emulsion | 0.19 as Ag |

-continued

| | |
|---|---|
| (AgI 19.0 mol %; AgI-rich internal type; sphere-corresponding diameter 1.0 μm; variation coefficient of sphere-corresponding diameter 16%; octahedral grains) | |
| Gelatin | 0.35 |
| ExS-7 | $2.0 \times 10^{-4}$ mol |
| ExY-1 | 0.22 |
| Solv-1 | $7.0 \times 10^{-2}$ |
| Fifteenth Layer (Interlayer): | |
| Fine Silver Iodobromide Grains (AgI 2 mol %; uniform AgI type; sphere-corresponding diameter 0.13 μm) | 0.20 as Ag |
| Gelatin | 0.30 |
| Sixteenth Layer (Third Blue-sensitive Emulsion Layer): | |
| Silver Iodobromide Emulsion (AgI 14.0 mol %; AgI-rich internal type; sphere-corresponding diameter 1.7 μm; variation coefficient of sphere-corresponding diameter 28%; tabular grains with aspect ratio of diameter/thickness of 5.0) | 1.55 as Ag |
| Gelatin | 1.00 |
| ExS-8 | $1.5 \times 10^{-4}$ mol |
| ExY-1 | 0.21 |
| Solv-1 | $7.0 \times 10^{-2}$ |
| Seventeenth Layer (First Protective Layer): | |
| Gelatin | 1.80 |

-continued

| | |
|---|---|
| UV-1 | 0.13 |
| UV-2 | 0.21 |
| Solv-1 | $1.0 \times 10^{-2}$ |
| Solv-2 | $1.0 \times 10^{-2}$ |
| Eighteenth Layer (Second Protective Layer): | |
| Fine Silver Chloride Grains (sphere-corresponding diameter 0.07 μm) | 0.36 as Ag |
| Gelatin | 0.70 |
| B-1 (diameter 1.5 μm) | $2.0 \times 10^{-2}$ |
| B-2 (diameter 1.5 μm) | 0.15 |
| B-3 | $3.0 \times 10^{-2}$ |
| W-1 | $2.0 \times 10^{-2}$ |
| H-1 | 0.35 |
| Cpd-7 | 1.00 |

To the sample were further added, in addition to the above-noted components, 1,2-benzisothiazolin-3-one (200 ppm to gelatin), n-butyl p-hydroxybenzoate (about 1,000 ppm to gelatin), and 2-phenoxyethanol (about 10,000 ppm to gelatin). In addition, the sample further contained B-4, B-5, W-2, W-3, F-1, F-2, F-3, F-4, F-5, F-6, F-7, F-8, F-9, F-10, F-11, F-12, F-13, as well as iron salt, lead salt, gold salt, platinum salt, iridium salt and rhodium salt.

The compounds used above are described below.

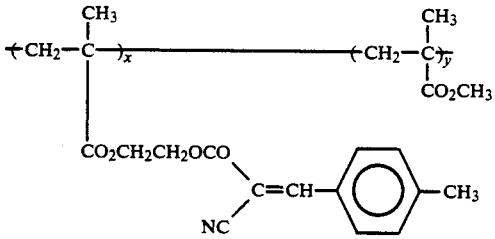

UV-1

X:Y = 7/3 (by weight)

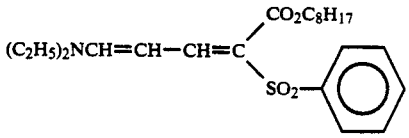

UV-2

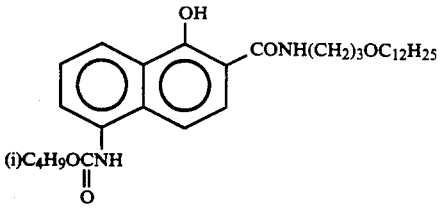

ExC-1

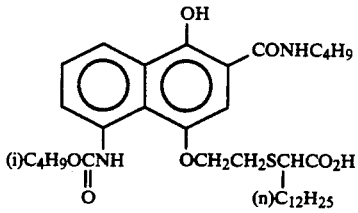

ExC-2

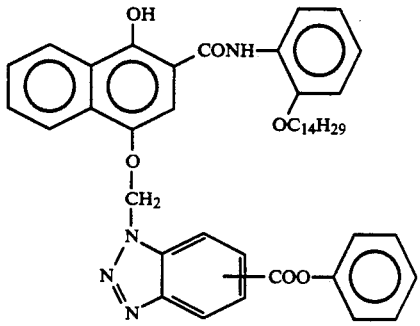

ExC-3

-continued
ExC-4
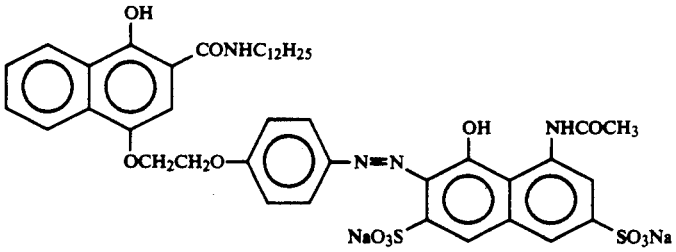
ExC-5
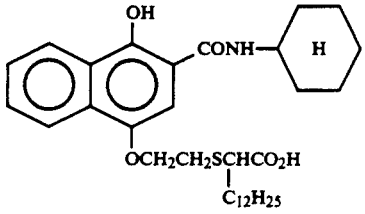
ExM-1
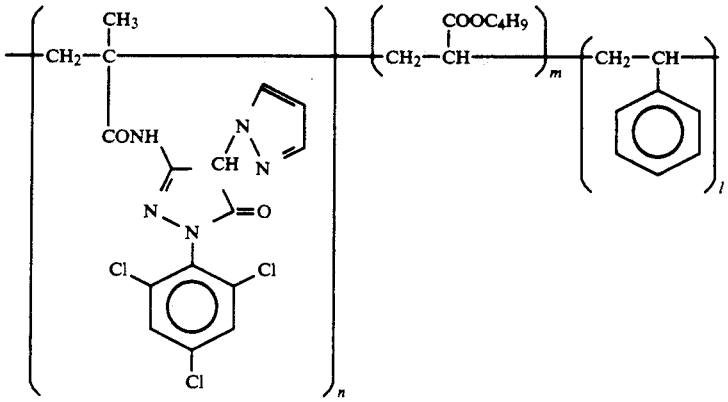
n:m:l = 2:1:1 (by weight)
Average Molecular Weight: 20,000
ExM-2
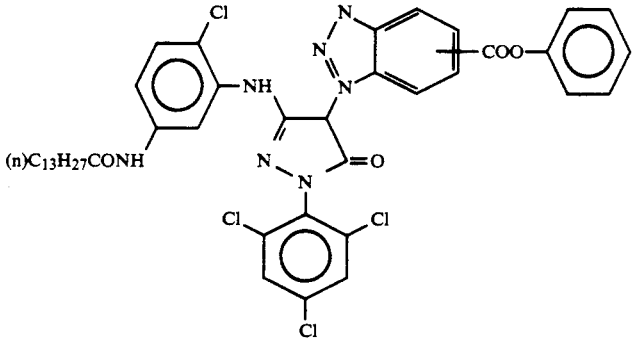
ExM-3
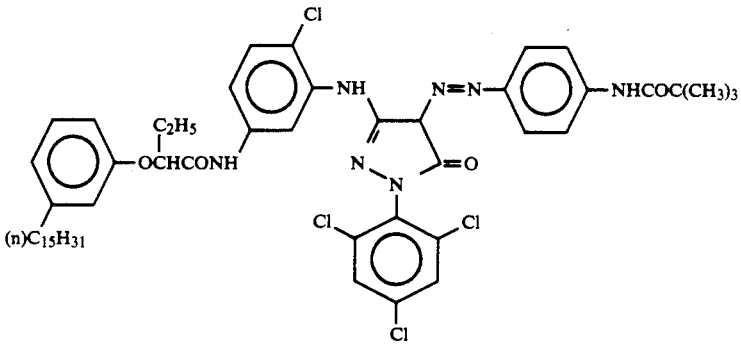

-continued
ExM-4
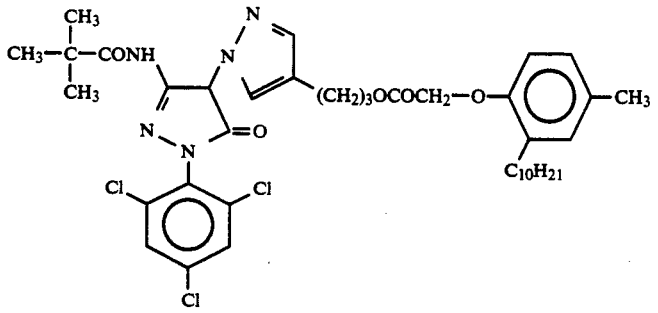
ExM-5
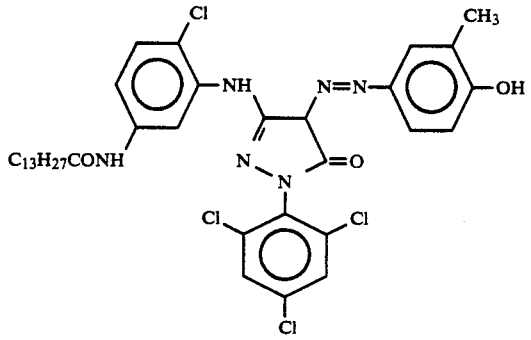
ExM-6
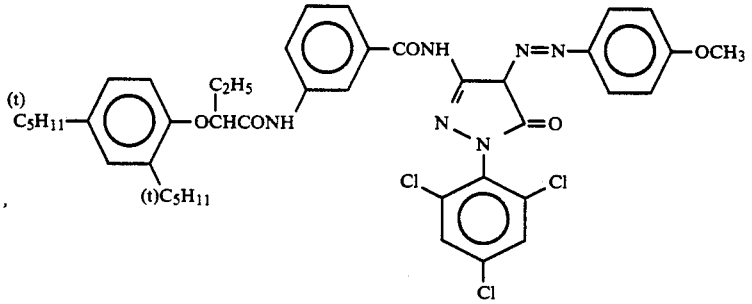
ExY-1
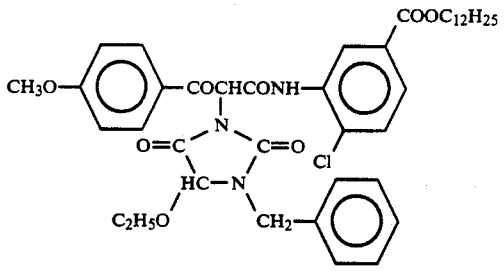
ExY-2
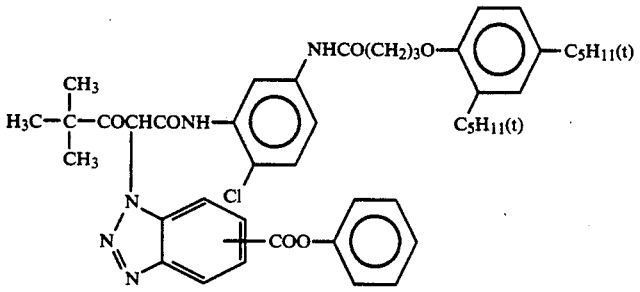

-continued
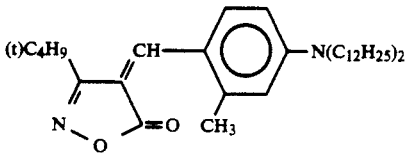
Cpd-1
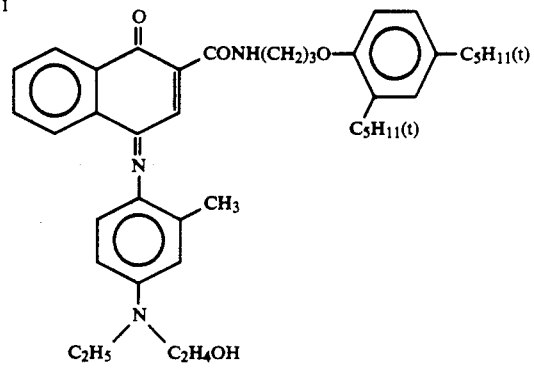
Cpd-2
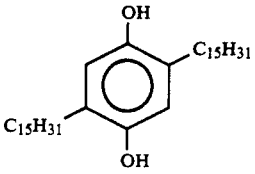
Cpd-3
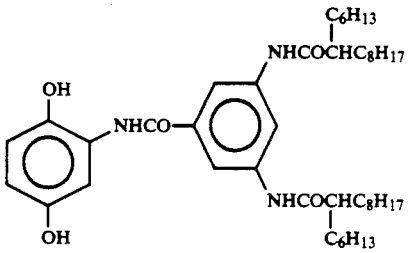
Cpd-4
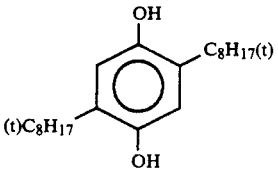
Cpd-5
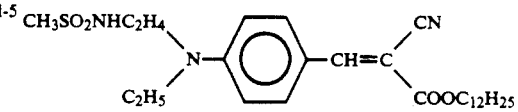
Cpd-6
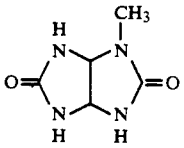
Cpd-7
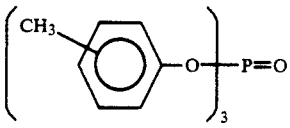
Solv-1
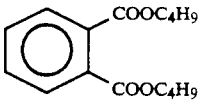
Solv-2
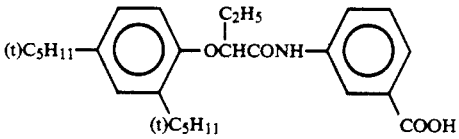
Solv-3
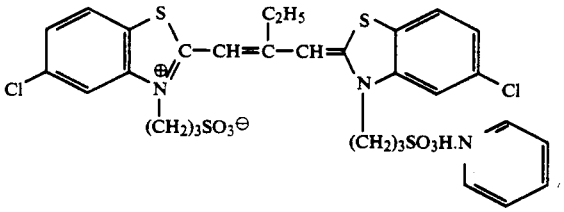
ExS-1
ExS-2
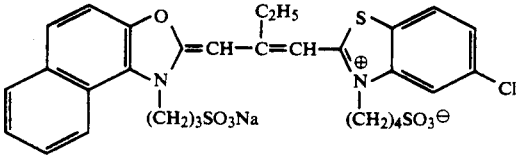
ExS-3
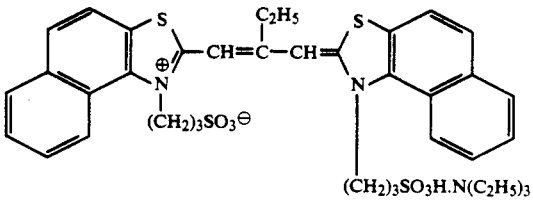

-continued
ExS-4
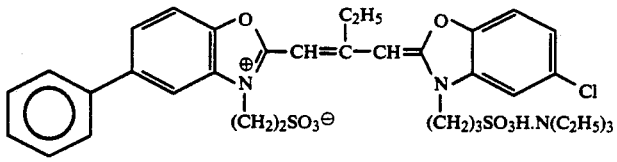
ExS-5
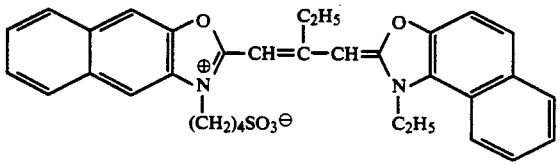
ExS-6
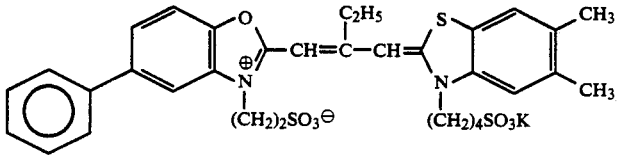
ExS-7
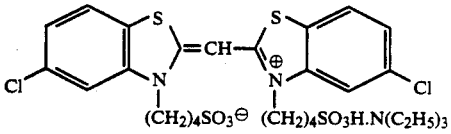
ExS-8
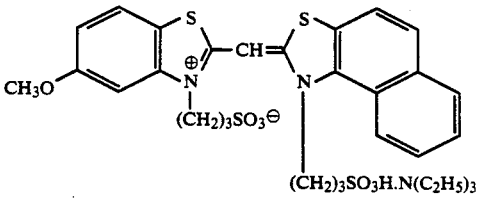
B-1
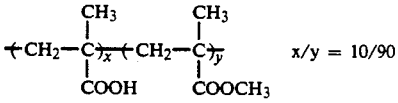
x/y = 10/90
B-2
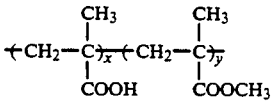
x/y = 40/60
B-3
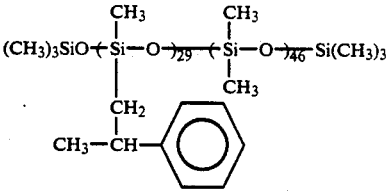
B-4
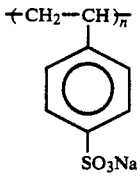
B-5
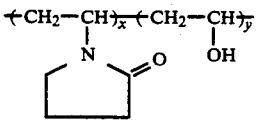
x/y = 70/30
W-1
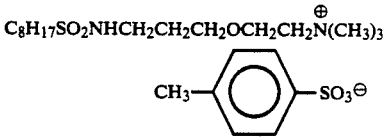
W-2
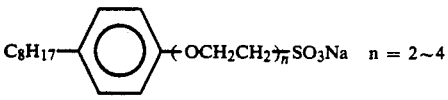
n = 2~4
W-3
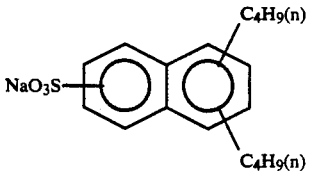
H-1
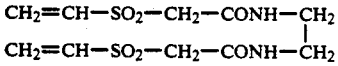
F-1
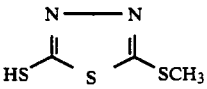

-continued

F-2

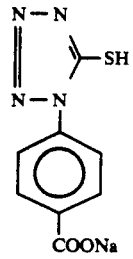

F-3

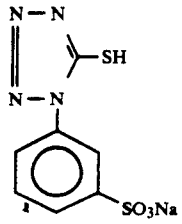

F-4

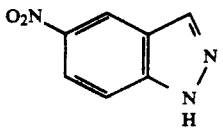

F-5

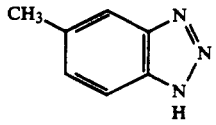

F-6

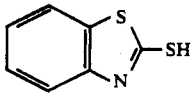

F-7

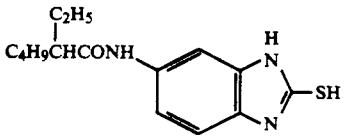

F-8

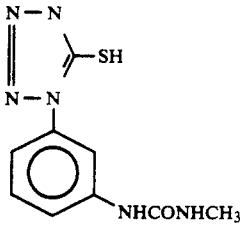

F-9

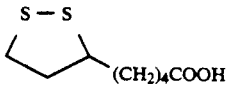

F-10

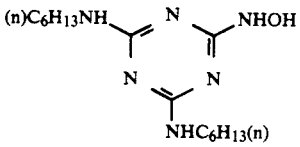

F-11

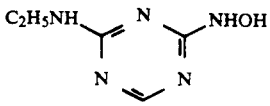

F-12

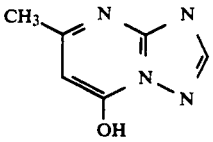

F-13

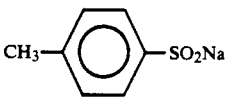

The photographic material sample thus prepared was cut into a desired size, imagewise exposed and subjected to a running test with a negative type automatic processing machine in accordance with the process described below. The test was continued until the amount of the replenisher to the bleach-fixing tank reached two times the tank capacity. Apart from this, the sample was exposed to a white light and then processed in the same manner and with the processing system used after the running test.

Processing Steps

| Step | Temp. | Time | Replenisher (*) | Tank Capacity (liter) |
|---|---|---|---|---|
| Color Development | 38.0° C. | 3 min 05 sec | 600 ml | 17 |
| Bleach-Fixing (1) | 38.0° C. | 50 sec | — | 5 |
| Bleach-Fixing (2) | 38.0° C. | 50 sec | 400 ml | 5 |
| Rinsing | 38.0° C. | 30 sec | 900 ml | 3 |
| Stabilization | 38.0° C. | 20 sec | — | 3 |

-continued

| Step | Temp. | Time | Replenisher (*) | Tank Capacity (liter) |
|---|---|---|---|---|
| (1) Stabilization | 38.0° C. | 20 sec | 560 ml | 3 |
| (2) Drying | 80° C. | 60 sec | | |

(*) This is an amount of the replenisher per $m^2$ of the photographic material sample processed.

The bleach-fixing and rinsing were effected each by a countercurrent cascade system from tank (2) to tank (1). The amount of the carryover of the developer to the bleach-fixing step and that of the bleach-fixing solution (2) to the rinsing step each were 65 ml and 50 ml, respectively, per $m^2$ of the sample processed. The crossover time was 6 seconds at every interval between adjacent steps, and this crossover time is included nit he processing time of the previous step.

The compositions of the processing solutions as used above are described below.

Color Developer

| | Starting Solution | Replenisher |
|---|---|---|
| Diethylenetriaminepenta-acetic Acid | 2.0 g | 2.0 g |
| 1-Hydroxyethylidene-1,1-diphosphonic Acid | 3.3 g | 3.3 g |
| Sodium Sulfite | 3.9 g | 5.1 g |
| Potassium Carbonate | 37.5 g | 39.0 g |
| Potassium Bromide | 1.4 g | 0.4 g |
| Potassium Iodide | 1.3 mg | — |
| Hydroxylamine Sulfate | 2.4 g | 3.3 g |
| 2-Methyl-4-[N-ethyl-N-(β-hydroxyethyl)amino]aniline Sulfate | 4.5 g | 6.0 g |
| Water to make | 1000 ml | 1000 ml |
| pH (25° C.) | 10.05 | 10.05 |
| Bleach-fixing Solution: | | |
| Fixing Agent (see Table 2) | 1.3 mol | 1.9 mol |
| Ammonium Sulfite (Ammonium sulfite was used only when the fixing agent was ammonium thiosulfate.) | 40 g | 100 g |
| Bleaching Agent (see Table 2) | 0.15 mol | 0.23 mol |
| Chelating Agent (The same as that of the bleaching agent.) | 0.05 mol | 0.08 mol |
| Ammonium Bromide | 80 g | 120 g |
| Acetic Acid | 40 g | 60 g |
| Water to make | 1000 ml | 1000 ml |
| pH (at 25° C., as adjusted with acetic acid or ammonia) | 5.8 | 5.6 |

Rinsing Water

Municipal water was passed through a mixed bed type column filled with an H-type strong acidic cation-exchange resin (Amberlite IR-120B, produced by Rohm & Haas Co.) and an OH-type strong basic anion-exchange resin (Amberlite IRA-400, produced by Rohm & Haas Co.), such that both the calcium ion concentration and the magnesium ion concentration in the water were each reduced to 3 mg/liter. Next, 20 mg/liter of sodium dichloroisocyanurate and 150 mg/liter of sodium sulfate were added to the resulting water, which had a pH value within the range of from 6.5 to 7.5. The solution thus prepared was used as the rinsing water.

Stabilizing Solution

Both the starting solution and the replenisher were same.

| | |
|---|---|
| Sodium p-toluenesulfinate | 0.1 g |
| Polyoxyethylene p-monononylphenyl Ether (mean polymerization degree 10) | 0.2 g |
| Disodium Ethylenediaminetetraacetate | 0.05 g |
| Formalin | 0.02 mol |
| Water to make | 1 liter |
| pH (as adjusted with aqueous ammonia or acetic acid) | 7.2 |

Evaluation of Desilvering Capacity

The white-exposed film as processed in the processing system after the running test was evaluated with respect to the amount of silver remaining therein by X-ray fluorescence.

Evaluation of Bleaching Fog

The image-exposed film sample processed just before completion of the running test was evaluated with respect to the magenta minimum density (Dmin) by use of a photographic densitometer (FSD 103 Model, manufactured by Fuji Photo Film Co.).

Evaluation of Processing Solution Stability

After the running test, the bleach-fixing solution used was visually evaluated with respect to the presence or absence of solid precipitates. Evaluation was made on the basis of the following criteria.

○: No precipitate formed.
Δ: Some precipitates formed.
x: Substantial precipitates formed.

Results of the tests are shown in Table 2 below.

TABLE 2

| No. | Bleaching Agent [Fe(III) Salt] | Fixing Agent | Amount of Remaining Silver (μg/cm²) | Magenta (Dmin) | Precipitates in Bleach-fixing Solution | Remarks |
|---|---|---|---|---|---|---|
| 1 | EDTA | ATS | 100 | 0.30 | Δ | comparative sample |
| 2 | 1,3-PDTA | ATS | 15.0 | 0.35 | X | comparative sample |
| 3 | Compound 1 | ATS | 14.0 | 0.28 | X | comparative sample |
| 4 | Compound 25 | ATS | 14.5 | 0.28 | X | comparative sample |
| 5 | EDTA | A-12 | 90.0 | 0.32 | ○ | comparative sample |
| 6 | 1,3-PDTA | A-12 | 10.0 | 0.40 | ○ | comparative sample |
| 7 | Compound 1 | A-12 | 0.5 | 0.20 | ○ | sample of the invention |
| 8 | Compound 25 | A-12 | 0.6 | 0.20 | ○ | sample of the invention |
| 9 | EDTA | B-4 | 90.0 | 0.32 | ○ | comparative sample |
| 10 | 1,3-PDTA | B-4 | 11.0 | 0.39 | ○ | comparative sample |
| 11 | Compound 1 | B-4 | 0.5 | 0.20 | ○ | sample of the invention |
| 12 | Compound 25 | B-4 | 0.5 | 0.21 | ○ | sample of the invention |

ATS: Ammonium Thiosulfate

As clearly seen from the results in Table 2 above, the present invention provided good results with respect to each of desilverability, prevention of bleaching fog, and stability of bleach-fixing solution.

EXAMPLE 5

The same tests as in Example 4 were carried out, except that the bleaching agent in No. 11 was separately replaced by the Fe(III) salts of Compounds 2, 3, 6, 12, 21, 27, 34 and 36, each in an equimolar amount. Like Example 4, the same good results were also obtained.

EXAMPLE 6

The same tests as in Example 4 were carried out, except that the fixing agent in No. 11 was separately replaced by A-1, A-4, A-10, B-1, A-13, B-3, C-2, C-5 and C-6, each in an equimolar amount. Like Example 4, the same good results were also obtained.

EXAMPLE 7

The sample as prepared in Example 4 was subjected to a running test in accordance with the processing procedure described below, until the amount of the replenisher to the bleaching tank reached two times the capacity of the same tank. Apart from this, the sample was exposed to a white light and then processed in the same manner and with the same processing system after the running test.

Processing Steps

| Step | Temp. | Time | Replenisher (*) | Tank Capacity (liter) |
|---|---|---|---|---|
| Color Development | 38.0° C. | 3 min 05 sec | 600 ml | 17 |
| Bleaching | 38.0° C. | 1 min | 200 ml | 5 |
| Fixing | 38.0° C. | 1 min 10 sec | 400 ml | 5 |
| Rinsing | 38.0° C. | 30 sec | 900 ml | 3 |
| Stabilization (1) | 38.0° C. | 20 sec | — | 3 |
| Stabilization (2) | 38.0° C. | 20 sec | 560 ml | 3 |
| Drying | 80° C. | 60 sec | | |

(*) This is an amount of the replenisher per $m^2$ of the photographic material sample processed.

The stabilization was effected by a countercurrent cascade system from tank (2) to tank (1). The amount of the carryover of the developer to the bleaching step, that of the bleaching solution to the fixing step and that of the fixing solution to the rinsing step were 65 ml, 50 ml and 50 ml, respectively, per $m^2$ of the sample being processed. The crossover time was 6 seconds at every interval between adjacent steps, and the crossover time is included in the processing time of the previous step.

The compositions of the bleaching solution and fixing solution used above are described below. The other processing solutions were same as those used in Example 4.

| | Starting Solution | Replenisher |
|---|---|---|
| Bleaching Solution: | | |
| Bleaching Agent (see Table 3) | 0.33 mol | 0.5 mol |
| Ammonium Bromide | 80 g | 120 g |
| Ammonium Nitrate | 15 g | 25 g |
| Hydroxyacetic Acid | 50 g | 75 g |
| Acetic Acid | 40 g | 60 g |
| Water to make | 1 liter | 1 liter |
| pH (as adjusted with aqueous ammonia) | 4.3 | 4.0 |
| Fixing Solution: | | |
| Fixing Agent (see Table 3) | 1.3 mol | 1.9 mol |

-continued

| | Starting Solution | Replenisher |
|---|---|---|
| Ammonium Sulfite (Ammonium sulfite was used only when the fixing agent was ammonium thiosulfate.) | 40 g | 100 g |
| Imidazole | 17 g | 26 g |
| Ethylenediaminetetraacetic Acid | 13 g | 20 g |
| Water to make | 1 liter | 1 liter |
| pH (as adjusted with aqueous ammonia or acetic acid) | 7.0 | 7.4 |

Evaluation with respect to desilverability, prevention of bleaching fog and stabilization of the processing solutions was conducted in the same manner as in Example 4. The results obtained are shown in Table 3 below.

TABLE 3

| No. | Bleaching Agent [Fe(III) Salt] | Fixing Agent | Amount of Remaining Silver ($\mu g/cm^2$) | Magenta (Dmin) | Precipitates in Bleach-fixing Solution | Remarks |
|---|---|---|---|---|---|---|
| 1 | EDTA | ATS | 120 | 0.31 | Δ | comparative sample |
| 2 | 1,3-PDTA | ATS | 20.0 | 0.36 | X | comparative sample |
| 3 | Compound 1 | ATS | 15.0 | 0.29 | X | comparative sample |
| 4 | Compound 21 | ATS | 15.5 | 0.29 | X | comparative sample |
| 5 | EDTA | A-4 | 95.0 | 0.33 | ○ | comparative sample |
| 6 | 1,3-PDTA | A-4 | 15.0 | 0.40 | ○ | comparative sample |
| 7 | Compound 1 | A-4 | 1.0 | 0.21 | ○ | sample of the invention |
| 8 | Compound 21 | A-4 | 1.1 | 0.21 | ○ | sample of the invention |
| 9 | EDTA | B-4 | 97.0 | 0.32 | ○ | comparative sample |
| 10 | 1,3-PDTA | B-4 | 17.0 | 0.39 | ○ | comparative sample |
| 11 | Compound 1 | B-4 | 1.1 | 0.20 | ○ | sample of the invention |
| 12 | Compound 21 | B-4 | 1.0 | 0.20 | ○ | sample of the invention |

ATS: Ammonium Thiosulfate

As clearly seen from the result in Table 3 above, the present invention provided good results with respect to each of desilverability, prevention of bleaching fog, and stability of the bleach-fixing solution

EXAMPLE 8

The same process as in Example 7 was repeated, except that the same molar amount of the following compound, as an image stabilizing agent, was incorporated into the stabilizing solution in place of formalin.

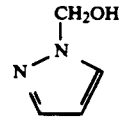

As in Example 7, the same good results were also obtained.

EXAMPLE 9

The following first to fourteenth layers were coated on the front surface of a paper support (thickness 100 μm), both surfaces of which had been laminated with polyethylene, while the following fifteenth and sixteenth layers were coated on the back surface of the same, to prepare a color photographic material sample. The polyethylene laminate below the first layer contained titanium oxide as a white pigment and a small amount of ultramarine as a bluish dye. The chromaticity of the front surface of the support was 88.0, −0.20 and −0.75, as L*, a*, b*, respectively, of the chromaticity system.

Constitution of Photographic Layers

Components constituting each layer are described below, together with the coverage of each component (unit, g/m$^2$). The silver halide coverage is given as the amount of silver. Emulsions in the the following layers were prepared in accordance with the method of preparing emulsion EM1. The emulsion in the fourteenth layer was a Lippmann emulsion which had not been subjected to surface chemical sensitization.

| | |
|---|---|
| First Layer (Anti-halation Layer): | |
| Black Colloidal Silver | 0.10 |
| Gelatin | 0.70 |
| Second Layer (Interlayer): | |
| Gelatin | 0.70 |
| Third Layer (Low-sensitivity Red-sensitive Layer): | |
| Silver Bromide color sensitized with red-sensitizing dyes (ExS-1, 2, 3) (mean grain size 0.25 μm; variation coefficient of grain size distribution 8%; octahedral grains) | 0.04 as Ag |
| Silver Chlorobromide color sensitized with red-sensitizing dyes (ExS-1, 2, 3) (silver chloride 5 mol %; mean grain size 0.40 μm; variation coefficient of grain size distribution 10%; octahedral grains) | 0.08 as Ag |
| Gelatin | 1.00 |
| Cyan Coupler (see Table 3) | 0.32 |
| Ultraviolet Absorbent (1/1/1/1 mixture of Cpd-1, 2, 3, 4) | 0.18 |
| Coupler Dispersing Medium (Cpd-5) | 0.03 |
| Coupler Solvent (1/1/1 mixture of Solv-1, 2, 3) | 0.12 |
| Fourth Layer (High-sensitivity Red-sensitive Layer): | |
| Silver Bromide color sensitized with red-sensitizing dyes (ExS-1, 2, 3) (mean grain size 0.60 μm; variation coefficient of grain size distribution 15%; octahedral grains) | 0.14 as Ag |
| Gelatin | 1.00 |
| Cyan Coupler (see Table 3) | 0.32 |
| Ultraviolet Absorbent (1/1/1/1 mixture of Cpd-1, 2, 3, 4) | 0.18 |
| Coupler Dispersing Medium (Cpd-5) | 0.03 |
| Coupler Solvent (1/1/1 mixture of Solv-1, 2, 3) | 0.12 |
| Fifth Layer (Interlayer): | |
| Gelatin | 1.00 |
| Color Mixing Preventing Agent (Cpd-6) | 0.08 |
| Color Mixing Preventing Agent Solvent (1/1 mixture of Solv-4, 5) | 0.16 |
| Polymer Latex (Cpd-7) | 0.10 |
| Sixth Layer (Low-sensitivity Green-sensitive Layer): | |
| Silver Bromide color sensitized with green-sensitizing dye (ExS-4) (mean grain size 0.25 μm; variation coefficient of grain size distribution 8%; octahedral grains) | 0.04 as Ag |
| Silver Chlorobromide color sensitized with green-sensitizing dye (ExS-4) (silver chloride 5 mol %; mean grain size 0.40 μm; variation coefficient of grain size distribution 10%; octahedral grains) | 0.06 as Ag |
| Gelatin | 0.80 |
| Magenta Coupler (1/1/1 mixture of ExM-1, 2, 3) | 0.12 |
| Coupler Dispersing Medium (Cpd-5) | 0.05 |
| Coupler Solvent (1/1 mixture of Solv-4, 5) | 0.15 |
| Seventh Layer (High-sensitivity Green-sensitive Layer): | |
| Silver Bromide color sensitized with green-sensitizing dye (ExS-4) (mean grain size 0.65 μm; variation coefficient of grain size distribution 16%; octahedral grains) | 0.10 as Ag |
| Gelatin | 0.80 |
| Magenta Coupler (1/1/1 mixture of ExM-1, 2, 3) | 0.12 |
| Coupler Dispersing Medium (Cpd-5) | 0.05 |
| Coupler Solvent (1/1 mixture of Solv-4, 6) | 0.15 |
| Eighth Layer (Interlayer): | |
| Same as fifth layer. | |
| Ninth Layer (Yellow Filter Layer): | |
| Yellow Colloidal Silver | 0.12 as Ag |
| Gelatin | 0.07 |
| Color Mixing Preventing Agent (Cpd-6) | 0.03 |
| Color Mixing Preventing Agent Dispersing Medium (1/1 mixture of Solv-4, 5) | 0.10 |
| Polymer Latex (Cpd-7) | 0.07 |
| Tenth Layer (Interlayer): | |
| Same as fifth layer. | |
| Eleventh Layer (Low-sensitivity Blue-sensitive Layer): | |
| Silver Bromide color sensitized with blue-sensitizing dyes (ExS-5, 6) (mean grain size 0.40 μm; variation coefficient of grain size distribution 8%; octahedral grains) | 0.07 as Ag |
| Silver Chlorobromide color sensitized with blue-sensitizing dyes (ExS-5, 6) (silver chloride 8 mol %; mean grain size 0.60 μm; variation coefficient of grain size distribution 11%; octahedral grains) | 0.14 |
| Gelatin | 0.80 |
| Yellow Coupler (1/1 mixture of ExY-1, 2) | 0.35 |
| Coupler Dispersing Medium (Cpd-5) | 0.05 |
| Coupler Solvent (Solv-2) | 0.10 |
| Twelfth Layer (High-sensitivity Blue-sensitive Layer): | |
| Silver Bromide color sensitized with blue-sensitizing dyes (ExS-5, 6) (mean grain size 0.85 μm; variation coefficient of grain size distribution 18%; octahedral grains) | 0.15 as Ag |
| Gelatin | 0.60 |
| Yellow Coupler (1/1 mixture of ExY-1, 2) | 0.30 |
| Coupler Dispersing Medium (Cpd-5) | 0.05 |
| Coupler Solvent (Solv-2) | 0.10 |
| Thirteenth Layer (Ultraviolet Absorbing Layer): | |
| Gelatin | 1.00 |
| Ultraviolet Absorbent (1/1/1 mixture of Cpd-2, 4, 8) | 0.50 |
| Color Mixing Preventing Agent (1/1 mixture of Cpd-6, 9) | 0.03 |
| Dispersing Medium (Cpd-5) | 0.02 |
| Ultraviolet Absorbent Solvent (1/1 mixture of Solv-2, 7) | 0.08 |
| Anti-irradiation Dye (10/10/13/15/20 of Cpd-10, 11, 12, 13, 18) | 0.05 |
| Fourteenth Layer (Protective Layer): | |
| Fine Silver Chlorobromide Grains (silver chloride 97 mol %; mean grain size 0.1 μm) | 0.03 as Ag |
| Acryl-modified Copolymer of Polyvinyl Alcohol | 0.01 |
| 1/1 Mixture of Polymethyl Methacrylate Grains (mean grain size 2.4 μm) and Silicon Dioxide (mean grain size 5 μm) | 0.05 |
| Gelatin | 1.80 |
| Gelatin Hardening Agent (1/1 mixture of H-1, H-2) | 0.18 |
| Fifteenth Layer (Backing Layer): | |
| Gelatin | 2.50 |
| Ultraviolet Absorbent (1/1/1 mixture of Cpd-2, 4, 8) | 0.50 |
| Dye (1/1/1/1/1 mixture of Cpd-10, 11, 12, 13, 18) | 0.06 |

-continued

| Sixteenth Layer Backing Protecting Layer): | |
|---|---|
| 1/1 Mixture of Polymethyl Methacrylate Grains (mean grain size 2.4 μm) and Silicon Oxide (mean grain size 5 μm) | 0.05 |
| Gelatin | 2.00 |
| Gelatin Hardening Agent (1/1 mixture of H-1, H-2) | 0.14 |

Emulsion EM-1 was prepared as described below.

An aqueous solution of potassium bromide and an aqueous solution of silver nitrate were simultaneously added to an aqueous gelatin solution with vigorous stirring at 75° C. over a period of 15 minutes, to obtain octahedral silver bromide grains having a mean grain size of 0.40 μm. To the emulsion were added 0.3 g per mole of the emulsion of 3,4-dimethyl-1,3-thiazoline-1-thione, 6 mg per mol of the emulsio of chloroauric acid (4-hydrate), in that order; and the entire mixture was heated at 75° C. for 80 minutes to effect chemical sensitization of the grains. The thus formed core grains were further grown under the same precipitation conditions as that employed for growing the cores. A monodispersed octahedral core/shell silver bromide emulsion having a mean grain size of 0.7 μm was obtained. The emulsion had a variation coefficient of grain size distribution of about 10%. To the emulsion were added 1.5 mg per mol of silver of sodium thiosulfate and 1.5 mg per mol of silver of chloroauric acid (4-hydrate); and the entire mixture was heated at 60° C. for 60 minutes to effect chemical sensitization of the emulsion. As a result, an internal latent image type silver halide emulsion was obtained.

Each of the light-sensitive layers described above contained $10^{-3}$% by weight to silver halide of ExZK-1 and $10^{-2}$% by weight to silver halide of ExZK-2, as nucleating agents, and $10^{-2}$% by weight to silver halide of Cpd-14 as a nucleation accelerating agent. In addition, the layers contained Alkanol XC (product by DuPont) and sodium alkylbenzenesulfonate, as emulsification and dispersion aids, and succinate and Magefac F-120 (product by Dai-Nippon Ink Co.), as coating aids. The layers containing silver halide and colloidal silver contained a stabilizer (mixture of Cpd-15, 16, 17).

The compounds used above are described below.

ExS-1

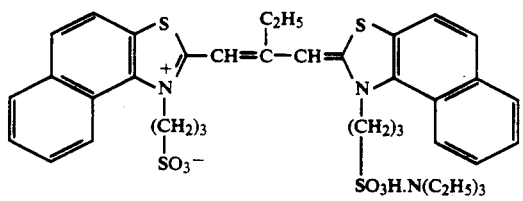

ExS-2

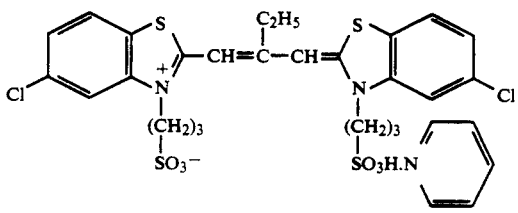

ExS-3

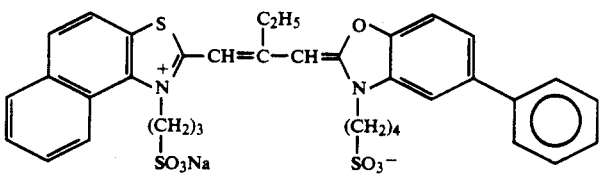

ExS-4

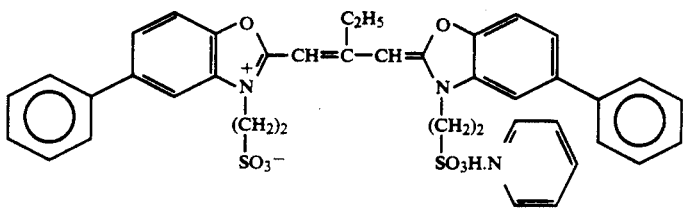

ExS-5

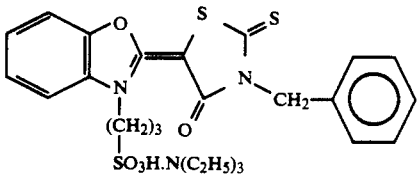

-continued
ExS-6
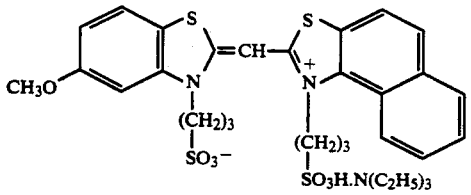
Cpd-1
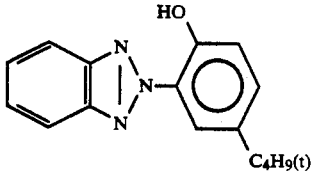
Cpd-2
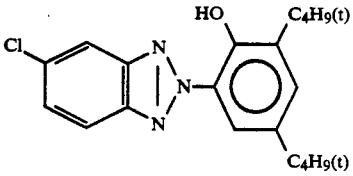
Cpd-3
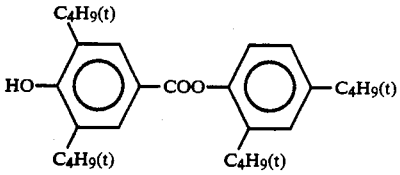
Cpd-4
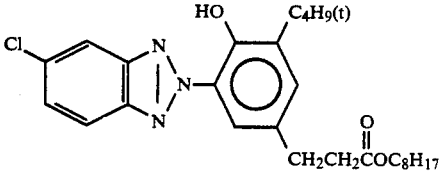
Cpd-5
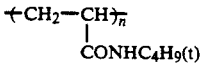
n = 100 ~ 1000
Cpd-6
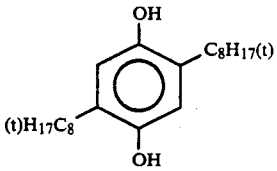
Cpd-7
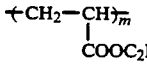
Cpd-8
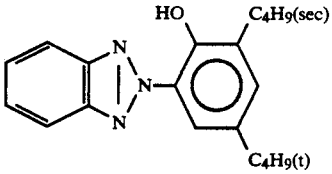
Cpd-9
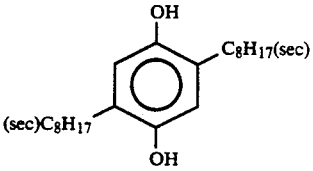

-continued
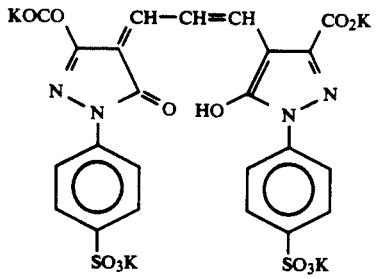
Cpd-10
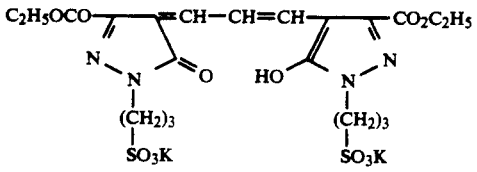
Cpd-11
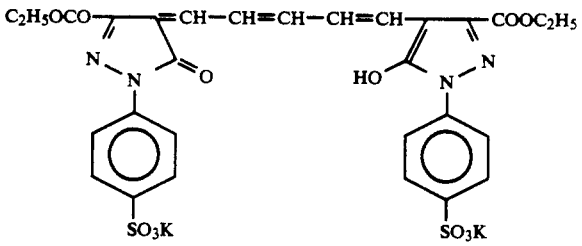
Cpd-12
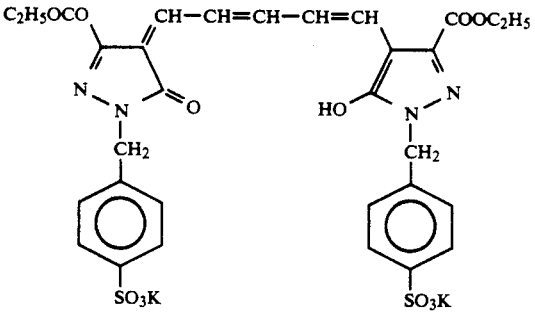
Cpd-13
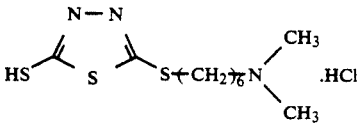
Cpd-14
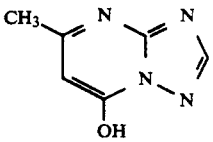
Cpd-15
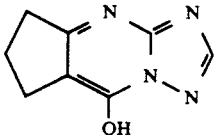
Cpd-16
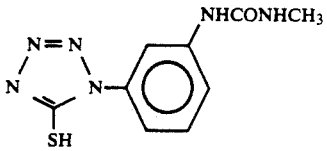
Cpd-17

-continued
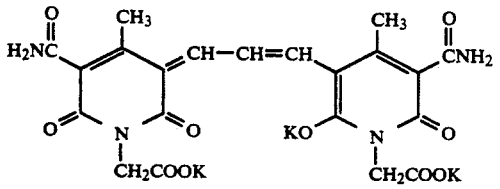
Cpd-18
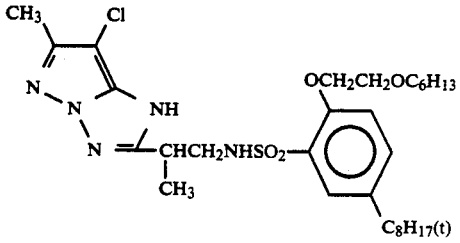
ExM-1
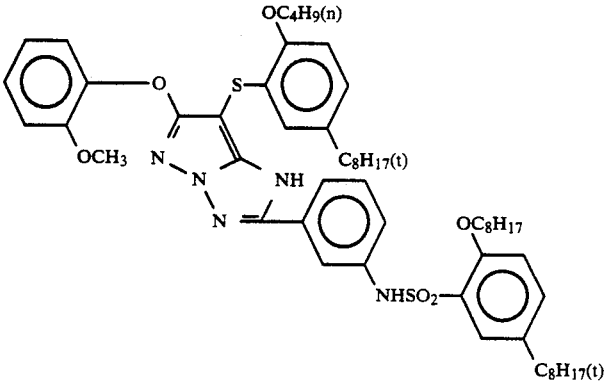
ExM-2
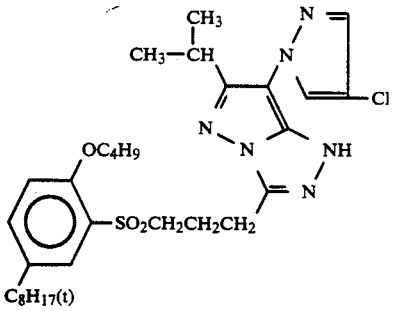
ExM-3
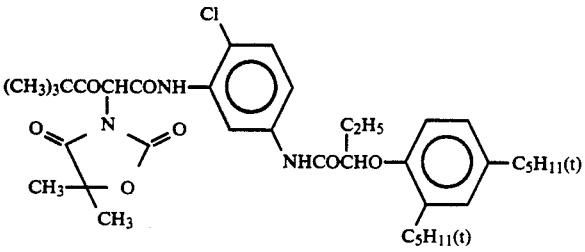
ExY-1

-continued

ExY-2

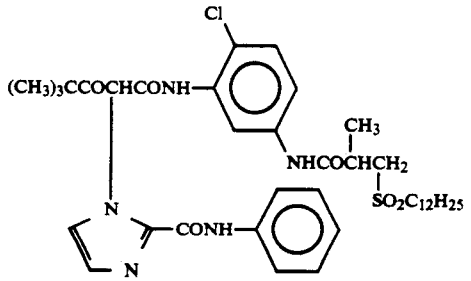

Solv-1: Di(2-ethylhexyl) Sebacate
Solv-2: Trinonyl Phosphate
Solv 3: Di(2-methylhexyl) Phthalate
Solv-4: Tricresyl Phosphate
Solv-5: Dibutyl Phthalate
Solv-6: Trioctyl Phosphate
Solv-7: Di(2-ethylhexyl) Phthalate
H-1: 1,2-Bis(vinylsulfonylacetamido)ethane
H-2: 4,6-Dichloro 2-hydroxy-1,3,5-triazine Sodium Salt
ExZK-1: 7-(3-Ethoxythiocarbonylaminobenzamido-9-methyl-10-propargyl-1,2,3,4-tetrahydroacridinium Trifluromethanesulfonate
ZK-2: 2-[4-{3-[3- {3-[5-{3-[2-Chloro-5-(1-dodecyloxycarbonylethoxycarbonyl)phenylcarbamoyl]-4-hydroxy-1-naphthylthio}tetrazol-1-yl]phenyl-}ureido]benzenesulfonamido}phenyl]-1-formylhydrazine The sample thus prepared was cut into a desired size and worked, and then wedgewise exposed through a B-G-R three-color separating filter disposed at the front of the wedge. Next, the sample was processed with an automatic developing machine in accordance with the processing method described below. Prior to processing the sample, other samples separately imagewise exposed were subjected to a running test with the same automatic developing machine and in accordance with the same processing method until the accumulated replenisher amount to the bleach-fixing bath reached three times the capacity of the tank.

Processing Method

| Step | Time | Temp. | Tank Capacity for Mother Solution | Amount of Replenisher |
|---|---|---|---|---|
| Color Development | 135 sec | 38° C. | 15 liters | 300 ml/m$^2$ |
| Bleach-fixing | 30 sec | 33° C. | 3 liters | 300 ml/m$^2$ |
| Rinsing (1) | 40 sec | 33° C. | 3 liters | — |
| Rinsing (2) | 40 sec | 33° C. | 3 liters | 320 ml/m$^2$ |
| Drying | 30 sec | 80° C. | | |

In the above method, rinsing was effected in accordance with a countercurrent replenishing system where the replenisher was added to the rinsing bath (2) and the overflow from the rinsing bath (2) was introduced into the rinsing bath (1). The carryover amount of the bleach-fixing solution from the bleach-fixing bath to the rinsing bath (1) was 35 ml/m2; and the ratio of the amount of the replenisher to the rinsing bath (2) to the carryover amount from the bleach-fixing bath was 9.1 times.

The compositions of the processing solutions used above are described below.

| | Mother Solution | Replenisher |
|---|---|---|
| Color Developer: | | |
| Ethylenediaminetetra-methylenephosphonic Acid | 1.5 g | 1.5 g |
| Diethylene Glycol | 10 ml | 10 m |
| Benzyl Alcohol | 12.0 ml | 14.4 m |
| Potassium Bromide | 0.70 g | — |
| Benzotriazole | 0.003 g | 0.004 |
| Sodium Sulfite | 2.4 g | 2.9 |
| Glucose | 2.5 g | 3.0 |
| N,N-bis(carboxymethyl)-hydrazine | 4.0 g | 4.8 g |
| Triethanolamine | 6.0 g | 7.2 g |
| N-methyl-N-(β-methanesulfonamidoethyl)-3-methyl-4-aminoaniline Sulfate | 6.0 g | 7.2 g |
| Potassium Carbonate | 30.0 g | 25.0 g |
| Brightening Agent (WHITEX-4, product by Sumitomo Chemical Co.) | 1.0 g | 1.2 g |
| Water to make | 1000 ml | 1000 ml |
| pH (25° C.) | 10.25 | 10.80 |
| Bleach-fixing Solution: | | |
| | Mother solution and replenisher were same. | |
| Fixing Agent (see Table 4) | | 0.9 mol |
| Ammonium Sulfite (Ammonium sulfite was used only when the fixing agent was ammonium thiosulfate.) | | 0.2 mol |
| Bleaching Agent (see Table 4) | | 0.18 mol |
| Chelating Agent (The same as that of the bleaching agent.) | | 0.01 mol |
| Ammonium Nitrate | | 10 g |
| Sodium P-toluenesulfinate | | 20 g |
| 5-Mercapto-1,3,4-triazole | | 0.5 g |
| Water to make | | 1000 ml |
| pH (25° C., as adjusted with acetic acid or ammonia) | | 6.20 |

Rinsing Water

Municipal water was passed through a mixed bed type column filled with an H-type strong acidic cation-exchange resin (Amberlite IR-120B, produced by Rhom & Haas Co.) and an OH-type strong basic anion-exchange resin (Amberlite IRA-400, produced by Rhom & Haas Co.), such that both the calcium ion concentration and the magnesium ion concentration in the water were each reduced to 3 mg/liter. Next, 20 mg/liter of sodium dichloroisocyanurate and 150 mg/liter of sodium sulfate were added to the resulting water, which had a pH value within the range of from 6.5 to 7.5.

The thus obtained solution was used as the rinsing water.

Evaluation of Desilvering Capacity

The white-exposed film as processed in the processing system after the running test was evaluated with respect to the amount of remaining silver by X-ray fluorescence.

Evaluation of Bleaching Fog

The image-exposed film sample processed just before completion of the running test was evaluated with respect to magenta minimum density (Dmin) by use of a photographic densitometer (FSD 103 Model, manufactured by Fuji Photo Film Co.).

Evaluation of Processing Solution Stability

After the running test, the bleach-fixing solution used was visually evaluated with respect to the presence or absence of solid precipitates. Evaluation of the test was made on the basis of the following criteria.

○: No precipitate formed.

Δ: Some precipitates formed.

x: Substantial precipitates formed.

Results of the tests are shown in Table 4 below.

TABLE 4

| No. | Bleaching Agent [Fe(III) Salt] | Fixing Agent | Amount of Remaining Silver ($\mu g/cm^2$) | Magenta (Dmin) | Precipitates in Bleach-fixing Solution | Remarks |
|---|---|---|---|---|---|---|
| 1 | EDTA | ATS | 10 | 0.15 | Δ | comparative sample |
| 2 | 1,3-PDTA | ATS | 3.0 | 0.25 | X | comparative sample |
| 3 | Compound 1 | ATS | 0.9 | 0.15 | X | comparative sample |
| 4 | Compound 21 | ATS | 1.0 | 0.15 | X | comparative sample |
| 5 | EDTA | A-1 | 9.2 | 0.17 | ○ | comparative sample |
| 6 | 1,3-PDTA | A-1 | 2.8 | 0.27 | ○ | comparative sample |
| 7 | Compound 1 | A-1 | 0.5 | 0.08 | ○ | sample of the invention |
| 8 | Compound 21 | A-1 | 0.7 | 0.09 | ○ | sample of the invention |
| 9 | EDTA | B-4 | 9.0 | 0.18 | ○ | comparative sample |
| 10 | 1,3-PDTA | B-4 | 2.7 | 0.28 | ○ | comparative sample |
| 11 | Compound 1 | B-4 | 0.5 | 0.08 | ○ | sample of the invention |
| 12 | Compound 25 | B-4 | 0.1 | 0.09 | ○ | sample of the invention |

ATS: Ammonium Thiosulfate

As clearly seen from the results in Table 4 above, the present invention provided good results with respect to each of desilverability, prevention of bleaching fog, and stability of the bleach-fixing solution.

EXAMPLE 10

The same tests as in Example 9 were carried out, except that the bleaching agent in No. 11 was separately replaced by the Fe(III) salts of Compounds 2, 3, 5, 12, 25, 28, 35, 36 and 39, in an equimolar amount. Like Example 9, the same good results were also obtained.

EXAMPLE 11

The same tests as in Example 9 were carried out, except that the fixing agent in No. 11 was separately replaced by A-4, A-6, A-10, A-12, B-1, B-3, C-2, C-5 and C-6. Like Example 9, the same good results were also obtained.

EXAMPLE 12

Plural layers each having the composition described below were coated over a cellulose triacetate film support (thickness: 127 μm) having a subbing layer, to prepare a multi-layer color photographic material sample No. 501. The number for each component indicates the coverage of the component in units of $g/m^2$. The coverage of silver halides and colloidal silver is given in terms of $g/m^2$ of silver. The effect of each constituent compound for preparing the sample is not limited to the particular effect indicated below.

| | |
|---|---|
| First Layer (Anti-halation Layer): | |
| Black Colloidal Silver | 0.25 g |
| Gelatin | 1.9 g |
| Ultraviolet Absorbent U-1 | 0.04 g |
| Ultraviolet Absorbent U-2 | 0.1 g |
| Ultraviolet Absorbent U-3 | 0.1 g |
| Ultraviolet Absorbent U-4 | 0.1 g |
| Ultraviolet Absorbent U-6 | 0.1 g |
| High Boiling Point Organic Solvent Oil-1 | 0.1 g |
| Second Layer (Interlayer): | |
| Gelatin | 0.40 g |
| Compound Cpd-D | 10 mg |
| High Boiling Point Organic Solvent Oil-3 | 0.1 mg |
| Dye D-4 | 0.4 mg |
| Third Layer (Interlayer): | |
| Surface and inside-fogged Fine Silver Iodobromide Emulsion (mean grain size 0.06 μm; variation coefficient 18%; AgI content 1 mol %) | 0.05 g as Ag |
| Gelatin | 0.4 g |
| Fourth Layer (Low-sensitivity Red-sensitive Emulsion Layer): | |
| Emulsion A | 0.2 g as Ag |
| Emulsion B | 0.3 g as Ag |
| Gelatin | 0.8 g |
| Coupler C-1 | 0.15 g |
| Coupler C-2 | 0.05 g |
| Coupler C-9 | 0.05 g |
| Compound Cpd-D | 10 mg |
| High Boiling Point Organic Solvent Oil-2 | 0.1 g |
| Fifth Layer (Middle-sensitivity Red-sensitive Emulsion Layer): | |
| Emulsion B | 0.2 g as Ag |
| Emulsion C | 0.3 g as Ag |
| Gelatin | 0.8 g |
| Coupler C-1 | 0.2 g |
| Coupler C-2 | 0.05 g |
| Coupler C-3 | 0.2 g |
| High Boiling Point Organic Solvent Oil-2 | 0.1 g |
| Sixth Layer (High-sensitivity Red-sensitive Emulsion Layer): | |
| Emulsion D | 0.4 g as Ag |
| Gelatin | 1.1 g |
| Coupler C-1 | 0.3 g |
| Coupler C-3 | 0.7 g |
| Additive P-1 | 0.1 g |
| Seventh Layer (Interlayer): | |
| Gelatin | 0.6 g |
| Additive M-1 | 0.3 g |
| Color Mixing Preventing Agent Cpd-K | 2.6 mg |
| Ultraviolet Absorbent U-1 | 0.1 g |
| Ultraviolet Absorbent U-6 | 0.1 g |
| Dye D-1 | 0.02 g |
| Eighth Layer (Interlayer): | |
| Surface and Inside-fogged Silver Iodobromide Emulsion (mean grain | 0.02 g as Ag |

-continued

| | |
|---|---|
| size 0.06 μm; variation coefficient 16%; AgI content 0.3 mol %) | |
| Gelatin | 1.0 g |
| Additive P-1 | 0.2 g |
| Color Mixing Preventing Agent Cpd-J | 0.1 g |
| Color Mixing Preventing Agent Cpd-A | 0.1 g |
| Ninth Layer (Low-sensitivity Green sensitive Emulsion Layer): | |
| Emulsion E | 0.3 g as Ag |
| Emulsion F | 0.1 g as Ag |
| Emulsion G | 0.1 g as Ag |
| Gelatin | 0.5 g |
| Coupler C-7 | 0.05 g |
| Coupler C-8 | 0.20 g |
| Compound Cpd-B | 0.03 g |
| Compound Cpd-D | 10 mg |
| Compound Cpd-E | 0.02 g |
| Compound Cpd-F | 0.02 g |
| Compound Cpd-G | 0.02 g |
| Compound Cpd-H | 0.02 g |
| High Boiling Point Organic Solvent Oil-1 | 0.1 g |
| High Boiling Point Organic Solvent Oil-2 | 0.1 g |
| Tenth Layer (Middle-sensitivity Green-sensitive Emulsion Layer): | |
| Emulsion G | 0.3 g as Ag |
| Emulsion H | 0.1 g as Ag |
| Gelatin | 0.6 g |
| Coupler C-7 | 0.2 g |
| Coupler C-8 | 0.1 g |
| Compound Cpd-B | 0.03 g |
| Compound Cpd-E | 0.02 g |
| Compound Cpd-F | 0.02 g |
| Compound Cpd-G | 0.05 g |
| Compound Cpd-H | 0.05 g |
| High Boiling Point Organic Solvent Oil-2 | 0.01 g |
| Eleventh Layer (High-sensitivity Green-sensitive Emulsion Layer): | |
| Emulsion I | 0.5 g as Ag |
| Gelatin | 1.0 g |
| Coupler C-4 | 0.3 g |
| Coupler C-8 | 0.1 g |
| Compound Cpd-B | 0.08 g |
| Compound Cpd-E | 0.02 g |
| Compound Cpd-F | 0.02 g |
| Compound Cpd-G | 0.02 g |
| Compound Cpd-H | 0.02 g |
| High Boiling Point Organic Solvent Oil-1 | 0.02 g |
| High Boiling Point Organic Solvent Oil-2 | 0.02 g |
| Twelfth Layer (Interlayer): | |
| Gelatin | 0.6 g |
| Dye D-1 | 0.1 g |
| Dye D-2 | 0.05 g |
| Dye D-3 | 0.07 g |
| Thirteenth Layer (Yellow Filter Layer): | |
| Yellow Colloidal Silver | 0.1 g as Ag |
| Gelatin | 1.1 g |
| Color Mixing Preventing Agent Cpd-A | 0.01 g |
| High Boiling Point Organic Solvent Oil-2 | 0.01 g |
| Fourteenth Layer (Interlayer): | |
| Gelatin | 0.6 g |
| Fifteenth Layer (Low-sensitivity Blue-sensitive Emulsion Layer): | |
| Emulsion J | 0.4 g as Ag |
| Emulsion K | 0.1 g as Ag |
| Emulsion L | 0.1 g as Ag |
| Gelatin | 0.8 g |
| Coupler C-5 | 0.6 g |
| Sixteenth Layer (Middle-sensitivity Blue-sensitive Emulsion Layer): | |
| Emulsion L | 0.1 g as Ag |
| Emulsion M | 0.4 g as Ag |
| Gelatin | 0.9 g |
| Coupler C-5 | 0.3 g |
| Coupler C-6 | 0.3 g |

-continued

| | |
|---|---|
| Seventeenth Layer (High-sensitivity Blue-sensitive Emulsion Layer): | |
| Emulsion N | 0.4 g as Ag |
| Gelatin | 1.2 g |
| Coupler C-8 | 0.7 g |
| Eighteenth Layer (First Protective Layer): | |
| Gelatin | 0.7 g |
| Ultraviolet Absorbent U-1 | 0.04 g |
| Ultraviolet Absorbent U-2 | 0.01 g |
| Ultraviolet Absorbent U-3 | 0.03 g |
| Ultraviolet Absorbent U-4 | 0.03 g |
| Ultraviolet Absorbent U-5 | 0.05 g |
| Ultraviolet Absorbent U-6 | 0.05 g |
| High Boiling Point Organic Solvent Oil-1 | 0.02 g |
| Formalin Scavenger Cpd-C | 0.2 g |
| Formalin Scavenger Cpd-I | 0.4 g |
| Dye D-3 | 0.05 g |
| Nineteenth Layer (Second Protective Layer): | |
| Colloidal Silver | 0.1 mg as Ag |
| Emulsion of Fine Silver Iodobromide Grains (mean grain size 0.06 μm; AgI content 1 mol %) | 0.1 g as Ag |
| Gelatin | 0.4 g |
| Twentieth Layer (Third Protective Layer): | |
| Gelatin | 0.4 g |
| Polymethyl Methacrylate (mean grain size 1.5 μm) | 0.1 g |
| 4/6 Copolymer of Methyl Methacrylate and Acrylic Acid (mean grain size 1.5 μm) | 0.1 g |
| Silicone Oil | 0.03 g |
| Surfactant W-1 | 3.0 g |
| Surfactant W-2 | 0.03 g |

Additives F-1, F-2, F-3, F-4, F-5, F-6, F-7 and F-8 were added, in addition to the above-described components, to all of the emulsion layers. Gelatin hardening agent H-1 and coating and emulsifying surfactants W-3 and W-4 were added, in addition to the above-described components, to all of the constituent layers.

Further, as antiseptic and fungicidal components, phenol, 1,2-benzisothiazolin-3-one, 2-phenoxyethanol and phenethyl alcohol were added.

The silver iodobromide emulsions used in preparing sample No. 501 are described below.

| Emulsion | Characteristic of Grains | Mean Grain Size (μm) | Variation Coefficient (%) | AgI Content (%) |
|---|---|---|---|---|
| A | Monodispersed tetradecahedral grains | 0.25 | 16 | 3.7 |
| B | Monodispersed cubic internal latent image type grains | 0.30 | 10 | 3.3 |
| C | Monodispersed tetradecahedral grains | 0.30 | 18 | 5.0 |
| D | Polydispersed twin plane grains | 0.60 | 25 | 2.0 |
| E | Monodispersed cubic grains | 0.17 | 17 | 4.0 |
| F | Monodispersed cubic grains | 0.20 | 16 | 4.0 |
| G | Monodispersed cubic internal latent image type grains | 0.25 | 11 | 3.5 |
| H | Monodispersed cubic internal latent image type grains | 0.30 | 9 | 3.5 |
| I | Polydispersed tabular grains (mean aspect ratio 4.0) | 0.80 | 28 | 1.5 |
| J | Monodispersed tetradecahedral grains | 0.30 | 18 | 4.0 |
| K | Monodispersed tetradecahedral grains | 0.37 | 17 | 4.0 |
| L | Monodispersed cubic internal latent image type grains | 0.46 | 14 | 3.5 |
| M | Monodispersed cubic grains | 0.55 | 13 | 4.0 |
| N | Polydispersed tabular grains | 1.00 | 33 | 1.3 |

-continued (mean aspect ratio 7.0)

Emulsions A to N were color-sensitized in the manner described below.

| Emulsion | Sensitizing Dyes Added | Amount (g) of Dye Added per mol of Silver Halide | Time of Adding Dyes |
|---|---|---|---|
| A | S-9 | 0.025 | Just after chemical sensitization |
| | S-2 | 0.25 | Just after chemical sensitization |
| B | S-1 | 0.01 | Just after formation of grains |
| | S-2 | 0.25 | Just after formation of grains |
| C | S-1 | 0.02 | Just after chemical sensitization |
| | S-2 | 0.25 | Just after chemical sensitization |
| D | S-1 | 0.01 | Just after chemical sensitization |
| | S-2 | 0.10 | Just after chemical sensitization |
| | S-7 | 0.01 | Just after chemical sensitization |
| E | S-3 | 0.5 | Just after chemical sensitization |
| | S-4 | 0.1 | Just after chemical sensitization |
| F | S-3 | 0.3 | Just after chemical sensitization |
| | S-4 | 0.1 | Just after chemical sensitization |
| G | S-3 | 0.25 | Just after formation of grains |

-continued

| | | | |
|---|---|---|---|
| | S-4 | 0.08 | Just after formation of grains |
| H | S-3 | 0.2 | During formation of grains |
| | S-4 | 0.06 | During formation of grains |
| I | S-3 | 0.3 | Just before initiation of chemical sensitization |
| | S-4 | 0.07 | Just before initiation of chemical sensitization |
| | S-8 | 0.1 | Just before initiation of chemical sensitization |
| J | S-6 | 0.2 | During formation of grains |
| | S-5 | 0.05 | During formation of grains |
| K | S-6 | 0.2 | During formation of grains |
| | S-5 | 0.05 | During formation of grains |
| L | S-6 | 0.22 | Just after formation of grains |
| | S-5 | 0.06 | Just after formation of grains |
| M | S-6 | 0.15 | Just after chemical sensitization |
| | S-5 | 0.04 | Just after chemical sensitization |
| N | S-6 | 0.22 | Just after formation of grains |
| | S-5 | 0.06 | Just after formation of grains |

The compounds used above for preparing sample No. 501 are described below.

C-1

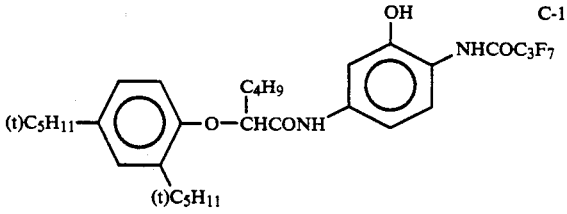

C-2

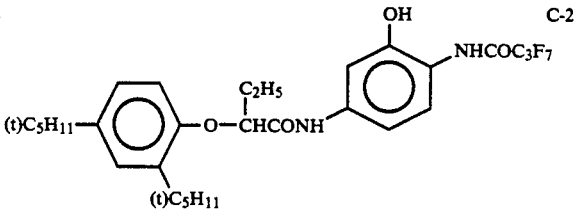

C-3

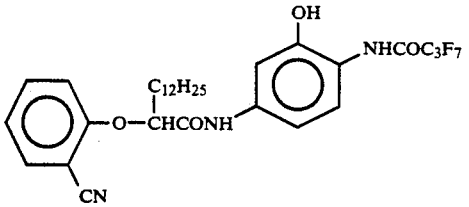

C-4

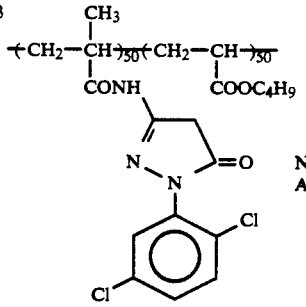

Numerals are % by weight
Average Molecular Weight: about 25,000

C-5

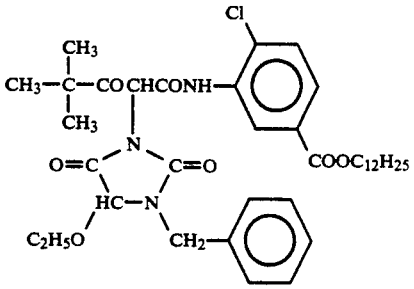

C-6

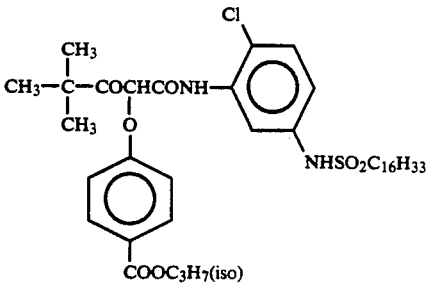

-continued
C-7
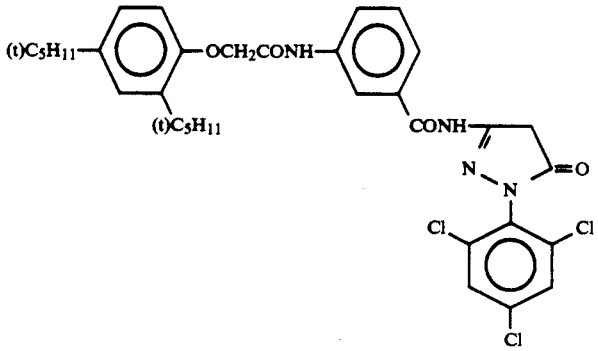
C-8
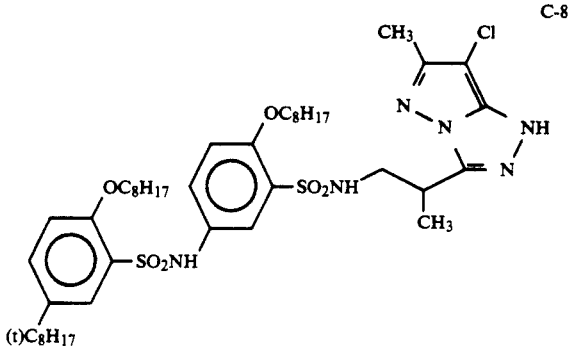
C-9
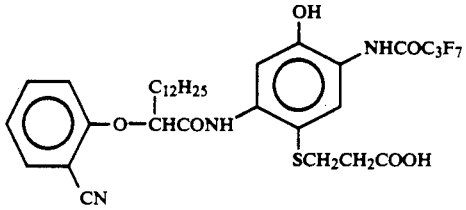
Dibutyl phthalate Oil-1
Tricresyl phosphate Oil-2
Oil-3
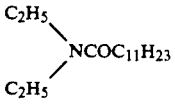
Cpd-A
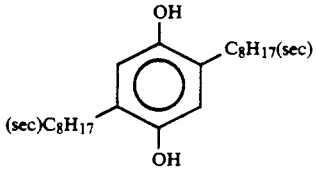
Cpd-B
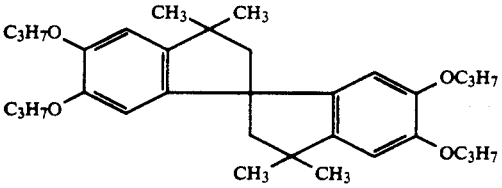
Cpd-C
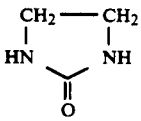
Cpd-D
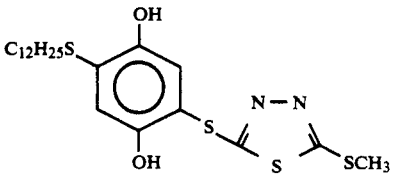
Cpd-E
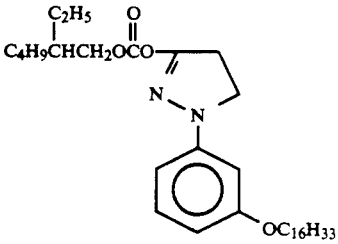

-continued
Cpd-F
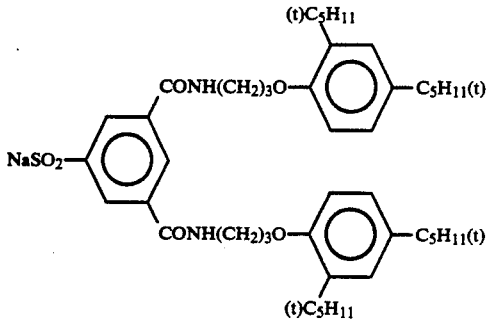
Cpd-G
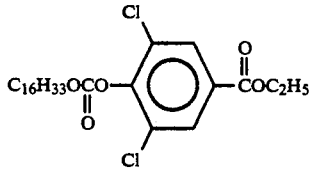
Cpd-H
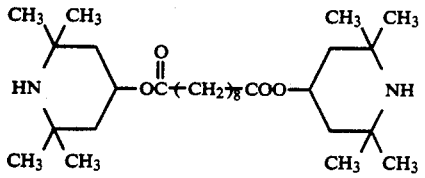
Cpd-I
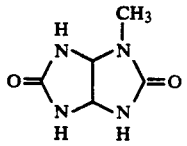
Cpd-J
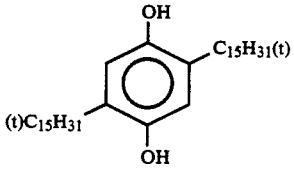
Cpd-K
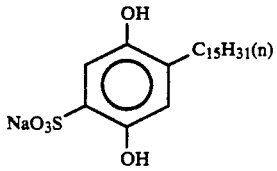
U-1
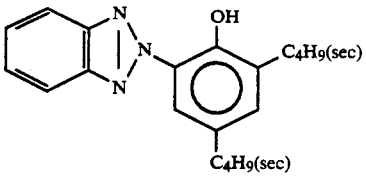
U-2
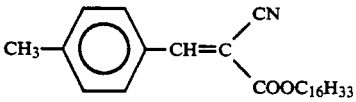
U-3
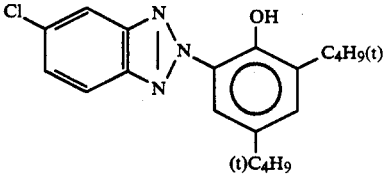
U-4
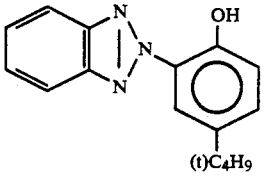
U-5
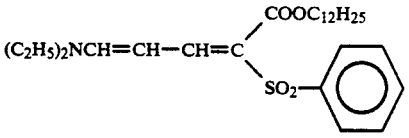
U-6
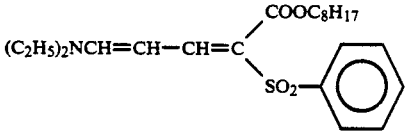
S-1
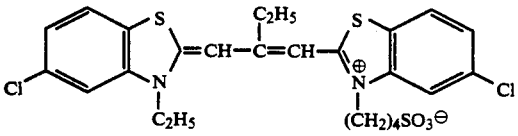
S-2
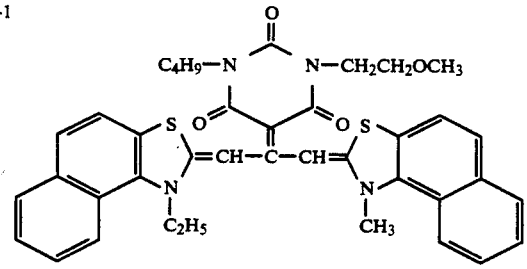
S-3
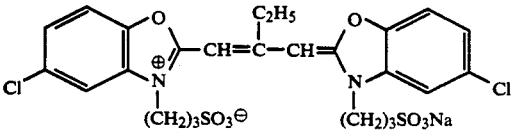
S-4
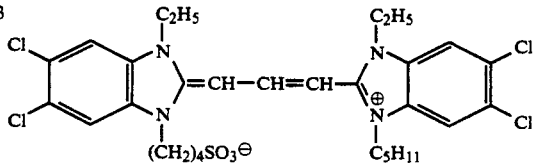

-continued
S-5
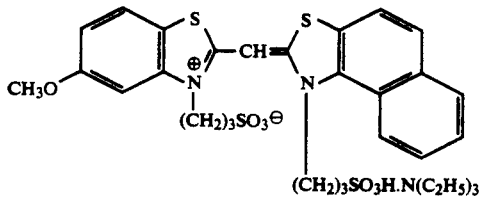
S-6
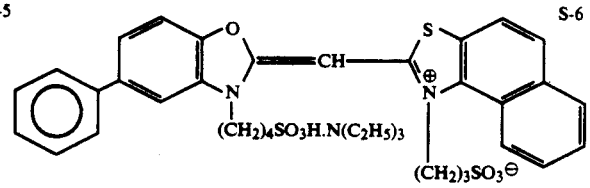
S-7
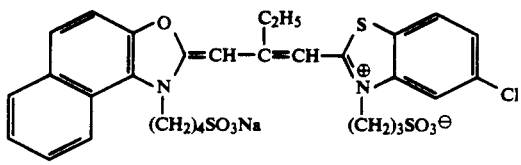
S-8
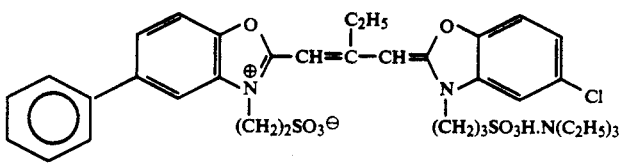
D-1
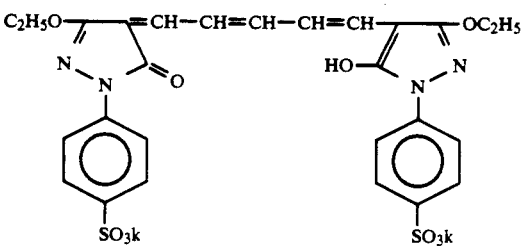
D-2
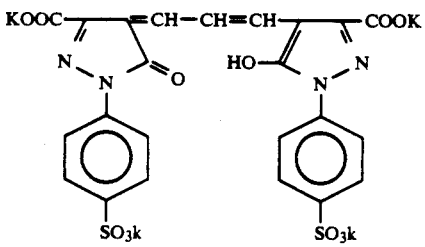
D-3
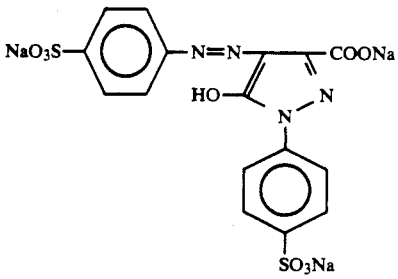
D-4
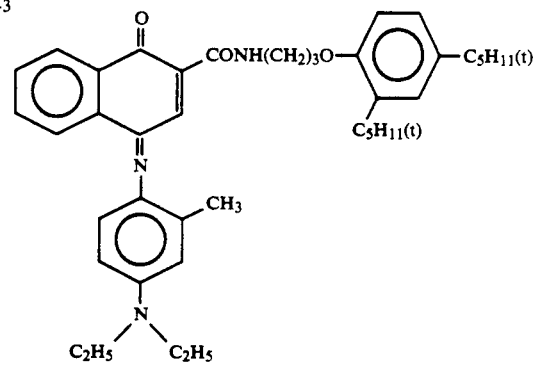
H-1
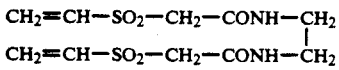
W-1
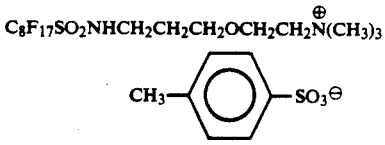
W-2
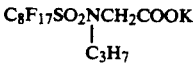
W-3
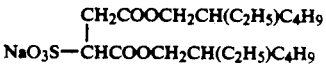
W-4
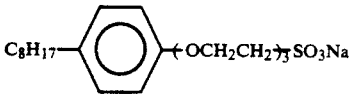
P-1
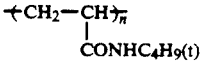

-continued

M-1

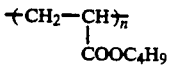

F-1

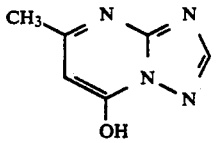

F-2

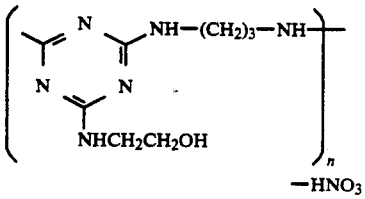

F-3

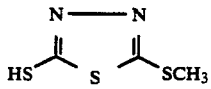

F-4

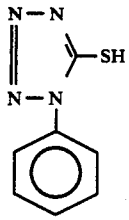

F-5

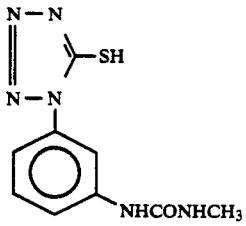

F-6

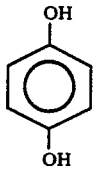

F-7

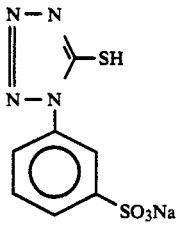

F-8

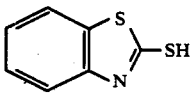

The photographic material sample thus prepared was cut into a desired size and imagewise exposed. The sample was then subjected to a running test of processing with a cinematographic automatic developing machine in accordance with the processing procedure described below until the amount of the replenisher to the bleaching tank reached two times of the capacity of the tank. Apart from this, the sample was exposed to a white light, and then processed in the same manner and with the same processing system following the running test.

Processing Steps

| Step | Time (min) | Temp. (°C.) | Amount of Replenisher (*) (liter) | Tank Capacity (liter) |
|---|---|---|---|---|
| Black-and-white Development | 6 | 38 | 1.5 | 12 |
| First Rinsing | 1 | 38 | 7.5 | 4 |
| Reversal | 1 | 38 | 1.1 | 4 |
| Color Development | 4 | 38 | 2.0 | 12 |
| Compensation | 2 | 38 | 1.1 | 4 |
| Bleaching | 3 | 38 | 1.3 | 12 |
| Fixation | 2 | 38 | 1.3 | 12 |
| Second Rinsing (1) | 1 | 38 | — | 4 |
| Second Rinsing (2) | 1 | 38 | 7.5 | 4 |
| Stabilization | 1 | 38 | 1.1 | 4 |
| Drying | 2 | 50 | | |

(*) This is an amount of the replenisher per $m^2$ of the photographic material sample being processed.

The overflow from the second rinsing tank (2) was recirculated to the second rinsing tank (1).

The compositions of the processing solutions used above are described below.

| | Starting Solution | Replenisher |
|---|---|---|
| Black-and-White Developer | | |
| Pentasodium Nitrilo-N,N,N-trimethylenephosphonate | 2.0 g | 2.0 g |
| Pentasodium Diethylenetriaminepentaacetate | 3.0 g | 3.0 g |
| Potassium Sulfite | 30 g | 30 g |
| Hydroquinone/Potassium monosulfonate | 20 g | 20 g |
| Potassium Carbonate | 33 g | 33 g |
| 1-Phenyl-4-methyl-4-hydroxymethyl-3-pyrazolidone | 2.0 g | 2.0 g |
| Potassium Bromide | 2.5 g | 0.9 g |
| Potassium Thiocyanate | 1.2 g | 1.2 g |

-continued

| | Starting Solution | Replenisher |
|---|---|---|
| Potassium Iodide | 2.0 mg | 2.0 mg |
| Water to make | 1.0 liter | 1.0 liter |
| pH (25° C., as adjusted with hydrochloric acid or potassium hydroxide) | 9.60 | 9.70 |

Reversal Solution:

| | (Starting solution and replenisher were the same.) |
|---|---|
| Pentasodium Nitrilo-N,N,N-trimethylene-phosphonate | 2.0 g |
| Stannous Chloride 2-Hydrate | 1.0 g |
| P-aminophenol | 0.1 g |
| Sodium Hydroxide | 8.0 g |
| Glacial Acetic Acid | 1.5 ml |
| Water to make | 1.0 liter |
| Ammonium Sulfite | 20 g |
| pH (25° C., as adjusted with acetic acid or aqueous ammonia) | 6.60 |

Color Developer:

| | | |
|---|---|---|
| Pentasodium Nitrilo-N,N,N-trimethylenephosphonate | 2.0 g | 2.0 g |
| Pentasodium Diethylenetri-aminepentaacetate | 2.0 g | 2.0 g |
| Sodium Sulfite | 7.0 g | 7.0 g |
| Tripotassium Phosphate 12-Hydrate | 36 g | 36 g |
| Potassium Bromide | 1.0 g | — |
| Potassium Iodide | 90 mg | — |
| Sodium Hydroxide | 3.0 g | 3.0 g |
| Citrazinic Acid | 1.5 g | 1.5 g |
| N-ethyl-N-(β-methanesulfon-amidoethyl)-3-methyl-4-amino-aniline Sulfate | 10.5 g | 10.5 g |
| 3.6-Dithiaoctane-1,8-diol | 3.5 | 3.5 |
| Water to make | 1.0 liter | 1.0 liter |
| pH (25° C., as adjusted with hydrochloric acid or potassium hydroxide) | 11.90 | 12.05 |

Compensating Solution:

| | (Starting solution and replenisher were the same.) |
|---|---|
| Disodium Ethylenediaminetetra-acetate 2-Hydrate | 8.0 g |
| Sodium Sulfite | 12 g |
| 2-Mercapto-1,3,4-triazole | 0.5 g |
| pH (25° C., as adjusted with hydrochloric acid or potassium hydroxide) | 6.00 |

Bleaching Solution:

| | (Starting solution and replenisher were the same.) |
|---|---|
| Bleaching Agent (see Table 5) | 0.3 mol |
| Chelating Agent (The same as that of the bleaching agent.) | 0.01 mol |
| Ammonium Bromide | 120 g |
| Ammonium Nitrate | 25 g |
| Hydroxyacetic Acid | 40 g |
| Acetic Acid | 30 g |
| Water to make | 1 liter |
| pH (as adjusted with aqueous ammonia or acetic acid) | 4.2 |

-continued

| | Starting Solution | Replenisher |
|---|---|---|
| Fixing Solution: | | |
| | (Starting solution and replenisher were the same.) | |
| Fixing Agent (see Table 5) | 1.2 mol | |
| Sodium Bisulfite (Sodium bisulfite was used only when the fixing agent was ammonium thiosulfate.) | 15 g | |
| Imidazole | 17 g | |
| Ethylenediaminetetraacetic Acid | 13 g | |
| Water to make | 1 liter | |
| pH (as adjusted with aqueous ammonia or acetic acid) | 6.0 | |

Stabilizing Solution

The same as that used in Example 4.

Evaluation of Desilvering Capacity

The white-exposed film as processed in the processing system following the running test was evaluated with respect to the amount of remaining silver by X-ray fluorescence.

Evaluation of Bleaching Fog

The image-exposed film sample processed just before completion of the running test was evaluated with respect to magenta minimum density (Dmin) by use of a photographic densitometer (FSD 103 Model, manufactured by Fuji Photo Film Co.).

Evaluation of Processing Solution Stability

After the running test, the bleach-fixing solution used was visually evaluated with respect to the presence or absence of solid precipitates. Evaluation of the test was made on the basis of the following criteria.

○: No precipitate formed.

Δ: Some precipitates formed.

x: Substantial precipitates formed.

Results of the tests are shown in Table 5 below.

TABLE 5

| No. | Bleaching Agent [Fe(III) Salt] | Fixing Agent | Amount of Remaining Silver (μg/cm²) | Magenta (Dmin) | Precipitates in Bleach-fixing Solution | Remarks |
|---|---|---|---|---|---|---|
| 1 | EDTA | ATS | 110 | 0.12 | Δ | comparative sample |
| 2 | 1,3-PDTA | ATS | 18.0 | 0.26 | X | comparative sample |
| 3 | Compound 1 | ATS | 15.0 | 0.12 | X | comparative sample |
| 4 | Compound 21 | ATS | 15.5 | 0.13 | X | comparative sample |
| 5 | EDTA | A-1 | 92.0 | 0.14 | ○ | comparative sample |
| 6 | 1,3-PDTA | A-1 | 16.0 | 0.28 | ○ | comparative sample |
| 7 | Compound 1 | A-1 | 1.0 | 0.07 | ○ | sample of the invention |
| 8 | Compound 21 | A-1 | 1.2 | 0.07 | ○ | sample of the invention |
| 9 | EDTA | B-4 | 95.0 | 0.13 | ○ | comparative sample |
| 10 | 1,3-PDTA | B-4 | 16.5 | 0.27 | ○ | comparative sample |
| 11 | Compound 1 | B-4 | 1.0 | 0.06 | ○ | sample of the invention |
| 12 | Compound 21 | B-4 | 1.1 | 0.07 | ○ | sample of the invention |

As clearly seen from the results in Table 5 above, the present invention provided good results with respect to each of desilverability, prevention of bleaching fog, and stability of bleach-fixing solution used.

EXAMPLE 13

The same tests as in Example 12 were carried out, except that the bleaching agent in No. 11 was separately replaced by the Fe(III) salts of Compounds 2, 5, 6, 12, 26, 27, 28 and 35, in an equimolar amount. Like Example 12, the same good results were also obtained.

EXAMPLE 14

The same tests as in Example 12 were carried out, except that the fixing agent in No. 11 was separately replaced by A-4, A 6, A-10, A-12, A-13, B-1, B-3, C-2 and C-6. Like Example 12, the same good results were also obtained.

Silver halide color photographic materials processed in accordance with the method of the present invention have good desilverability, and the processed materials have little bleaching fog. In addition, the stability of the fixing solution for use in accordance with the method of the present invention is markedly improved, such that formation of precipitates in the used fixing solution is considerably reduced.

While the invention has been described in detail and with reference to specific embodiments thereof it will be apparent to one skilled in the art that various changes and modifications can be made therein without departing from the spirit and scope thereof.

What is claimed is:

1. A method of processing an imagewise exposed silver halide color photographic material comprising a support having thereon at least one light-sensitive silver halide emulsion layer, comprising the steps of developing in a developing bath, bleaching in a bath having a bleaching ability and fixing in a bath having a fixing ability, wherein the bath having a bleaching ability contains at least one metal chelate compound of any of compounds represented by formulae (VI), (VII), (VIII), (IX), (X), (XI), (XIV), (XV) and (XVI) and the bath having a fixing ability contains at least one compound selected from the group consisting of compounds represented by formulae (A), (B) and (C):

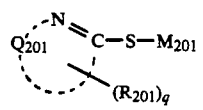

(A)

where $Q_{201}$ represents an atomic group necessary for forming a 5-membered or 6-membered hetero ring, which ring may be condensed with one or more carbon-aromatic rings or hetero-aromatic rings;

$R_{201}$ represents an alkyl, alkenyl, aralkyl, aryl or heterocyclic group substituted by at least one substituent selected from the group consisting of a carboxylic acid group or salt thereof, a sulfonic acid group or salt thereof, a sulfonic acid group or salt thereof, a phosphoric acid group or salt thereof, an amino group and an ammonium salt, or $R_{201}$ represents a carboxylic acid group or salt thereof, a sulfonic acid group or salt thereof, a phosphoric acid group or salt thereof, an amino group or an ammonium salt directly bonded to $Q_{201}$;

q represents an integer of from 1 to 3; and $M_{201}$ represents a cationic group;

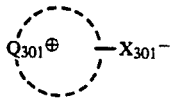

(B)

where $Q_{301}$ represents a 5-membered or 6-membered mesoionic ring composed of carbon, nitrogen, oxygen, sulfur and/or selenium atoms;

$X_{301}^-$ represents $—O^-$, $—S^-$, or $—N^-R_{301}$; and $R_{301}$ represents an alkyl group, a cycloalkyl group, an alkenyl group, an alkynyl group, an aralkyl group, an aryl group, or a heterocyclic group;

$$L_{401}-(A_{401}-L_{402})_r-A_{402}-L_{403} \quad (C)$$

where $L_{401}$ and $L_{403}$ may be same or different and each represents an alkyl group, an aryl group, an aralkyl group, an alkenyl group, or a heterocyclic group;

$L_{402}$ represents an alkylene group, an arylene group, an aralkylene group, a heterocyclic linking group, or a linking group comprising a combination of these groups;

$A_{401}$ and $A_{402}$ may be same or different and each represents —S—, —O—, $—NR_{420}—$, —CO—, —CS—, $—SO_2—$, or a group comprising a combination of these groups;

r represents an integer of from 1 to 10;

provided that at least one of $L_{401}$ and $L_{403}$ must be substituted by $—SO_3M_{401}$, $—PO_3M_{402}M_{403}$, $—NR_{401}(R_{402})$, $N^+R_{403}(R_{404})—(R_{405}).X_{401}^-$, $—SO_2NR_{406}(R_{407})$, $—NR_{408}SO_2R_{409}$, $—CONR_{410}(R_{411})$, $—NR_{412}COR_{413}$, $—SO_2R_{414}$, $—PO(—NR_{415}(R_{416}))_2$, $—NR_{417}CONR_{418}—(R_{419})$, $—COOM_{404}$ or a heterocyclic group;

$M_{401}$, $M_{402}$, $M_{403}$ and $M_{404}$ may be same or different and each represents a hydrogen atom or a pair cation;

$R_{401}$ to $R_{420}$ may be same or different and each represents a hydrogen atom, an alkyl group, an aryl group, an aralkyl group, or an alkenyl group; and $X_{401}^-$ represents a pair anion;

provided that at least one of $A_{401}$ and $A_{402}$ must be —S—;

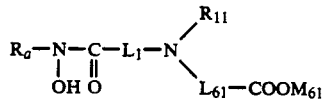

(VI)

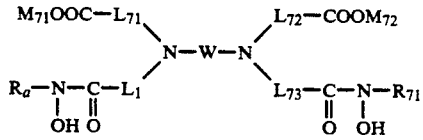

(VII)

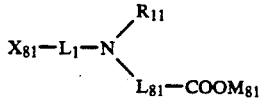

(VIII)

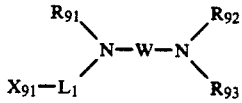

(IX)

where $R_{11}$, $R_{91}$, $R_{92}$ and $R_{93}$ each represents a hydrogen atom, an aliphatic group, an aromatic group, or a heterocyclic group;

$R_a$ and $R_{71}$ each represents a hydrogen atom, an aliphatic group, an aromatic group, or a heterocyclic group;

$L_1$, $L_{67}$, $L_{71}$, $L_{72}$, $L_{73}$ and $L_{81}$ each represents a divalent linking group containing an aliphatic group, an aromatic group, a heterocyclic group or a group comprising a combination of these groups;

$M_{61}$, $M_{71}$, $M_{72}$ and $M_{81}$ each are a hydrogen atom or a cation;

$X_{81}$ and $X_{91}$ each are $—SO_2NR_c(R_d)$ or $—NR_3—SO_2R_f$, in which $R_c$, $R_d$ and $R_e$ may be the same or different and each represents a hydrogen atom, an aliphatic group, an aromatic group, or a heterocyclic group, and $R_f$ is an aliphatic group, an aromatic group, or a heterocyclic group;

$R_{91}$, $R_{92}$, $R_{93}$ and $X_{91}—L_1$ may be the same or different from one another, and at least one of $R_{91}$, $R_{92}$ and $R_{93}$ is $L_{x1}—COOM^{x1}$ or $L_{x2}—X_{92}$;

$L_{x1}$ and $L_{x2}$ each represents a divalent linking group containing an aliphatic group, an aromatic group, a heterocyclic group or a group comprising a combination of these groups;

$X_{92}$ has the same meaning as $X_{91}$;

$M^{x1}$ is a hydrogen atom or a cation; and

W represents a divalent linking group;

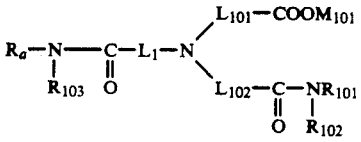

(X)

where $R_a$, $R_{101}$, $R_{102}$ and $R_{103}$ each represents a hydrogen atom, an aliphatic group, an aromatic group, or a heterocyclic group;

$L_1$, $L_{101}$ and $L_{102}$ each represents a divalent linking group containing an aliphatic group, an aromatic group, a heterocyclic group or a group comprising a combination of these groups; and $M_{101}$ is a hydrogen atom or a cation;

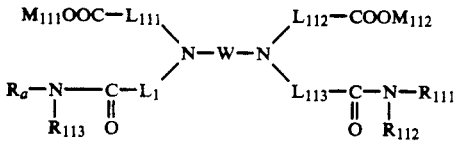

(XI)

where $R_a$, $R_{111}$, $R_{112}$ and $R_{113}$ each represents a hydrogen atom, an aliphatic group, an aromatic group, or a heterocyclic group;

$L_1$, $L_{111}$, $L_{112}$ and $L_{113}$ each represents a divalent linking group containing an aliphatic group, an aromatic group, a heterocyclic group or a group comprising a combination of these groups;

$M_{111}$ and $M_{112}$ each represent a hydrogen atom or a cation; and

W represents a divalent linking group;

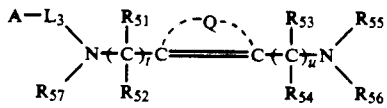

(XIV)

-continued

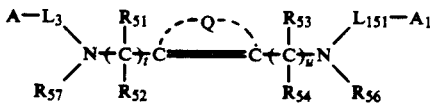

(XV)

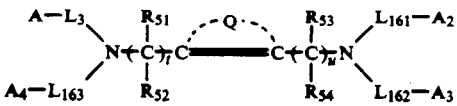

(XVI)

where

A, $A_1$, $A_2$, $A_3$ and $A_4$ each represents a carboxyl group, a phosphono group, a sulfo group, or a hydroxyl group;

$L_3$, $L_{151}$, $L_{161}$, $L_{162}$ and $L_{163}$ each represents a divalent linking group containing an aliphatic group, an aromatic group, a heterocyclic group or a group comprising a combination of these groups;

$R_{51}$, $R_{52}$, $R_{53}$, $R_{54}$, $R_{55}$, $R_{56}$ and $R_{57}$ may be same or different and each represents a hydrogen atom, an aliphatic group, an aromatic group, or a heterocyclic group;

Q represents a non-metallic atomic group capable of forming a 5-membered or 6-membered ring; and t and u each represents 0 or 1.

2. The method of processing a silver halide color photographic material as in claim 1, wherein the bath having a bleaching ability is a bleaching bath or a bleach-fixing bath.

3. The method of processing a silver halide color photographic material as in claim 1, wherein the bath having a fixing ability is a fixing bath or a bleach-fixing bath.

4. The method of processing a silver halide color photographic material as in claim 1, wherein the center metal of the metal chelate compound is selected from the group consisting of Fe(III), Mn(III), Co(III), Rh(II), Rh(III), Au(III), Au(II) and Ce(IV).

5. The method of processing a silver halide color photographic material as in claim 1, wherein the compounds of formula (A) are represented by formula (D):

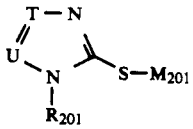

(D)

where $M_{201}$ and $R_{201}$ have the same meanings as those in formula (A); T and U each represent $C—R_{202}$ or N;

$R_{202}$ represents a hydrogen atom, a halogen atom, a hydroxyl group, a nitro group, an alkyl group, an alkenyl group, an aralkyl group, an aryl group, a carbonamido group, a sulfonamido group, an ureido group, a thioureido group, or $R_{201}$;

provided that when $R_{202}$ in $C—R_{202}$ represents $R_{201}$, $R_{201}$ in $C—R_{201}$ may be same as or different from $R_{201}$ in formula (D).

6. The method of processing a silver halide color photographic material as in claim 1, wherein the compounds of formula (B) are represented by formula (E):

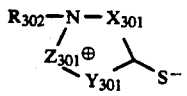

(E)

where $X_{301}$ represents N or C—$R_{303}$;

$Y_{301}$ represents O, S, N or N—$R_{304}$;

$Z_{301}$ represents N, N—$R_{305}$ or C—$R_{306}$;

$R_{302}$, $R_{303}$, $R_{304}$, $R_{305}$ and $R_{306}$ each represent an alkyl group, a cycloalkyl group, an alkenyl group, an alkynyl group, an aryl group, a heterocyclic group, an amino group, an acylamino group, a sulfonamido group, an ureido group, a sulfoamoylamino group, an acyl group, a thioacyl group, a carbamoyl group or a theiocarbamoyl group; or $R_{303}$ and $R_{306}$ each represent a hydrogen atom; and $R_{302}$ and $R_{303}$, $R_{302}$ and $R_{305}$, $R_{302}$ and $R_{306}$, $R_{304}$ and $R_{305}$, and $R_{304}$ and $R_{306}$ may bond together to form a ring.

* * * * *